US010000334B2

(12) United States Patent
Nose et al.

(10) Patent No.: US 10,000,334 B2
(45) Date of Patent: Jun. 19, 2018

(54) LIQUID HOLDING CONTAINER

(71) Applicant: SEIKO EPSON CORPORATION, Tokyo (JP)

(72) Inventors: Hiroshi Nose, Nagano (JP); Masahiro Karasawa, Nagano (JP); Yuji Aoki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 555 days.

(21) Appl. No.: 14/288,841

(22) Filed: May 28, 2014

(65) Prior Publication Data

US 2014/0361023 A1 Dec. 11, 2014

(30) Foreign Application Priority Data

Jun. 5, 2013 (JP) ..... 2013-118568

(51) Int. Cl.
*B65D 85/804* (2006.01)
*B41J 2/175* (2006.01)

(52) U.S. Cl.
CPC ..... *B65D 85/804* (2013.01); *B41J 2/17513* (2013.01); *B41J 2/17563* (2013.01)

(58) Field of Classification Search
CPC .. B65D 85/804; B41J 2/17563; B41J 2/17513
USPC ..... 210/448, 451, 453, 455; 347/86, 93, 85
See application file for complete search history.

(56) References Cited

U.S. PATENT DOCUMENTS 4,066,556 A * 1/1978 Vaillancourt ..... A61M 5/165 210/448
5,583,549 A 12/1996 Ujita et al.
5,589,862 A 12/1996 Ujita et al.
5,781,213 A 7/1998 Ujita et al.
6,170,939 B1 1/2001 Ujita et al.
6,189,704 B1 * 2/2001 Dennehey ..... A61B 10/025 210/435
2002/0109760 A1 8/2002 Miyazawa et al.
2002/0154200 A1 10/2002 Mlyazawa et al.
2004/0160481 A1 8/2004 Miyazawa et al.
2004/0201655 A1 10/2004 Miyazawa et al.
(Continued)

FOREIGN PATENT DOCUMENTS

EP 0738605 A2 10/1996
EP 0759362 A2 2/1997
(Continued)

OTHER PUBLICATIONS

The Extended European Search Report for the corresponding European Application No. 14170904.8 dated Apr. 21, 2016.

*Primary Examiner* — Madeline Gonzalez

(57) ABSTRACT

A liquid holding container having an ink pack constituted by a sheet member, capable of housing ink inside, a flow path member extending through the sheet member, between the outside and inside of the ink pack, and having a flow path capable of delivering ink from the inside to the outside of the ink pack, and a filter provided in the flow path member inside the ink pack. The flow path member and the sheet member are joined, and the flow path extends further to the inside of the ink pack than the end part which is the junction part at the position of the sheet member joined with the flow path member. At the flow path member, the filter is provided at a site further to the inside of the ink pack than the junction part.

17 Claims, 45 Drawing Sheets

(56) References Cited

U.S. PATENT DOCUMENTS

| | | | | |
|---|---|---|---|---|
| 2004/0239736 | A1 | 12/2004 | Miyazawa et al. | |
| 2006/0139424 | A1 | 6/2006 | Miyazawa et al. | |
| 2007/0070136 | A1* | 3/2007 | Hattori ..... | B41J 2/17506 347/86 |
| 2007/0229629 | A1 | 10/2007 | Miyazawa et al. | |
| 2008/0094429 | A1 | 4/2008 | Miyazawa et al. | |
| 2008/0192097 | A1 | 8/2008 | Miyazawa et al. | |

FOREIGN PATENT DOCUMENTS

| | | | |
|---|---|---|---|
| EP | 1053876 | A2 | 11/2000 |
| EP | 1769922 | A1 | 4/2007 |
| GB | 2269784 | A | 2/1994 |
| JP | 06-071900 | A | 3/1994 |
| JP | 09-099563 | A | 4/1997 |
| JP | 2004-203059 | A | 7/2004 |
| JP | 2007-112057 | A | 5/2007 |
| JP | 2011-148221 | A | 8/2011 |
| WO | 98/55318 | A1 | 12/1998 |

* cited by examiner

LIQUID HOLDING CONTAINER

CROSS-REFERENCE TO RELATED APPLICATIONS

This application claims priority to Japanese Patent Application No. 2013-118568 filed on Jun. 5, 2013. The entire disclosure of Japanese Patent Application No. 2013-118568 is hereby incorporated herein by reference.

BACKGROUND

Technical Field

The present invention relates to a liquid holding container or the like.

Related Art

As one liquid holding container which is a container for housing liquid, there is an ink cartridge used for inkjet recording devices. For this kind of ink cartridge, there are items for which after sealing ink inside a bag shaped pack constituted by flexible sheet members or the like, that pack is housed in a case constituted by synthetic resin or the like. With this kind of pack, in the past, items are known for which a filter is installed on a supply port part for delivering the ink inside the pack to the inkjet recording device (see Japanese Unexamined Patent Publication No. 2011-148221, for example).

SUMMARY

In general, the kind of pack noted above is often constituted in a bag shape by adhering flexible sheet members. To adhere the flexible sheet members, a joining method such as welding is used. By adhering the sheet members using welding or the like, the sealing properties of the bag form pack are increased. However, with welding, the item subject to welding is typically pressurized and heated. With the pack noted in the Japanese Unexamined Patent Publication No. 2011-148221 and Japanese Unexamined Patent Publication No. 2007-112057, the filter overlaps the welding area of the bag form pack. With this constitution, when the pack is welded, it is possible that the filter will also undergo the pressurization or heating applied with welding. When pressurization or heating applied with welding is applied to the filter, there are cases when the supply of ink is obstructed due to damage to the filter. Thus, with conventional liquid holding containers, there was the problem that the supply of liquid was obstructed.

The present invention was created to address at least a portion of the problems described above, and can be realized as the following modes or aspects.

A liquid holding container includes a housing unit, a flow path member and a filter. The housing unit is constituted in a bag form by a flexible sheet member, and configured and arranged to house liquid inside. The flow path member extends through the sheet member between an outside and an interior of the housing unit, the flow path member defining a flow path configured and arranged to deliver the liquid from the interior of the housing unit to the outside of the housing unit. The filter is disposed in the flow path member in the interior of the housing unit. The flow path member and the sheet member are joined at a junction part. The flow path extends further to an inside of the housing unit than the junction part. The filter in the flow path member is disposed at a site further to the inside of the housing unit than the junction part.

With the liquid holding container of this aspect, a flow path that is capable of delivering liquid from the interior of the housing unit to outside the housing unit extends further to the inside of the housing unit than the junction part of the sheet member and the flow path member. Also, the filter is provided at a site further to the inside of the housing unit than the junction part. By doing this, the filter is displaced from the junction part, so it is easy to avoid having the stress applied to the junction of the sheet member and the flow path member act on the filter. Because of this, it is easy to avoid damage to the filter. As a result, it is easy to avoid obstruction of delivery of liquid from the interior of the housing unit to outside.

In the liquid holding container noted above, the flow path member is preferably constituted by a plurality of members including a first flow path member exposed to the outside of the housing unit, and a second flow path member housed in the interior of the housing unit, and the filter is preferably disposed in the second flow path member.

With this aspect, the flow path member is constituted by a plurality of members including the first flow path member and the second flow path member. Also, the filter is provided in the second flow path member. By doing this, for example, when using a constitution with the filter omitted with the liquid holding container, it is possible to use a constitution with that omitted for each second flow path member. In this way, it is possible share a constitution with the second flow path member removed for the constitution using the filter and the constitution omitting the filter.

In the liquid holding container noted above, a link between the first flow path member and the second flow path member is preferably covered by the junction part.

With this aspect, the link between the first flow path member and the second flow path member is covered by the junction part. By doing this, it is easy to avoid having the liquid inside the housing unit flow into the flow path from the link between the first flow path member and the second flow path member, specifically, from flowing into the flow path without going via the filter.

In the liquid holding container noted above, the junction part preferably extends to a periphery of the flow path member, and when an area enclosed by the junction part is seen in a plan view, the second flow path member and the filter are preferably inside the area.

With this aspect, the second flow path member and the filter are inside the area enclosed by the junction part, so it is easy to suppress the housing unit to a small thickness.

In the liquid holding container noted above, a largest surface, for which a surface area is greatest among a plurality of surfaces constituting an external outline of the filter, is preferably parallel to a surface for which a surface area is greatest among a plurality of surfaces constituting an external outline of the housing unit.

With this aspect, by making the filter larger along the surface for which the surface area is greatest among the plurality of surfaces constituting the external outline of the housing unit, it is possible to expand the surface area of the filter while suppressing the housing unit thickness to be small.

In the liquid holding container noted above, the flow path member preferably includes a convex part protruding further outward than the filter.

With this aspect, by the liquid inside the housing unit being consumed, when the liquid volume inside the housing unit decreases, there are cases when the housing unit collapses according to the consumption volume of the liquid. When the housing unit collapses, it is easier for the sheet member to contact the filter. When the sheet member contacts the filter, the liquid inside the housing unit has a difficult time passing through the filter. As a result, it is easy for the delivery of liquid from inside the housing unit to outside to be obstructed. In response to this kind of situation, with this liquid holding container, it is easier to ensure a gap between the sheet member and the filter using a convex part provided protruding further outward than the filter. By doing this, it is easy to avoid the filter being covered by the sheet member. As a result, it is easy to avoid obstruction of the delivery of liquid from the interior of the housing unit to outside.

In the liquid holding container noted above, the flow path member preferably includes a plurality of the convex parts, and the plurality of convex parts are preferably provided in a periphery of the filter.

With this aspect, a plurality of convex parts are provided, so it is even easier to ensure a gap between the sheet member and the filter. As a result, it is even easier to avoid obstruction of the delivery of liquid from the interior of the housing unit to outside.

In the liquid holding container noted above, at least one of the plurality of convex parts preferably includes a through hole extending through the at least one of the convex parts in a direction intersecting a direction orthogonal to the largest surface of the filter.

With this aspect, a through hole is provided on at least one convex part, so even if the sheet member contacts the convex part, it is easy to ensure a liquid flow path via the through hole. As a result, it is even easier to avoid obstruction of the delivery of the liquid from the interior of the housing unit to outside.

In the liquid holding container noted above, the flow path member preferably includes an opening part extending through the flow path member in a direction intersecting the largest surface further to the outside than the area of the largest surface of the filter.

With this aspect, an opening part is provided on the flow path member, so it is easy to ensure a liquid flow path that pierces the flow path member in the direction intersecting the largest surface. As a result, it is even easier to avoid obstruction of the delivery of liquid from the interior of the housing unit to outside.

In the liquid holding container noted above, the flow path member preferably includes a plurality of the opening parts, and in the orientation when the liquid holding container is used, a first opening part among the plurality of the opening parts is preferably positioned further downward in a vertical direction than the filter, and a second opening part among the plurality of the opening parts is preferably positioned further upward in the vertical direction than the first opening part.

With this aspect, in the orientation when the liquid holding container is used, a first opening part which is one of the plurality of opening parts is positioned further downward in the vertical direction than the filter, and a second opening part which is another one of the plurality of opening parts is positioned further upward in the vertical direction than the first opening part, so even when a concentration difference occurs in the ink inside the housing unit due to precipitation of pigment or the like contained in the ink, it is possible to mix and supply to the printing device ink of a higher concentration than the average of the ink concentration inside the housing unit from the first opening positioned below, and the ink of a lower concentration than the average of the ink concentration inside the housing unit from the second opening positioned above, making it possible to ease the concentration difference.

In the liquid holding container noted above, the second flow path member preferably includes a base part, a first site protruding from the base part with the filter being disposed in the first site, and a second site protruding from the base part and connected to the first site.

With this aspect, a second site connected to the first site protruding from the base part is provided on the second flow path member, so it is possible to lighten the inclination of the first site to the base part.

In the liquid holding container noted above, the second site preferably has a plate shape continuous with the first site, the second site preferably includes a gate part which is convex facing toward the sheet member, and the gate part preferably protrudes further toward the sheet member than the filter.

With this aspect, a gate part is provided on the second site, so it is easier to ensure a gap between the sheet member and the filter. By doing this, it is easier to avoid the filter being covered by the sheet member. As a result, it is even easier to avoid obstruction of the delivery of the liquid from the interior of the housing unit to outside.

In the liquid holding container noted above, in the orientation in which the liquid holding container is used, the filter preferably extends further to a downward side than a center of the housing unit in a vertical direction.

With this aspect, the filter extends further to the downward side than the center of the housing unit in the vertical direction, so even if the liquid inside the housing unit is consumed and the liquid remaining in the housing unit concentrates to the downward side of the housing unit, it is easier for the liquid remaining inside the housing unit to be introduced inside the flow path via the filter. As a result, even if the liquid inside the housing unit is consumed, the liquid remaining inside the housing unit is easily delivered stably to outside the housing unit.

In the liquid holding container noted above, a largest surface, for which a surface area is greatest among a plurality of surfaces constituting an external outline of the filter, preferably intersects a surface for which a surface area is greatest among a plurality of surfaces constituting an external outline of the housing unit.

With this aspect, the largest surface of the filter intersects the surface for which the surface area is greatest among the plurality of surfaces constituting the external outline of the housing unit, so it is easy to avoid the filter being blocked by the sheet member. As a result, it is easy to avoid obstruction of the delivery of liquid inside housing unit to the outside.

In the liquid holding container noted above, the junction part preferably extends to a periphery of the flow path member, and when an area enclosed by the junction part is seen in a plan view, the filter preferably extends from within the area to outside the area.

With this aspect, the filter extends from within the area enclosed by the junction part to outside the area, so it is easy to expand the surface area of the filter. By doing this, it is possible to reduce the flow path resistance of the liquid flow path due to the filter.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
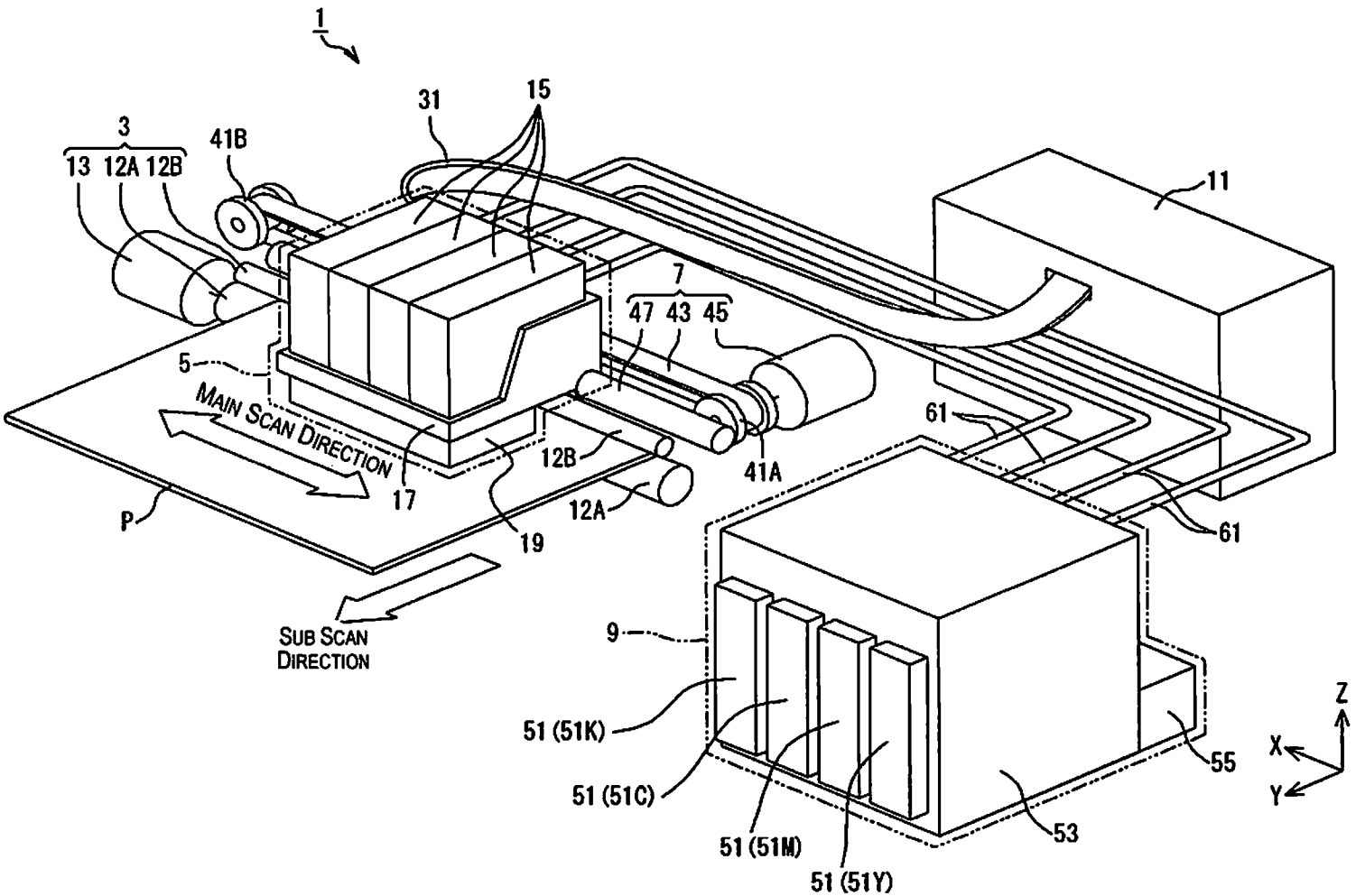
FIG. 1 is a perspective view showing the main constitution of the printer of this embodiment.

Using an example of a printer which is one liquid spraying device, we will describe an embodiment while referring to the drawings. In each drawing, to make a size of a level for which each respective constitution is visible, the constitution and member scale may be different.

As shown in FIG. 1, a printer 1 of this embodiment has a conveyance device 3, a recording unit 5, a moving device 7, an ink supply unit 9, and a control unit 11. In FIG. 1, to make it easier to understand, a mutually orthogonal X axis, Y axis, and Z axis are shown. The mutually orthogonal X axis, Y axis, and Z axis will be added as necessary to drawings shown hereafter. Also, the X axis, Y axis, and Z axis in FIG. 1 correspond respectively to the X axis, Y axis, and Z axis in other drawings.

The conveyance device 3 intermittently conveys a recording medium P of recording paper or the like in the sub scan direction in the drawing. The recording unit 5 performs recording using ink on the recording medium P conveyed by the conveyance device 3. The moving device 7 moves the recording unit 5 back and forth in the main scan direction in the drawing. The ink supply unit 9 supplies ink to the recording unit 5. The control unit 11 controls driving of each of the aforementioned constitutions. With this embodiment, in the printer 1 usage state, the main scan direction corresponds to the X axis direction, and the sub scan direction corresponds to the V axis direction.

As shown in FIG. 1, the conveyance device 3 has a drive roller 12A, a driven roller 12B, and a conveyance motor 13. The drive roller 12A and the driven roller 12B are constituted to be able to rotate while having their outer circumferences in contact with each other. The conveyance motor 13 generates force for driving the rotation of the drive roller 12A. The force from the conveyance motor 13 is transmitted to the drive roller 12A via a transmission mechanism. Also, the recording medium P gripped between the drive roller 12A and the driven roller 12B are intermittently conveyed in the sub scan direction.

The recording unit 5 is equipped with four relay units 15, a carriage 17, and a recording head 19. The relay units 15 relay ink supplied from the ink supply unit 9 to the recording head 19. The recording head 19 sprays the ink as ink droplets, and performs recording on the recording medium P. The carriage 17 has mounted on it four relay units 15 and the recording head 19. The recording head 19 is connected to the control unit 11 via a flexible cable 31. The spraying of the ink droplets from the recording head 19 is controlled by the control unit 11.

As shown in FIG. 1, the moving device 7 is equipped with a timing belt 43, a carriage motor 45, and a guide shaft 47. The timing belt 43 is stretched between pair of pulleys 41A and 41B. The pair of pulleys 41A and 41B are aligned along the main scan direction. Because of this, the timing belt 43 is stretched along the main scan direction. The carriage motor 45 generates force for driving the rotation of the pulley 41A. The guide shaft 47 extends in the main scan direction. The guide shaft 47 is supported in a case (not illustrated) at both ends, and guides the carriage 17 in the main scan direction.

With this embodiment, the state with the printer 1 arranged on a horizontal plane defined by the main scan direction and the sub scan direction is the printer 1 usage state. In the printer 1 usage state, the direction orthogonal to both the conveyance direction and the main scan direction is the vertical direction. The direction orthogonal to the conveyance direction and the main scan direction is noted as the Z axis direction. In the printer 1 usage state, the Z axis direction is the vertical direction. Also, in the printer 1 usage state, in FIG. 1, the direction facing from the recording head 19 toward the recording medium P, specifically the Z axis negative direction, is the vertical downward direction.

The carriage 17 is fixed to a portion of the timing belt 43. Power is transmitted to the carriage 17 from the carriage motor 45 via the pulley 41A and the timing belt 43. Also, the carriage 17 is constituted to be able to move back and forth in the main scan direction by the transmitted power.

As shown in FIG. 1, the ink supply unit 9 has a cartridge 51 as a liquid holding container, a holder 53, and a pump unit 51. With this embodiment, the ink supply unit 9 includes a plurality of cartridges 51 (four with this embodiment). The holder 53 holds four cartridges 51. The four cartridges 51 are constituted to be detachable in relation to the holder 53. Ink is housed in each cartridge 51. The ink is housed inside the cartridge 51 in a state tightly sealed in the ink pack constituted by flexible sheets. With the printer 1, when the ink inside the ink pack is consumed, this is replaced with a new cartridge 51.

Mutually different types of ink are stored in the four cartridges 51. With this embodiment, yellow (Y), magenta (M), cyan (C), and black (K) inks are housed in respectively different cartridges 51. Hereafter, when distinguishing the four cartridges 51 for each type of ink, the four cartridges 51 will be noted as cartridge 51Y, cartridge 51M, cartridge 51C, and cartridge 51K. The ink pack in which yellow ink is sealed is housed in the cartridge 51Y. Similarly, the ink pack in which magenta ink is sealed is housed in the cartridge 51M, the ink pack in which cyan ink is sealed is housed in the cartridge 51C, and the ink pack in which black ink is sealed is housed in the cartridge 51K.

An ink supply tube 61 is connected to the ink pack inside each cartridge 51. The ink supply tube 61 is connected to the relay unit 15 of the recording unit 5 at the side opposite to the cartridge 51 side. The pump unit 55 pumps the ink inside the cartridge 51 mounted in the holder 53. Also, the pump unit 55 sends the ink pumped from the cartridge 51 to the relay unit 15 via the ink supply tube 61. By doing this, the ink inside the cartridge 51 is supplied to the recording head 19 via the relay unit 15. Also, the ink supplied to the recording head 19 is sprayed as ink droplets from nozzles (not illustrated) facing the recording medium P side.

With the printer 1 having the constitution noted above, the driving of the conveyance motor 13 is controlled by the control unit 11, and the conveyance device 3 intermittently conveys the recording medium P in the sub scan direction while having it face opposite the recording head 19. At this time, the control unit 11 controls the driving of the carriage motor 45, and while moving the carriage 17 back and forth in the main scan direction, controls the driving of the recording head 19, and sprays ink droplets at designated positions. With this kind of operation, dots are formed on the recording medium P, and recording is performed on this recording medium P based on the recording information of image data and the like.

Figure 2:
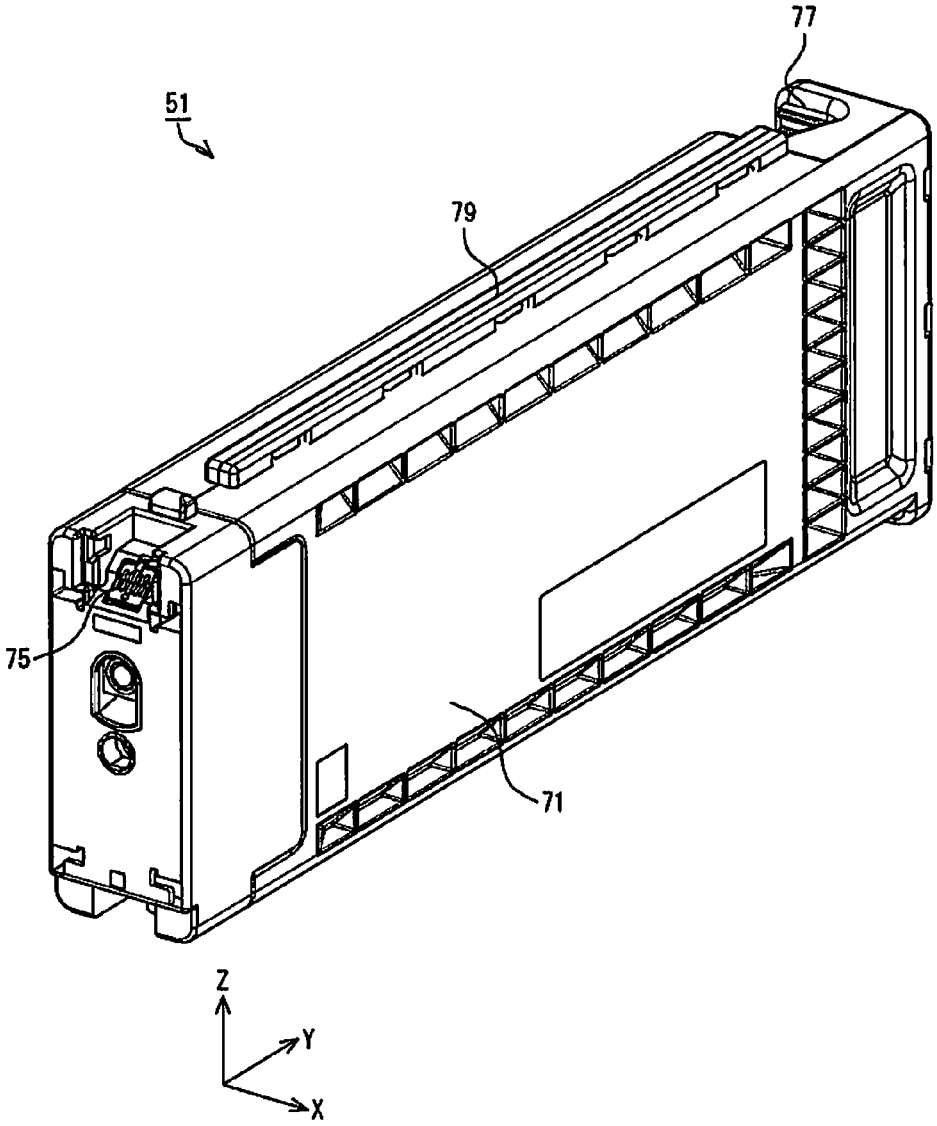
FIG. 2 is a perspective view showing the cartridge of this embodiment.

As shown in FIG. 2, the cartridge 51 has a case 71 and a substrate 75. Provided on the case 71 are a handle part 77 and rail part 79. When the user attaches and detaches the cartridge 51 to the holder 53 (FIG. 1), it is possible to grip the handle part 77 and grasp the cartridge 51. The substrate 75 is provided on the case 71. On the case 71, the substrate 75 is provided on the side opposite to the handle part 77 side of the case 71. A plurality of terminals are provided on the substrate 75. Also, on the reverse side of the substrate 75, a storage device (not illustrated) is provided electrically connected to the terminals of the substrate 75. Recorded in the storage device is for example information related to the ink housed in the cartridge 51 and the like.

When the cartridge 51 is mounted in the holder 53 (FIG. 1), it is inserted in the holder 53 from the side opposite to the handle part 77 side of the case 71, specifically, the substrate 75 side of the cartridge 51. At this time, by the rail part 79 of the cartridge 51 being inserted in the guide groove (not illustrated) of the holder 53, the cartridge 51 is guided along the Y axis direction inside the holder 53. A contact point mechanism (not illustrated) is provided inside the holder 53. The contact point mechanism inside the holder 53 is electrically connected to the control unit 11. When the cartridge 51 is mounted in the holder 53, the plurality of terminals of the substrate 75 abut the contact point mechanism inside the holder 53. By doing this, it is possible to transfer information between the storage device provided on the substrate 75 and the control unit 11.

Figure 3:
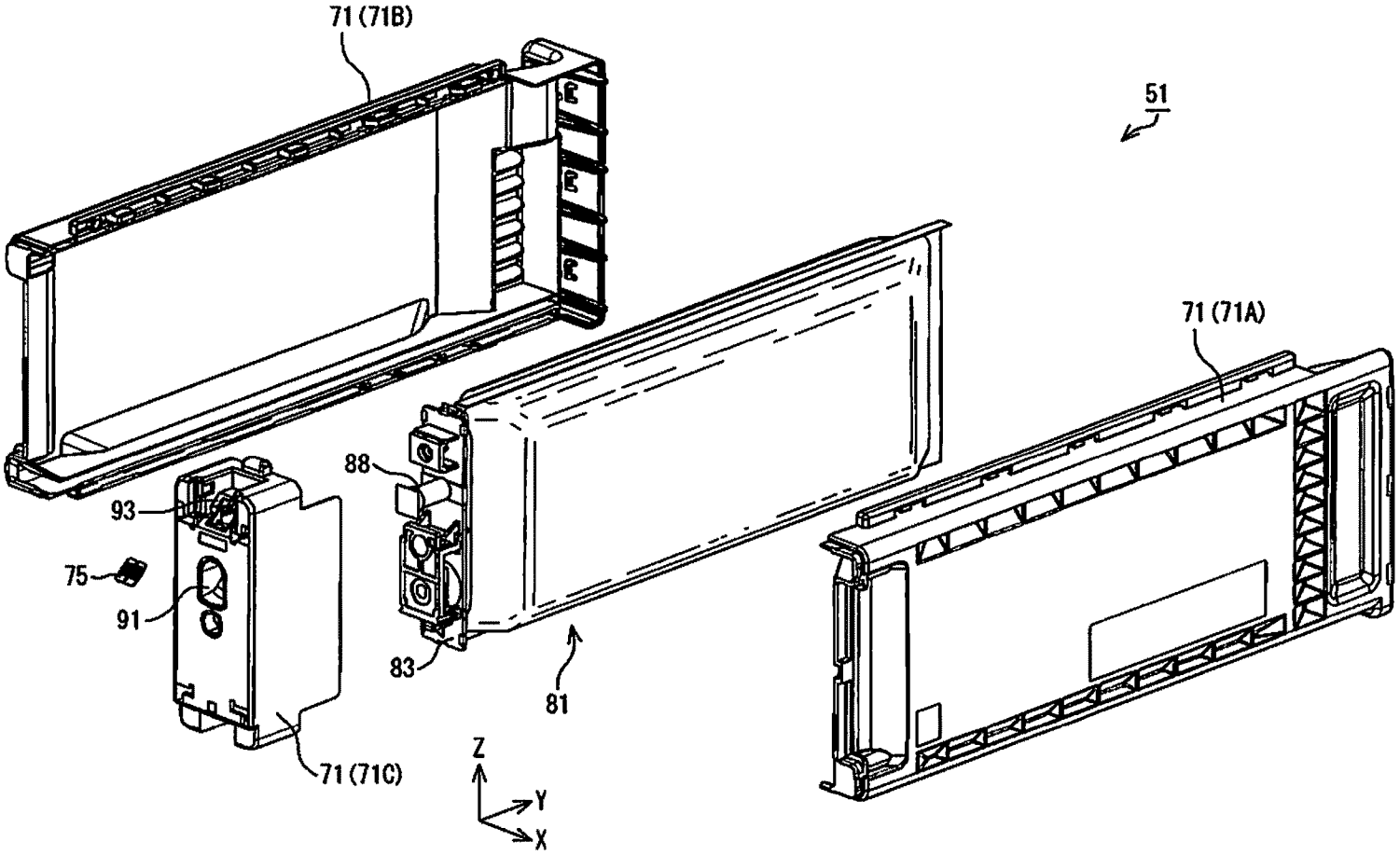
FIG. 3 is an exploded perspective view showing the cartridge of this embodiment.

As shown in FIG. 3, the case 71 has a first case 71A, a second case 71B, and a third case 71C. Also, the cartridge 51 has a pack unit 81. The substrate 75 is provided on the third case 71C. When the first case 71A, the second case 71B, and the third case 71C are assembled as the case 71, a space is formed inside the case 71. The pack unit 81 is housed in the space inside the case 71.

Embodiment 1

Figure 4:
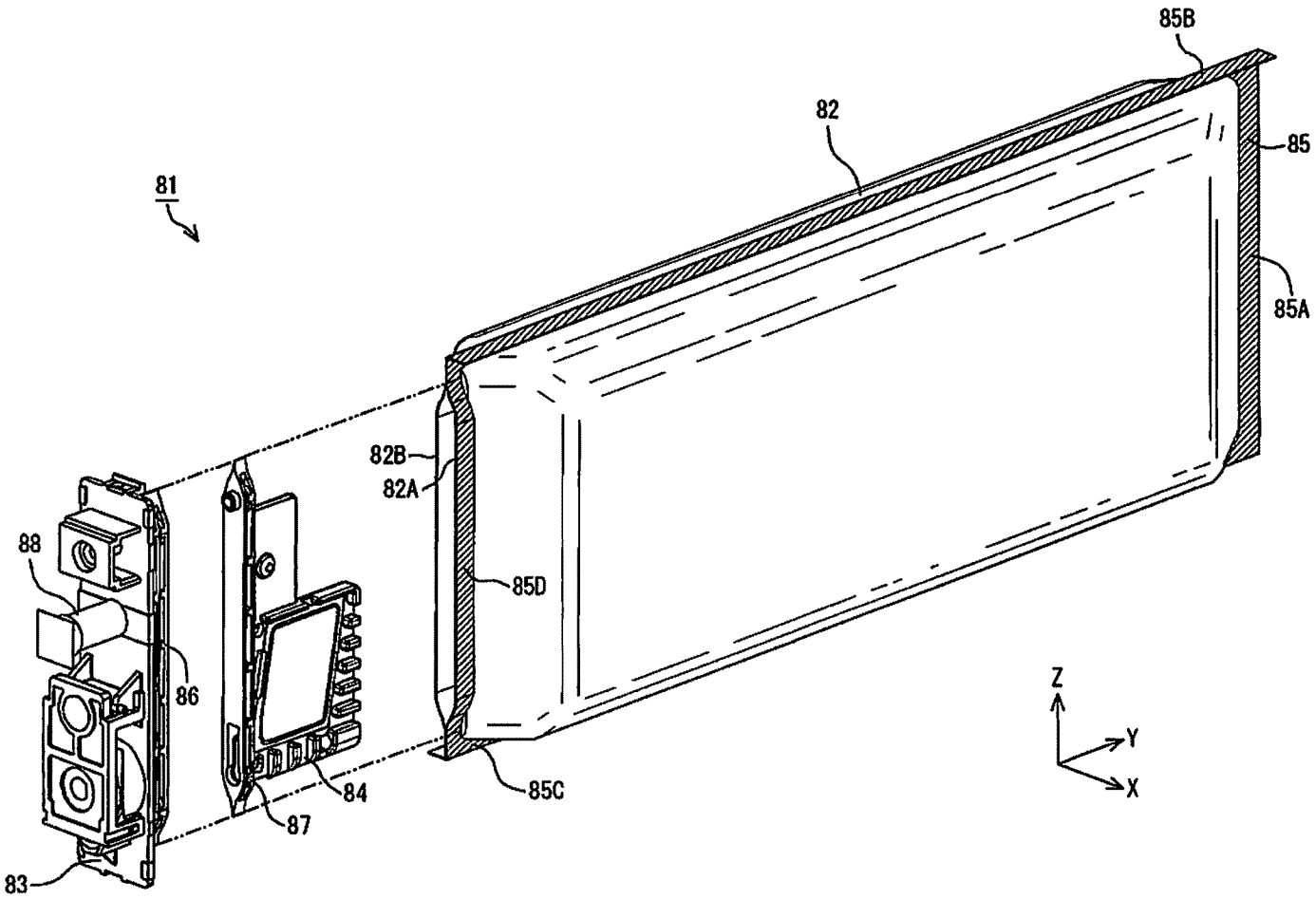
FIG. 4 is an exploded perspective view showing the pack unit of embodiment 1.

As shown in FIG. 4, the pack unit 81 of embodiment 1 has an ink pack 82 as the housing unit, a flow path unit 83, and a filter unit 84. The ink pack 82 has a sheet 82A as a sheet member and a sheet 82B as a sheet member. The sheet 82A and the sheet 82B are mutually welded at a peripheral edge area 85 in a state mutually overlapping. By doing this, the ink pack 82 is in a bag form mode. Ink is housed inside the ink pack 82.

Hereafter, of the peripheral edge area 85, when distinguishing the end part of the Y axis direction of the ink pack 82 from other sites of the peripheral edge area 85, the end part of the Y axis direction of the ink pack 82 is noted as end part 85A. Also, of the peripheral edge area 85, when distinguishing the end part in the upward part of the Z axis direction from other sites of the peripheral edge area 85, the end part in the upward part of the Z axis direction is noted as end part 85B. Similarly, of the peripheral edge area 85, when distinguishing the end part in the downward part of the Z axis direction from other sites of the peripheral edge area 85, the end part in the downward part of the Z axis direction is noted as end part 85C. In this case, the end part 85A is positioned in the Y direction which is the direction intersecting the direction for which the end part 85B and the end part 85C are connected in the Z axis direction. Also, in the Y axis direction, the end part on the side opposite the end part 85A is noted as end part 85D.

As the material for the respective sheet 82A and sheet 82B, it is possible to use polyethylene terephthalate (PET), nylon, polyethylene or the like, for example. It is also possible to use a laminated structure for which film constituted with these materials is laminated. With this kind of laminated structure, for example, it is possible to use PET or nylon which has excellent shock resistance for the outer layer, and to use polyethylene which has excellent ink resistance for the inner layer. Furthermore, it is possible to use a film or the like having a layer with aluminum or the like vapor deposited. By doing this, it is possible to increase the gas barrier properties.

The flow path unit 83 is sandwiched by the sheet 82A and the sheet 82B at the end part 85D of the peripheral edge area 85. The flow path unit 83 and the sheet 82A are welded to each other at the end part 85D of the peripheral edge area 85. Similarly, the flow path unit 83 and the sheet 82B are welded to each other at the end part 85D of the peripheral edge area 85. Because of this, the end part 85D of the peripheral edge area 85 is the junction part with the flow path unit 83. A welded part 86 is provided on the flow path unit 83. In a state with the welded part 86 sandwiched by the sheet 82A and the sheet 82B, the sheet 82A and the sheet 82B are respectively welded to the welded part 86. By having the sheet 82A, the sheet 82B, and the flow path unit 83 joined to each other, the ink pack 82 functions as a bag for housing the ink.

Figure 5:
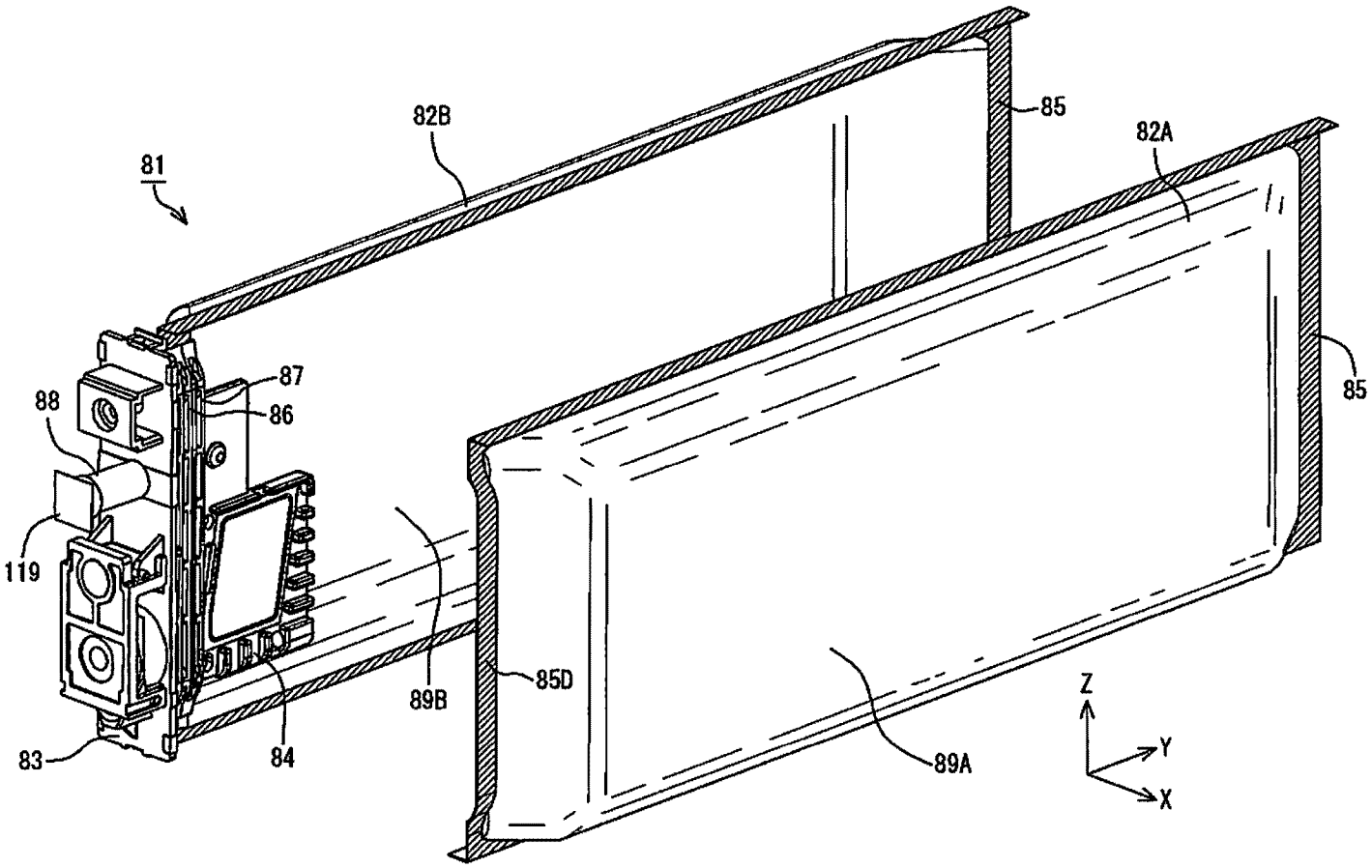
FIG. 5 is an exploded perspective view showing the pack unit of embodiment 1.

The filter unit 84 is housed inside the ink pack 82. The filter unit 84 supplies the ink inside the ink pack 82 to the flow path unit 83 through a filter described later. As shown in FIG. 5, the filter unit 84 is housed inside the ink pack 82 in a state linked to the flow path unit 83. As shown in FIG. 4, a welded part 87 is provided on the filter unit 84. The sheet 82A and the sheet 82B are respectively welded to the welded part 87 in a state with the welded part 87 sandwiched by the sheet 82A and the sheet 82B.

The filter unit 84 is sandwiched by the sheet 82A and the sheet 82B at the end part 85D of the peripheral edge area 85. The filter unit 84 and the sheet 82A are welded to each other at the end part 85D of the peripheral edge area 85. Similarly, the filter unit 84 and the sheet 82B are welded to each other at the end part 85D of the peripheral edge area 85. Because of this, the end part 85D of the peripheral edge area 85 is the junction part with the filter unit 84.

With embodiment 1, as shown in FIG. 5, the welded part 86 and the welded part 87 are sandwiched by the sheet 82A and the sheet 82B in a state with the flow path unit 83 and the filter unit 84 linked to each other. Also, the sheet 82A and the sheet 82B are respectively welded to the respective welded part 86 and welded part 87. The sheet 82A has a surface 89A along the YZ plane. Also, the sheet 82B has a surface 89B along the YZ plane. The surface 89A and the surface 89B are respectively one of the plurality of surfaces constituting the ink pack 82. Also, the surface 89A and the surface 89B are respectively the surfaces having the largest surface area among the plurality of surfaces constituting the ink pack 82.

A supply tube 88 is provided on the flow path unit 83. The interior and exterior of the ink pack 82 are put in communication via the supply tube 88. The supply tube 88 is blocked by a film 119 in the state before the cartridge 51 is mounted on the holder 53. By doing this, the interior of the ink pack 82 is kept in a sealed state. The supply tube 88 is exposed via an opening part 91 provided on the third case 71C shown in FIG. 3. Also, a recess part 93 is provided on the third case 71C. The substrate 75 is provided inside the recess part 93.

As shown in FIG. 1, the cartridge 51 having the constitution noted above is inserted along the Y axis direction in the holder 53. A hollow needle (not illustrated) is provided inside the holder 53. The hollow needle inside the holder 53 is in communication with the ink supply tube 61. When the cartridge 51 is mounted in the holder 53, the hollow needle inside the holder 53 is inserted in the supply tube 88 of the flow path unit 83 (FIG. 4). The film 119 is broken by the hollow needle inserted in the supply tube 88, and there is communication between the interior and exterior of the ink pack 82 via the hollow needle. By doing this, there is communication between the inside of the ink pack 82 and the ink supply tube 61 (FIG. 1), and the ink inside the ink pack 82 can be supplied to the ink supply tube 61.

Figure 6:
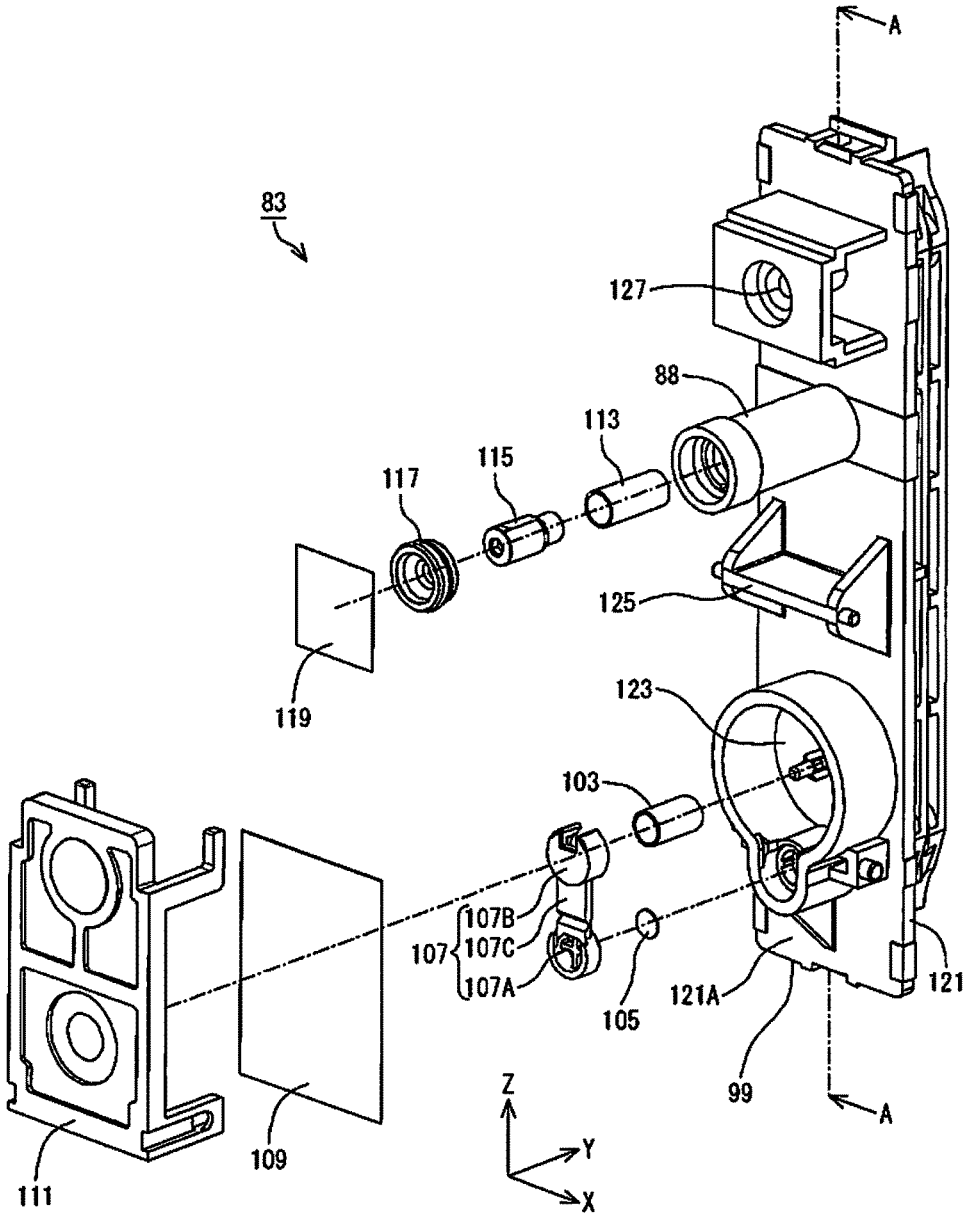
FIG. 6 is an exploded perspective view showing the schematic structure of the flow path unit of this embodiment.

We will give a detailed description of the flow path unit 83. As shown in FIG. 6, the flow path unit 83 has a first flow path member 99, a spring 103, a non-return valve 105, a pressure receiving member 107, a film 109, and a lever 111. The flow path unit 83 also has a spring 113, a plug 115, a packing 117, and a film 119. The first flow path member 99 has a base part 121, a cavity 123, a stopper 125, a supply tube 88, and an injection port 127. The base part 121 has a surface 121A facing the side opposite to the ink pack 82 side (FIG. 4). On the surface 121A, the cavity 123, the stopper 125, the supply tube 88, and the injection port 127 are provided protruding from the surface 121A toward the side opposite the ink pack 82 side.

The spring 103, the non-return valve 105, and the pressure receiving member 107 are housed inside the cavity 123. Also, the cavity 123 is blocked by the film 109 with the spring 103, the non-return valve 105, and the pressure receiving member 107 in a housed state. The lever 111 overlaps the cavity 123 over the film 109. The spring 113, the plug 115, and the packing 117 are housed inside the supply tube 88. The supply tube 88 is blocked by the film 119 with the spring 113, the plug 115, and the packing 117 in a housed state. With this embodiment, a compression coil spring is used respectively as the spring 103 and the spring 113.

Figure 7:
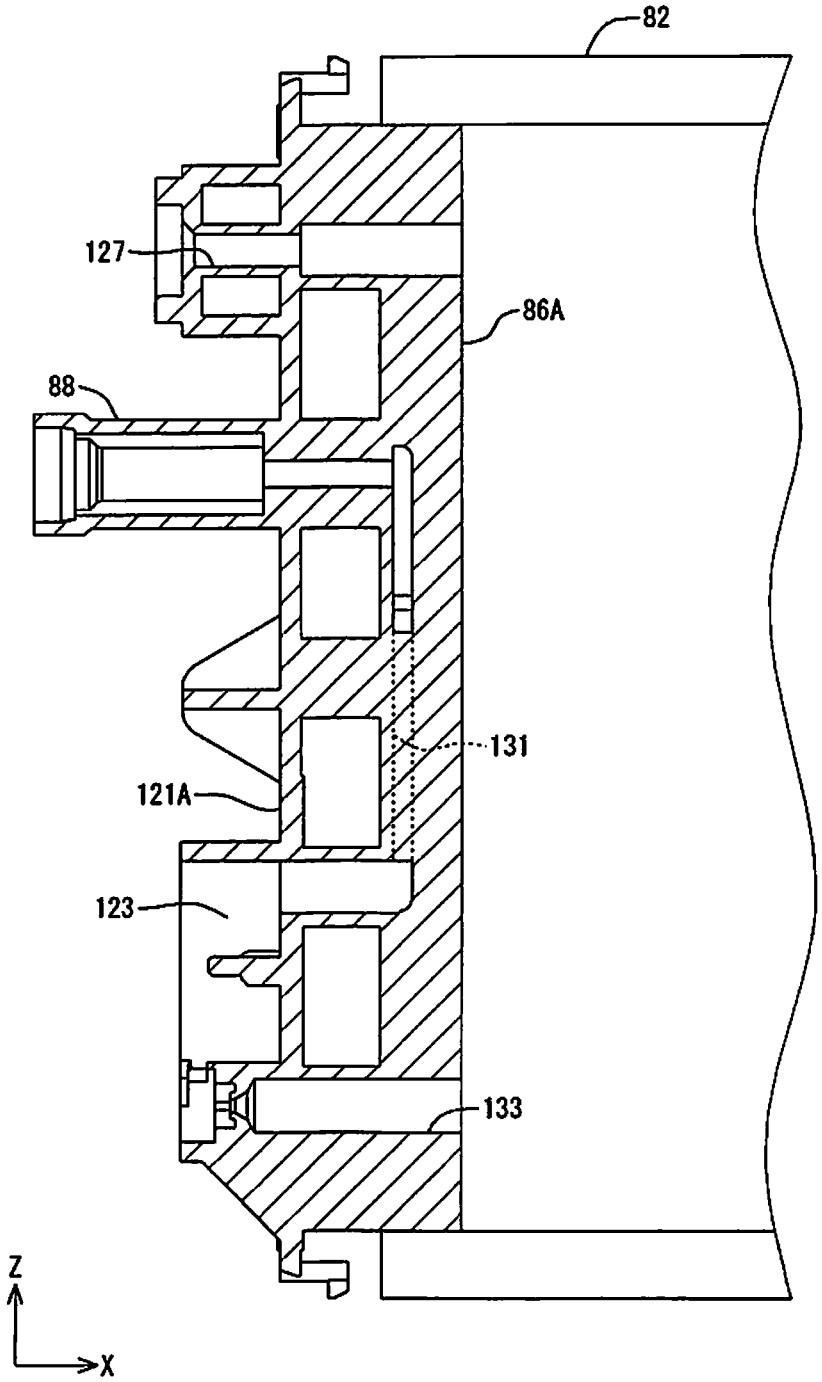
FIG. 7 is a cross section view of line A-A in FIG. 6.

As shown in FIG. 7 which is a cross section diagram of line A-A of FIG. 6, the cavity 123 and the supply tube 88 are in communication with each other via a flow path 131 provided on the ink pack 82 side of the surface 121A. In FIG. 7, an illustration of the filter unit 84 is omitted. Also, the cavity 123 and the ink pack 82 interior are in communication with each other by a flow path 133 provided on the ink pack 82 side of the surface 121A. The injection port 127 passes through the inside of the ink pack 82. The injection port 127 is blocked after the ink is injected into the ink pack 82.

Figure 8:
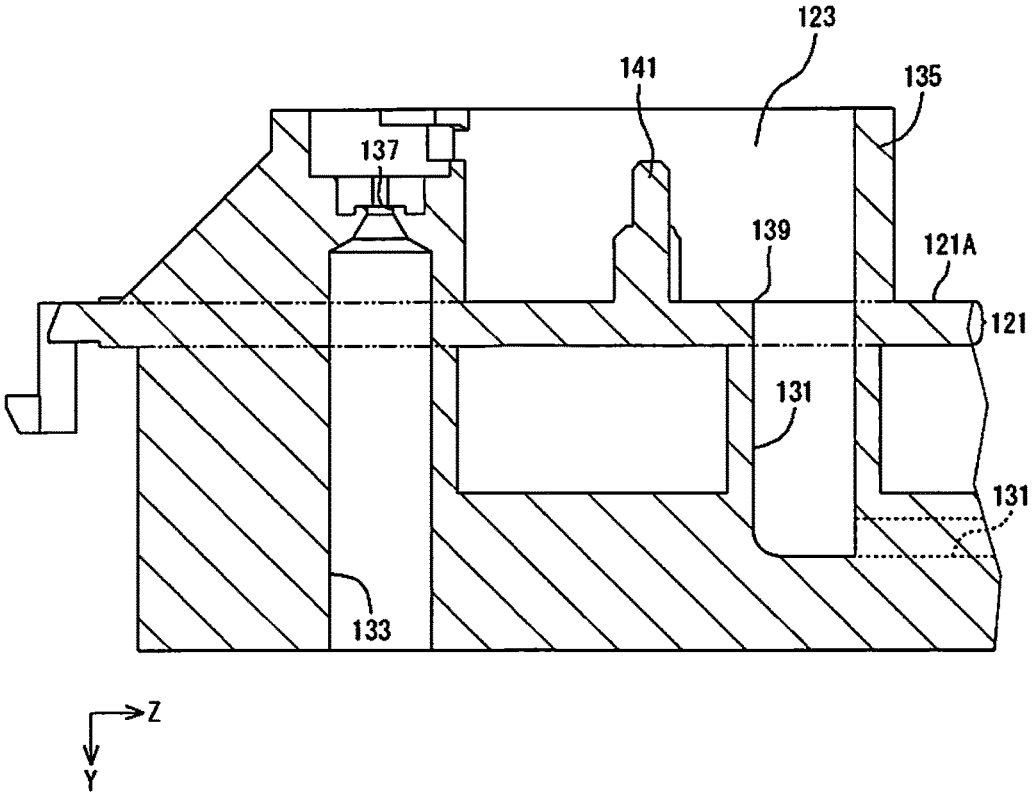
FIG. 8 is an enlarged view of the cavity in FIG. 7.

As shown in FIG. 8 which is an enlarged view of the cavity 123 in FIG. 7, the cavity 123 is enclosed by a side wall 135 which protrudes from the surface 121A toward the side opposite the flow path 131 side (ink pack 82 side). The cavity 123 exhibits a concave shape which is concave facing the surface 121A side at the inside of the area enclosed by the side wall 135. An inlet 137 and an outlet 139 are provided inside the cavity 123. The ink inside the ink pack 82 flows into the cavity 123 from the inlet 137 via the flow path 133. Also, the ink inside the cavity 123 flows out from the outlet 139 to the supply tube 88 (FIG. 7) via the flow path 131.

Figure 9:
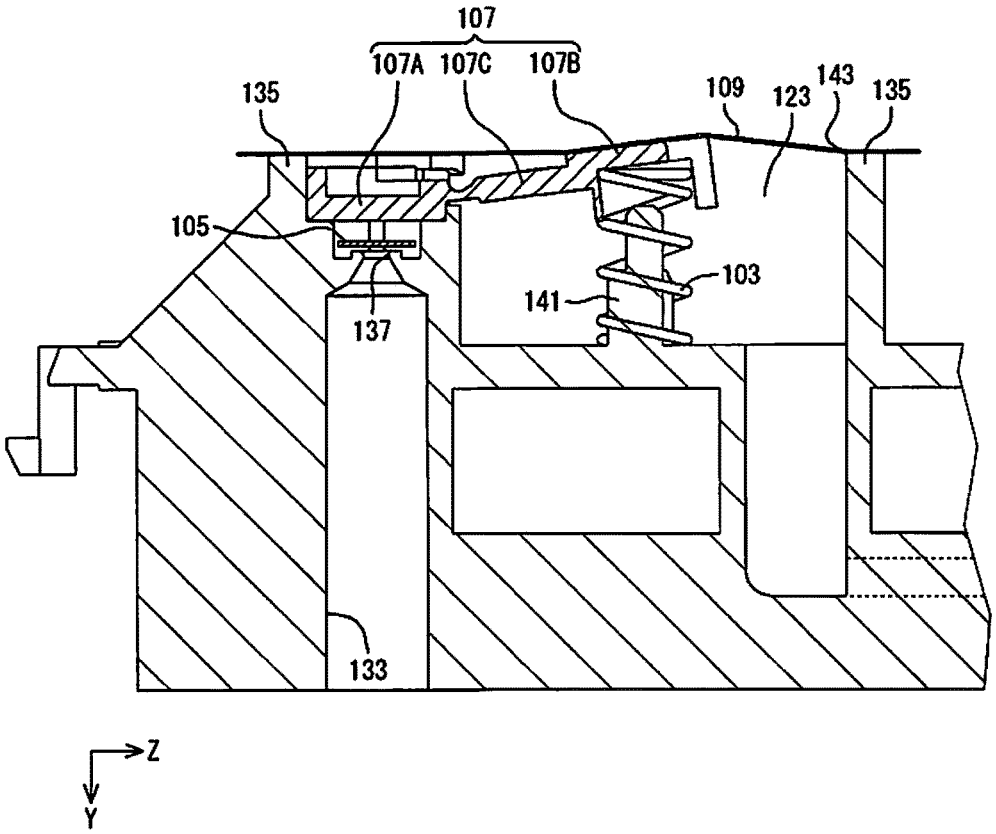
FIG. 9 is an enlarged view showing the site of the cavity in FIG. 7.

As shown in FIG. 8, a convex part 141 that is convex from the surface 121A facing the side opposite the base part 121 side is provided on the bottom of the cavity 123. The end part of the side opposite to the base part 121 side of the convex part 141 is positioned inside the cavity 123. As shown in FIG. 9, the spring 103 is fit into the convex part 141. In a state fit into the convex part 141, the spring 103 protrudes further to the side opposite to the base part 121 side than the convex part 141.

The non-return valve 105 is provided on the cavity 123 side of the inlet 137. The non-return valve 105 inhibits backflow of the ink to inside the inlet 137 from inside the cavity 123. A pressure receiving member 107 is provided further to the cavity 123 side than the non-return valve 105 (ink flow downstream side). As shown in FIG. 6, the pressure receiving member 107 has a supported part 107A and a spring receiving part 107B. The supported part 107A and the spring receiving part 107B are linked to each other via an arm part 107C.

As shown in FIG. 9, with this embodiment, the supported part 107A of the pressure receiving member 107 is supported on the side wall 135. A flow hole (not illustrated) is provided on the supported part 107A. The ink that flows into the supported part 107A side from the inlet 137 can be distributed to the downstream side of the supported part 107A via a flow hole of the supported part 107A.

The spring receiving part 107B extends to the center part of the cavity 123 by the arm part 107C. By doing this, the spring receiving part 107B faces opposite the convex part 141. The spring 103 is sandwiched by the bottom of the cavity 123 and the spring receiving part 107B. By doing this, the spring receiving part 107B is energized by the spring 103 at the side opposite the base part 121 side.

An opening part 143 of the cavity 123 is sealed by the film 109. By doing this, the inside and outside of the cavity 123 are separated by the film 109. The film 109 is joined to the side wall 135. By doing this, the opening part 143 of the cavity 123 is sealed by the film 109. With this embodiment, the film 109 is welded to the side wall 135. In a state with the opening part 143 of the cavity 123 sealed by the film 109, the energizing of the pressure receiving member 107 by the spring 103 is also applied to the film 109. In other words, the film 109 is energized via the pressure receiving member 107 by the spring 103 facing the side opposite the base part 121 side.

Figure 10:
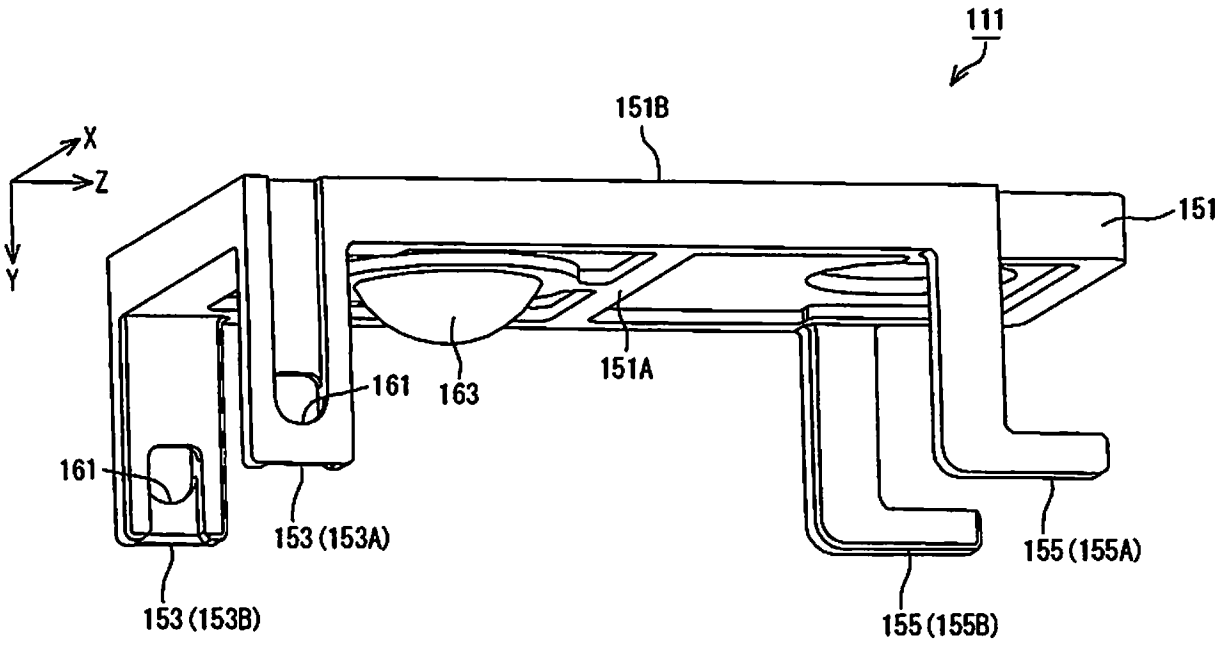
FIG. 10 is an outline drawing showing the lever of this embodiment.

As shown in FIG. 10, the lever 111 has a base part 151, two bearing parts 153, and two hooks 155. The base part 151 has a plate shaped external appearance, and has a first surface 151A, and a second surface 151B which is a surface facing opposite the first surface 151A. The two bearing parts 153 and the two hooks 155 respectively protrude facing the direction that is convex facing the side opposite to the base part 151 side from the first surface 151A of the base part 151. The two bearing parts 153 are provided at one end side of the base part 151 in the Z axis direction. The two bearing parts 153 are aligned in the X axis direction having a gap with each other. Hereafter, when distinguishing the two bearing parts 153 from each other, the two bearing parts 153 will respectively be noted as bearing part 153A and bearing part 153B.

The two hooks 155 are provided at the other end side of the base part 151 in the Z axis direction. The two hooks 155 are aligned in the X axis direction having a gap with each other. Hereafter, when distinguishing the two hooks 155 from each other, the two hooks 155 are respectively noted as hook 155A and 155B. The hook 155A and the bearing part 153A are aligned along the Z axis direction. Also, the hook 155B and the bearing part 153B are aligned along the Z axis direction. The two hooks 155 respectively have their end part of the side facing opposite the base part 151 side bent in a hook shape facing opposite to the bearing part 153 side. On the two bearing parts 153 are provided bearing holes 161 that pierce the bearing part 153 in the X axis direction on the end part side of the side opposite to the base part 151 side. Also, on the first surface 151A of the base part 151, a projection 163 that is convex facing the side opposite to the base part 151 side from the first surface 151A is provided. The projection 163 is positioned between the bearing part 153 and the hook 155 in the Z axis direction.

Figure 11:
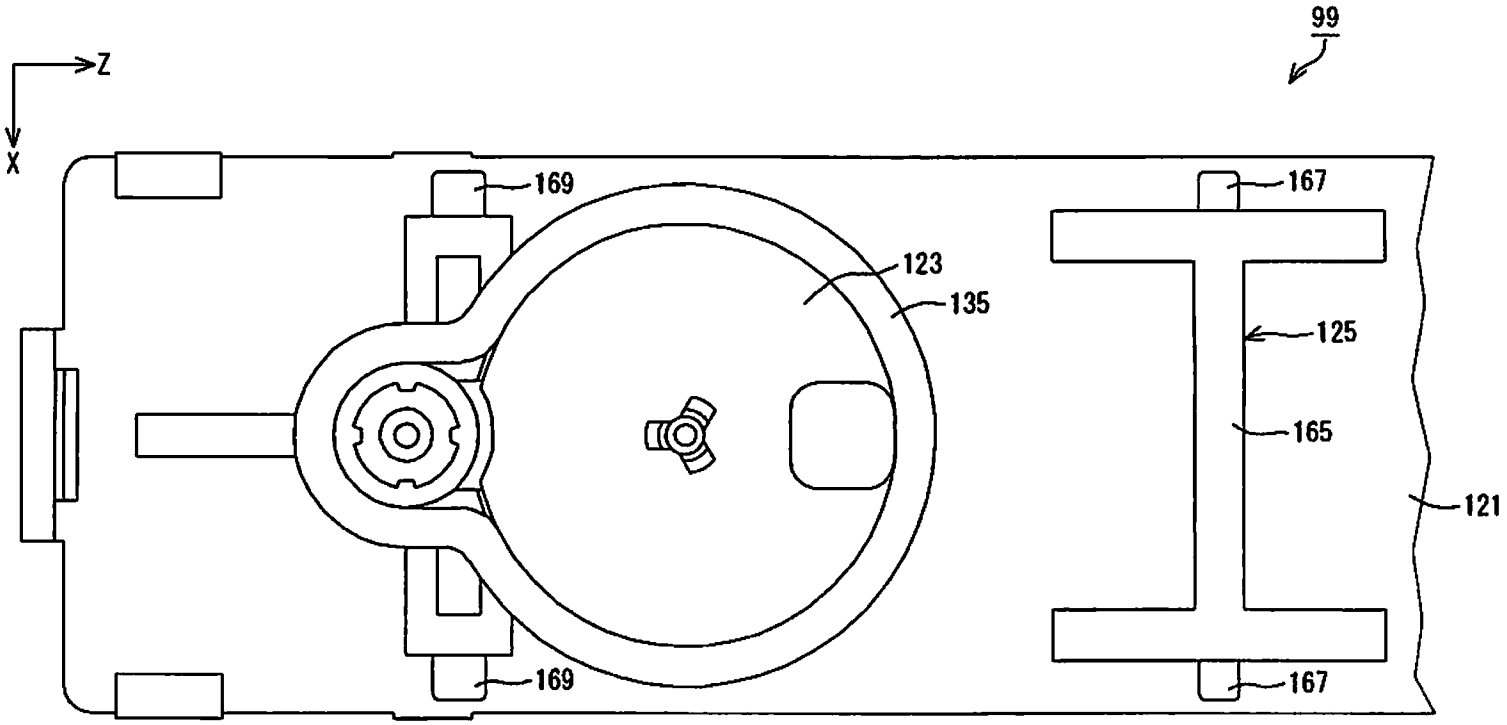
FIG. 11 is a plan view showing the flow path member of this embodiment.
Figure 12:
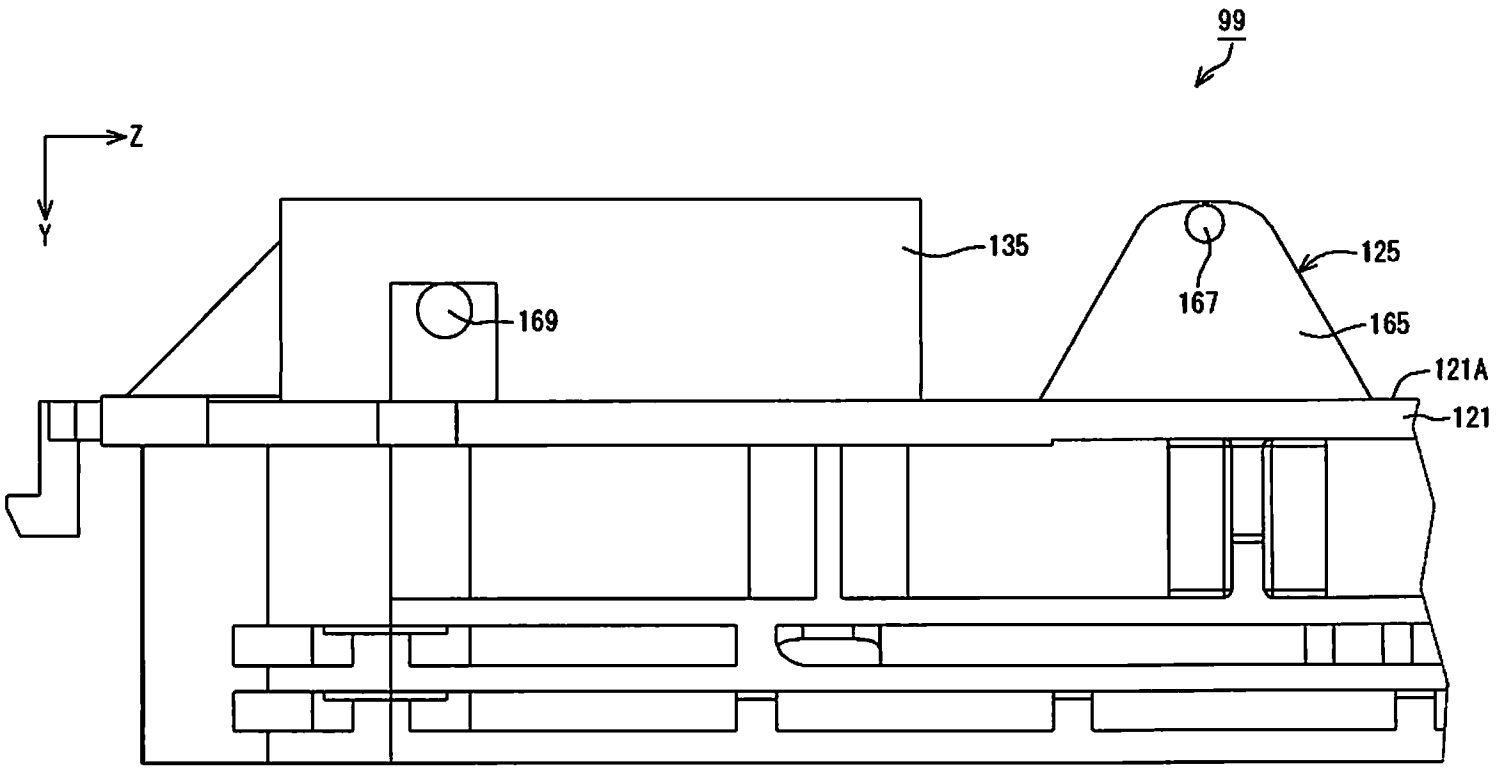
FIG. 12 is a side view showing the flow path member of this embodiment.

As shown in FIG. 11, the stopper 125 has a support part 165 and two shaft parts 167. As shown in FIG. 12, the support part 165 protrudes from the surface 121A of the base part 121 to the side opposite the base part 121 side. The two shaft parts 167 are respectively provided on the support part 165. The two shaft parts 167 are respectively provided in a state floating from the surface 121A. In other words, a gap is provided between the two shaft parts 167 and the surface 121A. As shown in FIG. 11, the two shaft parts 167 extend in the direction mutually moving away from the support part 165 in the X axis direction.

Two shaft parts 169 are provided on the outside of the side wall 135 constituting the cavity 123. The two shaft parts 169 protrude facing opposite each other sandwiching the cavity 123 in the X axis direction. As shown in FIG. 12, the two shaft parts 169 are respectively provided in a state floating from the surface 121A. In other words, a gap is provided between the two shaft parts 169 and the surface 121A.

Figure 13:
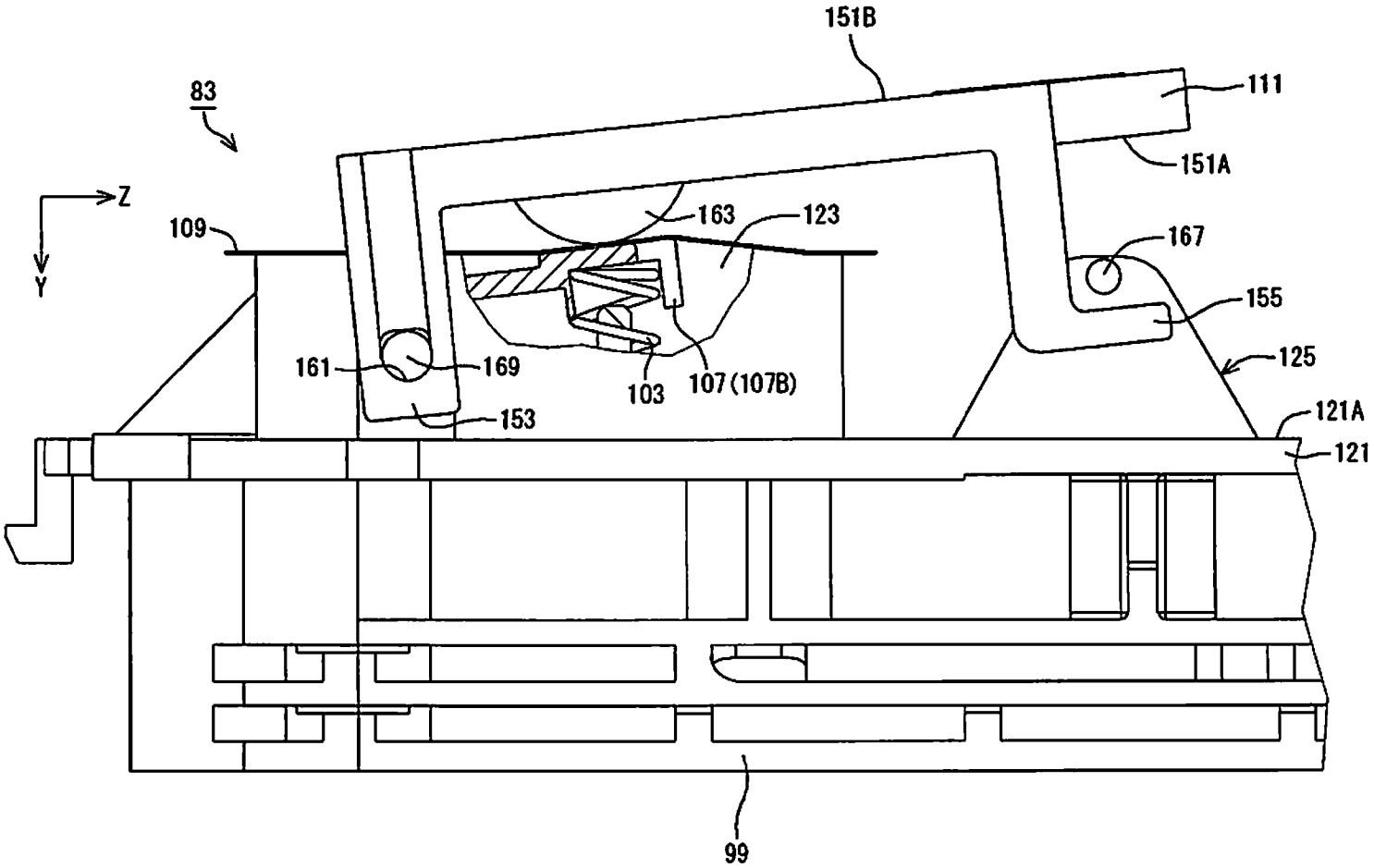
FIG. 13 is an outline drawing showing the flow path unit of this embodiment.

With the flow path unit 83, as shown in FIG. 13, the lever 111 is attached to a first flow path member 99. In a state with the lever 111 attached to the first flow path member 99, the first surface 151A of the lever 111 faces the surface 121A of the base part 121. Also, in a state with the hook 155 of the lever 111 facing the stopper 125 side, two shaft parts 169 of the first flow path member 99 are fit into the two bearing holes 161 of the lever 111. The two hooks 155 are respectively inserted between the surface 121A and the shaft part 167. In a state with the lever 111 attached to the first flow path member 99, the lever 111 is constituted to be able to rotate with the two shaft parts 169 as a fulcrum. The rotation of the lever 111 is restricted by the two hooks 155. The rotation range of the lever 111 is the range between the position at which the hook 155 abuts the shaft part 167, and the position at which the hook 155 abuts the surface 121A.

In a state with the lever 111 attached to the first flow path member 99, the projection 163 of the lever 111 sandwiches the film 109 and faces the spring receiving part 107B of the pressure receiving member 107. As described previously, the film 109 is energized by the spring 103 via the pressure receiving member 107 facing the side opposite the base part 121 side. Because of this, the lever 111 is energized via the projection 163 in the direction for which the angle between the first surface 151A and the surface 121A opens, specifically, the direction for which the lever 111 moves further away from the base part 121.

Figure 14:
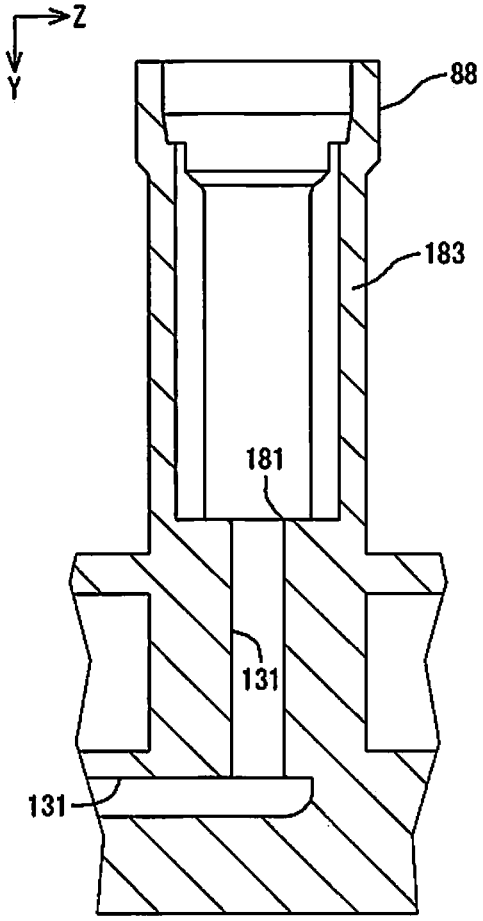
FIG. 14 is an enlarged view of the supply tube in FIG. 7.
Figure 15:
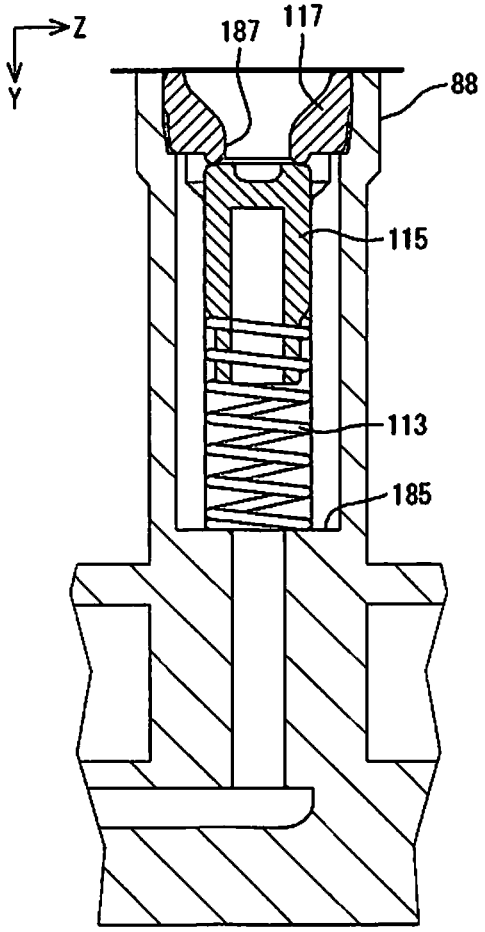
FIG. 15 is an enlarged view showing the site of the supply tube in FIG. 7.

As shown in FIG. 14, the supply tube 88 has a side wall 183 surrounding a supply port 181 that is the end edge of the flow path 131. The side wall 183 protrudes from the surface 121A facing the side opposite the base part 121 side. The supply port 181 is provided inside the area enclosed by the side wall 183 of the supply tube 88. The ink inside the flow path 131 is supplied via the supply port 181 to the inner side of the supply tube 88, in other words, inside the area enclosed by the side wall 183. As shown in FIG. 15, the spring 113, the plug 115, and the packing 117 are housed inside the supply tube 88. The spring 113 is sandwiched by the supply tube 88 bottom part 184 and the plug 115. The plug 115 is sandwiched by the spring 113 and the packing 117. Because of this, the plug 115 is energized by the spring 113 toward the packing 117 side.

The packing 117 is constituted by an elastic body such as rubber, an elastomer or the like, for example. The packing 117 is press fit inside the supply tube 88. An opening part 187 is provided on the packing 117. The plug 115 is energized facing the packing 117 side in a state overlapping the opening part 187 of the packing 117. Because of this, the opening part 187 of the packing 117 is blocked by the plug 115. A gap is maintained between the plug 115 and the supply tube 88. A gap is also maintained between the spring 113 and the supply tube 88. Because of this, the plug 115 and the spring 113 can respectively have the interior of the supply tube 88 be displaced along the Y axis direction.

Figure 16:
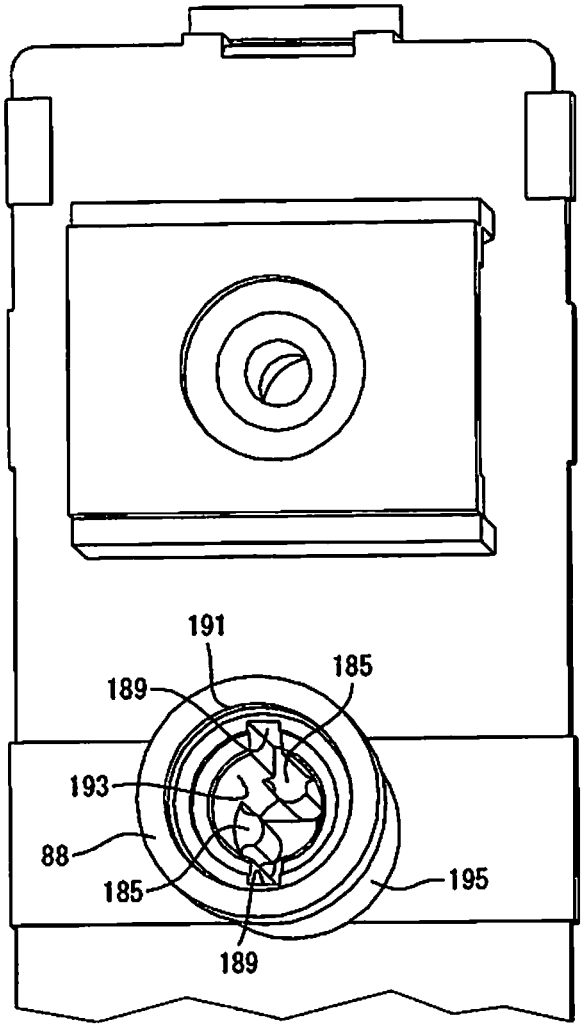
FIG. 16 is a perspective view showing the flow path member of this embodiment.

Here, as shown in FIG. 16, a groove 189 is provided inside the supply tube 88. With this embodiment, two grooves 189 are provided. The grooves 189 extend along the Y axis direction facing the bottom part 185 from the end edge 191 side of the supply tube 88. The grooves 189 reach from the end edge 191 side to the bottom part 185. The grooves 189 are provided facing so as to be concave facing the outer wall 195 from the inner wall 193 of the supply tube 88. Because of this, in a state with the plug 115 housed inside the supply tube 88, it is possible to utilize the space enclosed by the plug 115 and the grooves 189 as the ink flow path.

Figure 17:
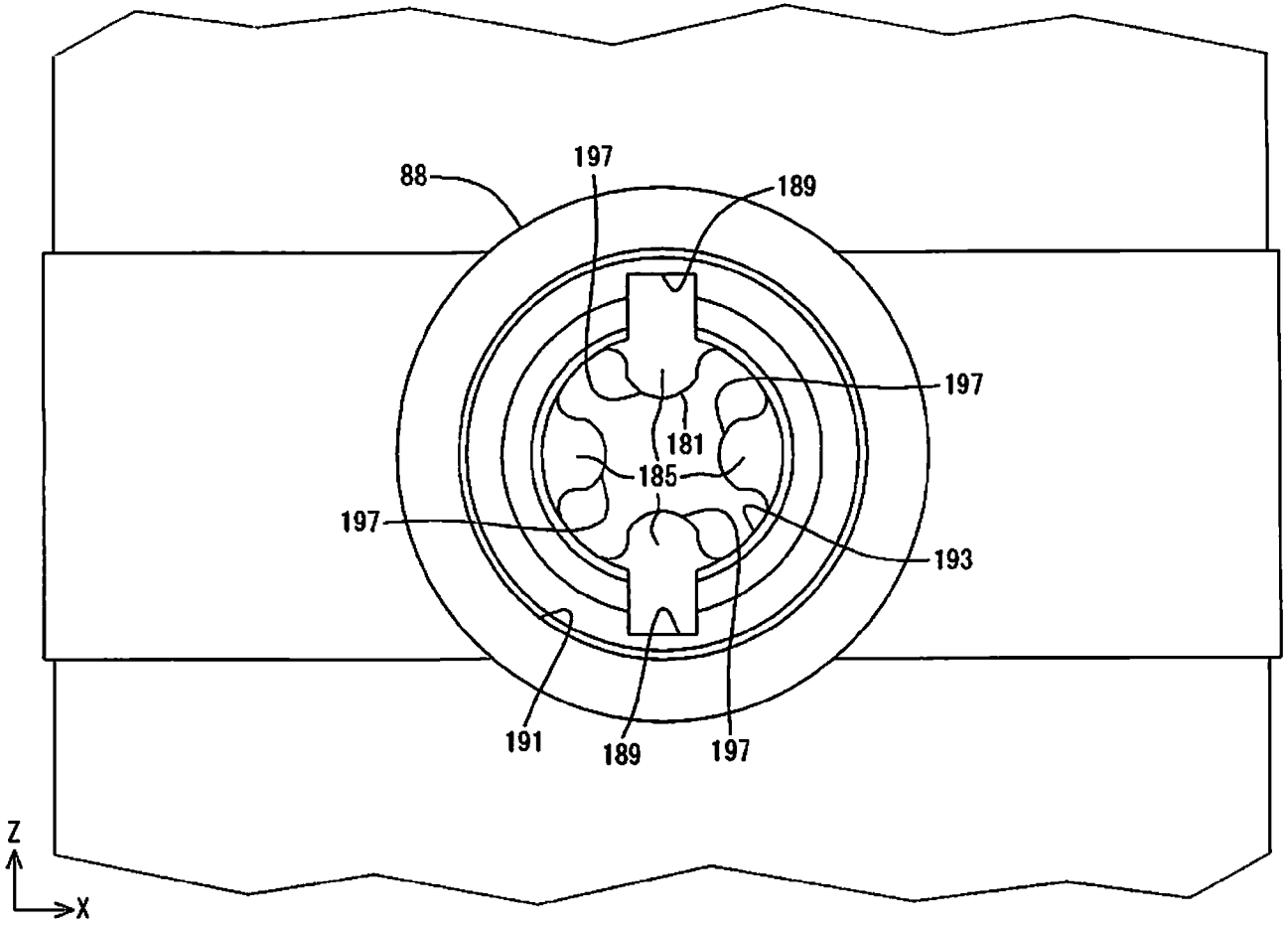
FIG. 17 is a plan view showing the flow path member of this embodiment.

As shown in FIG. 17, a protruding part 197 is also provided on the inner wall 193 of the supply tube 88. With this embodiment, four protruding parts 197 are provided. The protruding parts 197 protrude from the inner wall 193 of the supply tube 88 facing the side opposite the outer wall 195 side, specifically, facing the center of the supply tube 88 with a plan view. Also, the surfaces facing the end edge 191 side of the surfaces of the protruding parts 197 constitute the bottom part 185. In other words, with this embodiment, the bottom part 185 is constituted by the four protruding parts 197. In contrast to the side wall 183 enclosing the supply port 181 exhibiting roughly a round tube shape, the supply port 181 exhibits a different shape of a cross shape by the four protruding parts 197 with the plan view.

Figure 18:
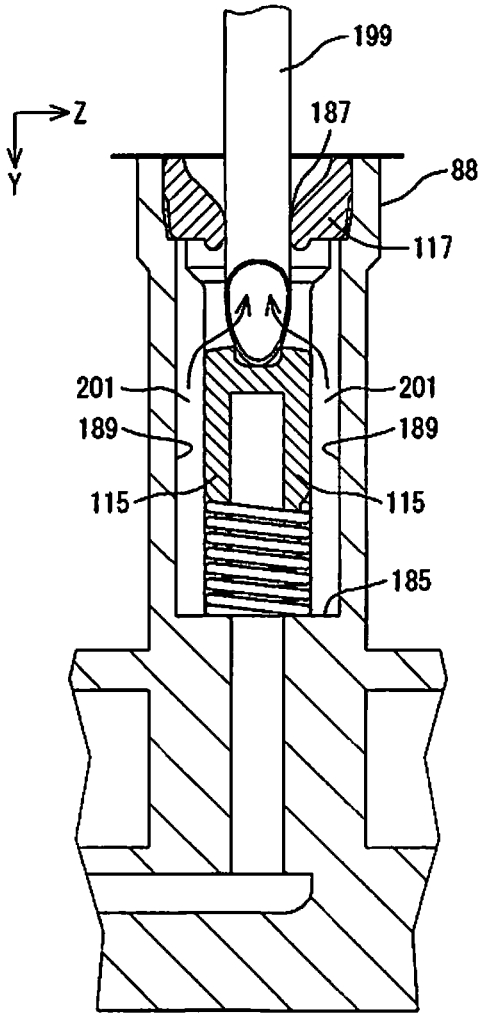
FIG. 18 is an enlarged view showing the supply tube in FIG. 7.

As shown in FIG. 18, when the cartridge 51 is mounted in the holder 53 (FIG. 1), the hollow needle 199 is inserted in the opening part 187 of the packing 117. At this time, the plug 115 is pressed by the hollow needle 199, and is displaced toward the bottom part 185 side. By doing this, as shown by the arrows in the drawing, ink can be supplied to the ink supply tube 61 (FIG. 1) via the hollow needle 199 from the flow path 201 enclosed by the grooves 189 and the plug 115. The hollow needle 199 is provided inside the holder 53.

Figure 19:
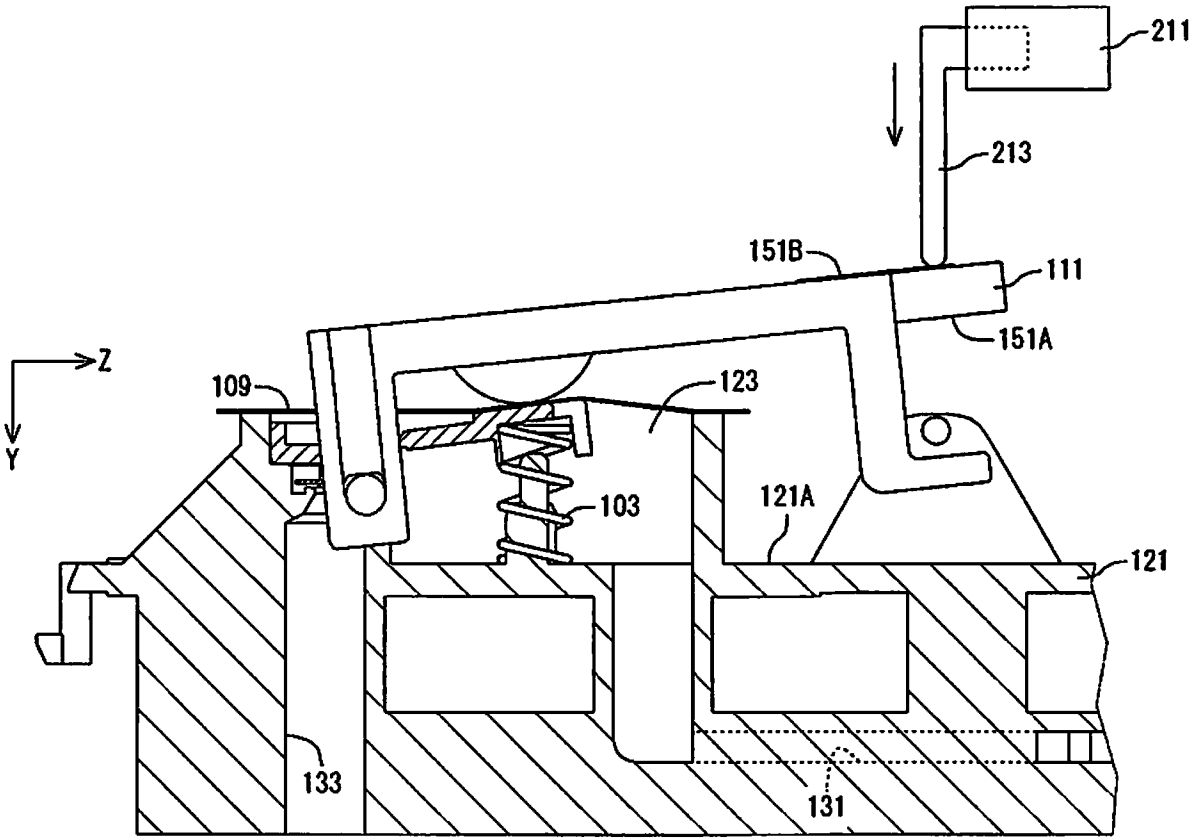
FIG. 19 is a drawing for describing the residual volume detection method of this embodiment.

With the flow path unit 83 having the constitution noted above, the lever 111 is displaced within the rotation range according to the volume of ink inside the cavity 123. With this embodiment, the residual volume of ink inside the cartridge 51 is detected based on the displacement of the lever 111. With this embodiment, as shown in FIG. 19, by the displacement of the lever 111 being detected by an optical sensor 211, the residual volume of the ink inside the cartridge 51 is detected. The displacement of the lever 111 is detected via a detection rod 213. With this embodiment, the detection rod 213 and the optical sensor 211 are provided on the printer 1.

As shown in FIG. 19, the detection rod 213 abuts the second surface 151B of the lever 111. The detection rod 213 is energized in the arrow direction in the drawing via an energizing mechanism (not illustrated). The direction of the energizing force applied to the detection rod 213 is the reverse direction to the direction of the energizing force by the spring 103. The energizing force applied to the detection rod 213 acts on the lever 111 via the detection rod 213. Because of this, the lever 111 comes to rest in a state with the energizing force from the detection rod 213 and the energizing force from the spring 103 in balance. When in this state, the position of the optical sensor 211 and the detection rod 213 is set at the position detected by the detection rod 213 using the optical sensor 211.

When ink is suctioned from the supply tube 88, the volume of ink inside the cavity 123 decreases. Here, with this embodiment, the cross section surface area of the flow path 131 is greater than the cross section surface area of the inlet 137. Because of this, the resistance of the ink flowing in the inlet 137 of the flow path 133 is greater than the resistance of the ink flowing in the flow path 131. By doing this, when ink is suctioned from the supply tube 88, the inside of the cavity 123 is in a state with reduced pressure (hereafter called a reduced pressure state).

Figure 20:
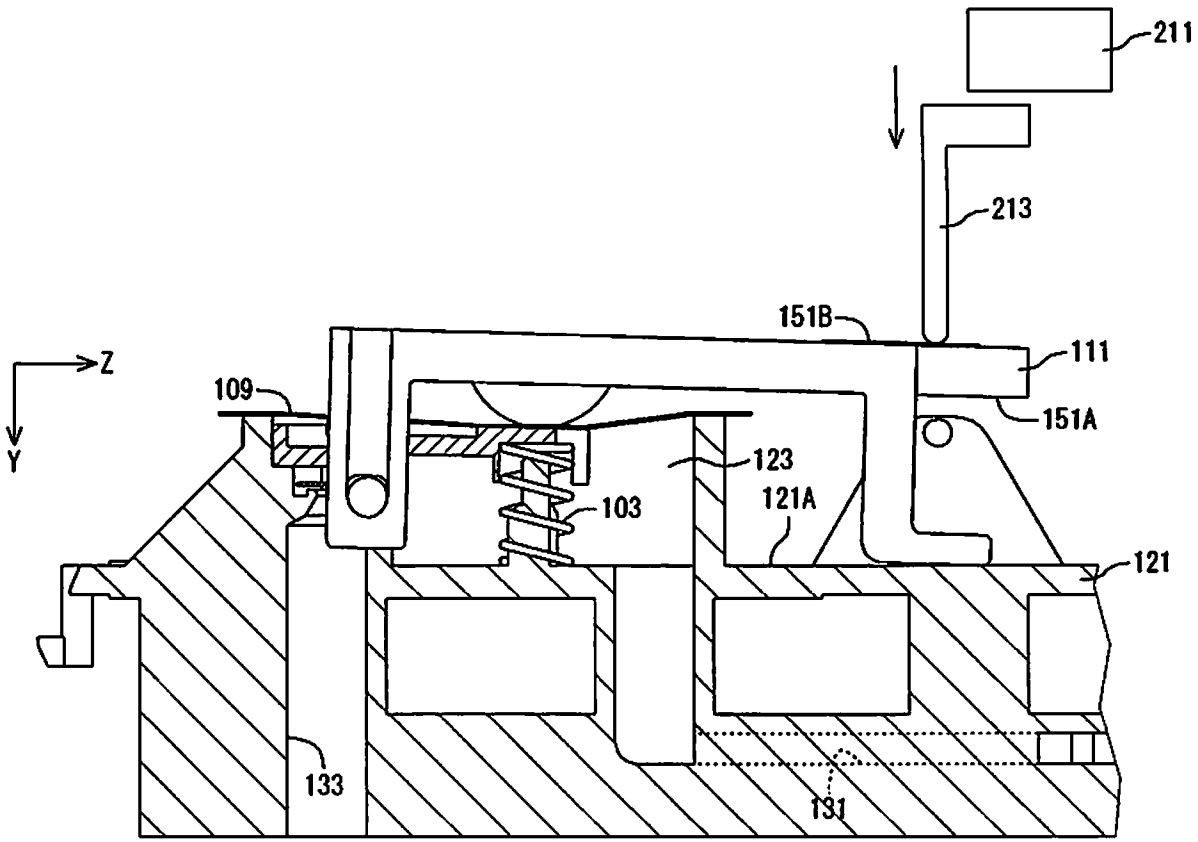
FIG. 20 is a drawing for describing the residual volume detection method of this embodiment.

At this time, as shown in FIG. 20, the spring 103 is compressed from the film 109 side toward the surface 121A side by the pressure within the cavity 123 in a reduced pressure state and by the energizing force from the detection rod 213. By doing this, the film 109 is bent facing the surface 121A side, specifically, facing the inward depth side of the cavity 123. As a result, the lever 111 is displaced in the direction for which the angle between the first surface 151A and the surface 121A closes, specifically, the direction for which the lever 111 approaches the base part 121. When in this state, the position of the optical sensor 211 and the detection rod 213 is set at a position for which the detection rod 213 is outside the optical sensor 211 detection range.

Also, if ink remains inside the ink pack 82, ink is supplied inside the cavity 123 as time elapses, so the pressure inside the cavity 123 is restored. In other words, when a designated time elapses after ink is suctioned from the supply tube 88, the bending of the film 109 is recovered from. By doing this, as shown in FIG. 19, the lever 111 is displaced in the direction for which the angle between the first surface 151A and the surface 121A opens, specifically, the direction for which the lever 111 goes further away from the base part 121. Because of this, when a designated time elapses after ink is suctioned from the supply tube 88, the detection rod 213 is again detected by the optical sensor 211. By doing this, it is possible to detect that ink is remaining inside the ink pack 82.

On the other hand, when a sufficient volume of ink does not remain inside the ink pack 82 to restore the pressure inside the cavity 123, the pressure inside the cavity 123 is not restored even after the designated time elapses. Because of this, even when the designated time elapses from after the detection rod 213 is outside the optical sensor 211 detection range, the detection rod 213 is not detected again by the optical sensor 211. By doing this, it is possible to detect that ink is not remaining inside the ink pack 82. From the above, based on the displacement of the lever 111, the remaining volume of ink inside the cartridge 51, specifically, whether or not ink remains inside the ink pack 82, is detected.

Figure 21:
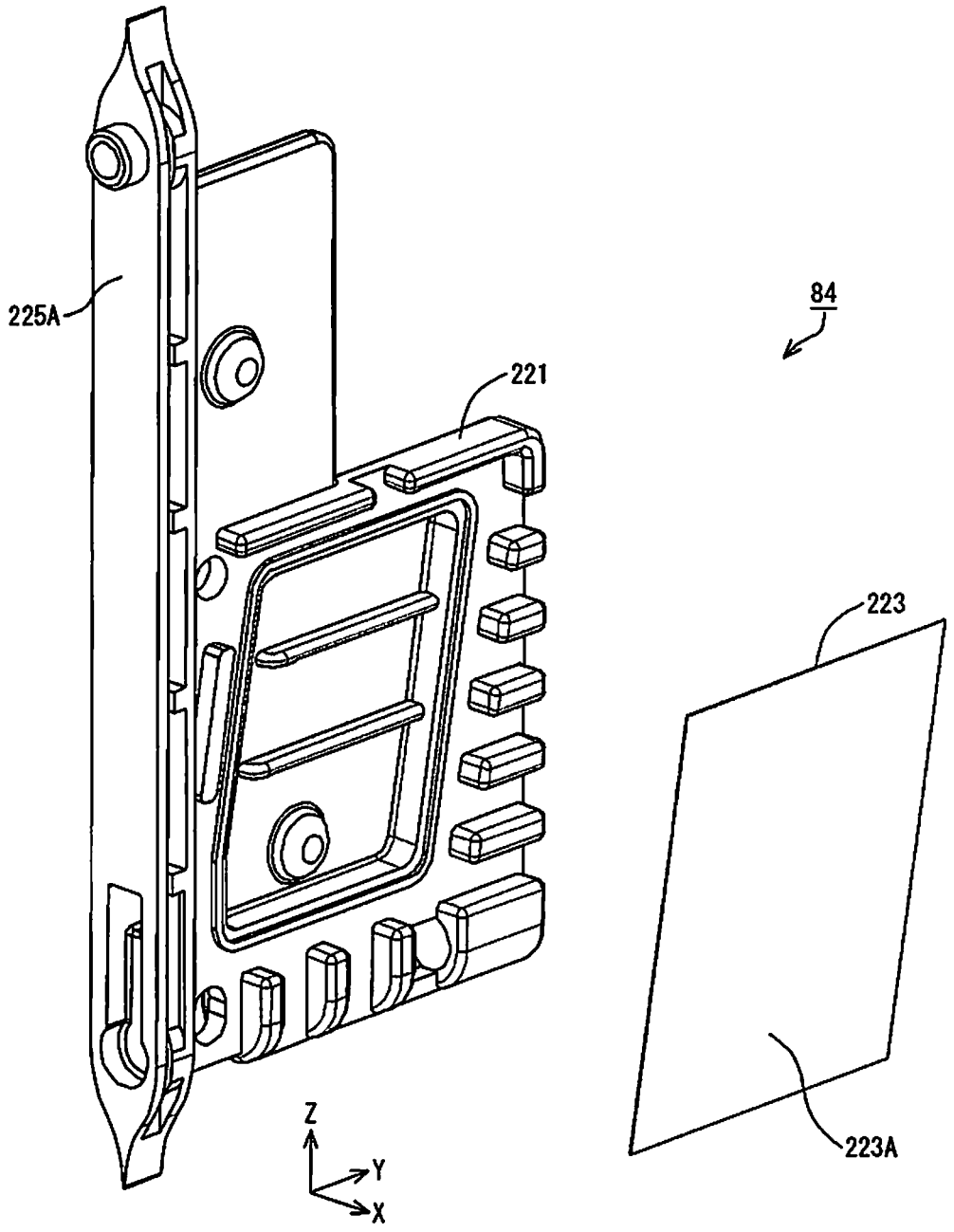
FIG. 21 is an exploded perspective view showing the filter unit of embodiment 1.

As shown in FIG. 21, the filter unit 84 has a second flow path member 221 and a filter 223. The filter 223 has a largest surface 223A. The largest surface 223A extends along the YZ plane. The largest surface 223A is the surface for which the surface area is greatest of the plurality of surfaces constituting the external shape of the filter 223. The second flow path member 221 is constituted by a plastic such as a synthetic resin or the like. With embodiment 1, the second flow path member 221 is formed by resin injection molding.

Figure 22:
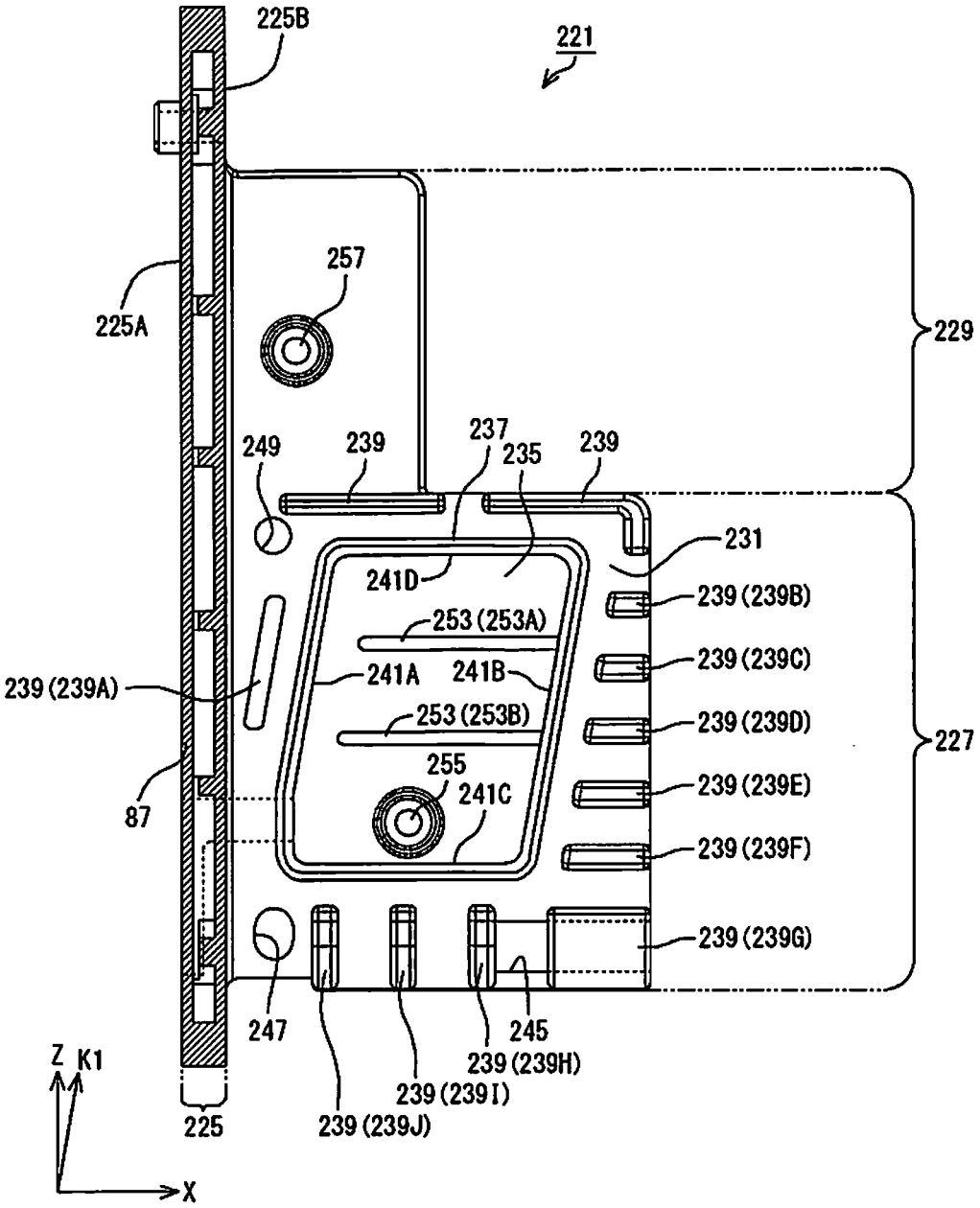
FIG. 22 is a side view showing the flow path member of embodiment 1.

With the description hereafter, the second flow path member 221 is divided into a base part 225, a first site 227, and a second site 229 as shown in FIG. 22. The base part 225 extends along the Z axis direction. The outer circumferences of the base part 225 is set as the welded part 87 described previously. With FIG. 22, to show the constitution in a manner easy to understand, cross hatching is shown on the welded part 87.

The base part 225 has a surface 225A facing the flow path unit 83 (FIG. 4) side, and a surface 225B on the side facing opposite the surface 225A. The surface 225A and the surface 225B respectively extend along the XZ plane. As shown in FIG. 22, the first site 227 and the second site 229 respectively protrude in the direction facing the side opposite the flow path unit 83 side (FIG. 4), specifically, toward the ink pack 82 side. The first site 227 exhibits a plate shape extending along the YZ plane. The second site 229 also exhibits a plate shape extending along the YZ plane. The first site 227 and the second site 229 are aligned in the Z axis direction. The base part 225, the first site 227, and the second site 229 are connected to each other.

Figure 23:
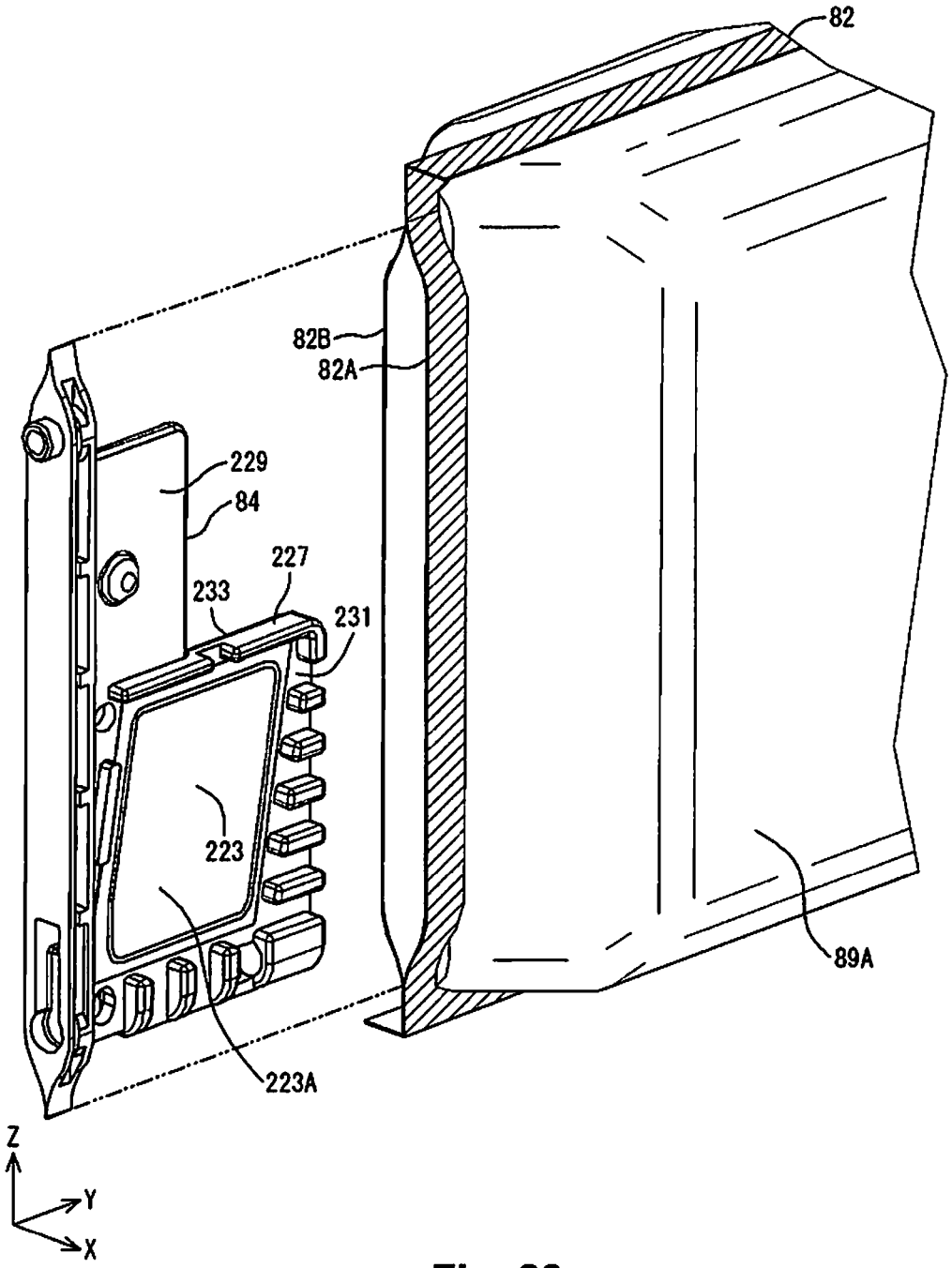
FIG. 23 is a perspective view showing the filter unit and the ink pack of embodiment 1.
Figure 24:
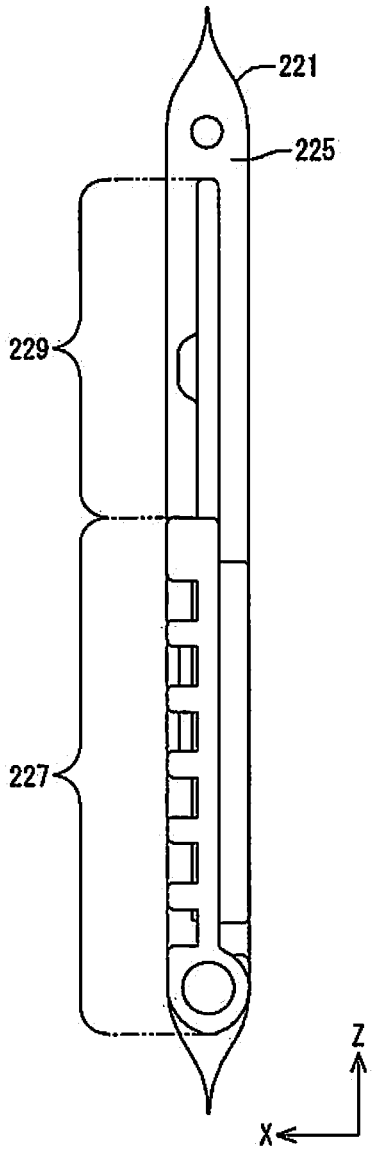
FIG. 24 is a rear view showing the flow path member of embodiment 1.

As shown in FIG. 23, the first site 227 and the second site 229 are housed inside the ink pack 82. As described previously, with the ink pack 82, the surface 89A of the sheet 82A and the surface 89B of the sheet 82B (FIG. 5) respectively extend along the YZ plane. Because of this, with embodiment 1, the first site 227 and the second site 229, as well as the surface 89A and the surface 89B respectively extend along the YZ plane. In other words, the first site 227 and the second site 229, as well as the surface 89A and the surface 89B are roughly parallel to each other. As shown in FIG. 24, with the second flow path member 221, the first site 227 and the second site 229 are housed inside the area overlapping the base part 225 when seen from the front view.

As shown in FIG. 23, the first site 227 has a surface 231 facing the sheet 82A in a state housed inside the ink pack 82. With the first site 227, the surface of the side opposite the surface 231, specifically, the surface facing the sheet 82B, is noted as surface 233. The surface 231 is shared by the first site 227 and the second site 229. In other words, at the second site 229, the surface facing the sheet 82A is continuous with the surface 223A. Because of this, the second site 229 can be regarded as exhibiting a plate shape continuous from the first site 227.

Figure 25:
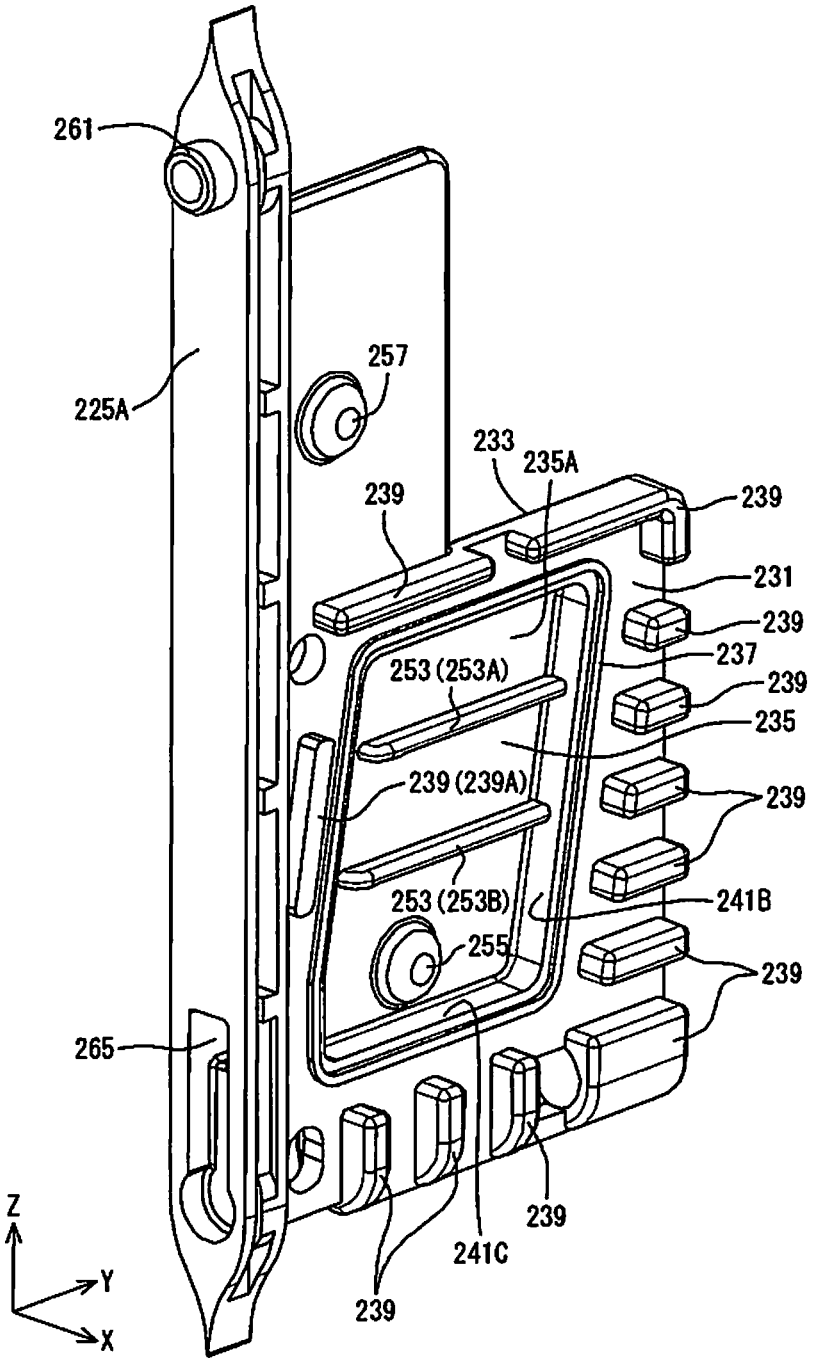
FIG. 25 is a perspective view showing the flow path member of embodiment 1.

As shown in FIG. 25, with the first site 227, a recess part 235 is provided on the surface 231. The recess part 235 is provided in a direction that is concave facing the surface 233 from the surface 231. Because of this, the bottom part 235A of the recess part 235 is positioned further to the surface 233 side than the surface 231. Also, with the surface 231, in the periphery of the recess part 235, an embankment part 237 is provided surrounding the recess part 235. The embankment part 237 protrudes from the surface 231 facing the side opposite the surface 233 side, specifically, facing the sheet 82A (FIG. 23) side. With the first site 227, a plurality of convex parts 239 are provided outside the area enclosed by the embankment part 237.

The plurality of convex parts 239 respectively protrude from the surface 231 facing the side opposite to the surface 233 side, specifically, the sheet 82A (FIG. 23) side. The plurality of convex parts 239 also respectively protrude facing further to the sheet 82A (FIG. 23) side than the embankment part 237. In other words, the height from the surface 231 for each convex part 239 is higher than the height from the surface 231 for the embankment part 237. With embodiment 1, the plurality of convex parts 239 are aligned in ring form in a state with a gap maintained between each other. Because of this, with embodiment 1, the plurality of convex parts 239 surround the periphery of the recess part 235. Also, with embodiment 1, a portion of the plurality of convex parts 239 are aligned along the circumference edge of the first site 227.

As shown in FIG. 22, a convex part 239A which is one of the plurality of convex parts 239 is positioned between the embankment part 237 and the base part 225. The convex part 239A is inclined in relation to both the Z axis direction and the Y axis direction. The convex part 239A extends along an incline direction K1. The convex part 239A is inclined in the direction moving further away from the base part 225 as it faces from the site 227 side to the second site 229 side. Said another way, the convex part 239A is inclined in the direction facing from the Y axis negative direction to the Y axis positive direction as it faces from the Z axis negative direction to the Z axis positive direction. Specifically, the incline direction K1 is inclined in the direction that moves further away from the base part 225 as it faces from the first site 227 side toward the second site 229 side. Said another way, the incline direction K1 is inclined facing from the Y axis negative direction to the Y axis positive direction as it faces from the Z axis negative direction to the Z axis positive direction.

As shown in FIG. 22, when the bottom part 235A of the recess part 235 is seen with a plan view, of the contour of the recess part 235, a site 241A adjacent to the convex part 239A in the Y axis direction and a site 241B facing the site 241A in the Y axis direction are inclined along the incline direction K1. Because of this, when the bottom part 235A is seen in plan view, the recess part 235 is inclined along the incline direction K1. The site 241A and the site 241B are respectively longer than a site 241C and a site 241D extending along the Y axis direction of the contour of the recess part 235. Because of this, the recess part 235 can be regarded as extending along the incline direction K1.

As shown in FIG. 22, the embankment part 237 is provided along the contour of the recess part 235. Because of this, a portion of the embankment part 237 is inclined in the incline direction K1 along the site 241A and the site 241B of the contour of the recess part 235. Of the plurality of convex parts 239, five convex parts 239 adjacent to the site 241B of the contour of the recess part 235 in the Y axis direction are respectively noted as convex part 239B, convex part 239C, convex part 239D, convex part 239E, and convex part 239F. The convex part 239B, convex part 239C, convex part 239D, convex part 239E, and convex part 239F are aligned in this sequence along the direction facing from the second site 229 side to the first site 227 side. With these five convex parts 239, the dimensions along the Y axis direction gradually increase in sequence of the convex part 239B, convex part 239C, convex part 239D, convex part 239E, and convex part 239F. In other words, the dimensions along the Y axis direction of the convex part 239F are greater than the dimensions along the Y axis direction of the convex part 239B.

With the convex part 239B, convex part 239C, convex part 239D, convex part 239E, and convex part 239F, the degree of gradual increase in dimensions along the Y axis direction follows the degree of incline of the incline direction K1. Because of this, the gap in the Y axis direction between the site 241B of the contour of the recess part 235 and the five convex parts 239 is mutually equal with the convex part 239B, convex part 239C, convex part 239D, convex part 239E, and convex part 239F. In other words, the gap in the Y axis direction between the site 241B and the convex part 239B is equal to the gap in the Y axis direction between the site 241B and the convex part 239C. This relationship is also the same for the other three convex parts 239D, 239E, and 239F.

Of the plurality of convex parts 239, the convex part 239 adjacent to the convex part 239F in the Z axis direction is noted as the convex part 239G. The convex part 239G is positioned at the end part of the side opposite to the second site 229 side of the first site 227, and is positioned at the end part of the side opposite to the base part 225 side of the first site 227. In other words, the convex part 239G is positioned at the side opposite the second site 229 side of the first site 227, and at the corner of the side opposite the base part 225 side of the first site 227. The convex part 239G extends along the V axis direction. The dimensions along the Y axis direction of the convex part 239G are greater than the dimensions along the Y axis direction of the convex part 239F.

In the Y axis direction, between the convex part 239G and the base part 225, three convex parts 239 are aligned along the Y axis direction. The three convex parts 239 positioned between the convex part 239G and the base part 225 are respectively noted as convex part 239H, convex part 239I, and convex part 239J. The convex part 239H, convex part 239I, and convex part 239J are aligned in this sequence facing from the convex part 239G side to the base part 225 side. Between the convex part 239G and the convex part 239H is provided an opening part 245 that pierces the first site 227 in the X axis direction. The opening part 245 pierces between the surface 231 and the surface 233 of the first site 227.

Also, between the convex part 239J and the base part 225, an opening part 247 that pierces the first site 227 in the X axis direction is provided. Furthermore, inside the area of the first site 227, an opening part 249 that pierces the first site 227 in the X axis direction is provided further to the second site 229 side than the convex part 239A. The opening part 247 and the opening part 249 respectively pierce between the surface 231 and the surface 233 of the first site 227.

Figure 26:
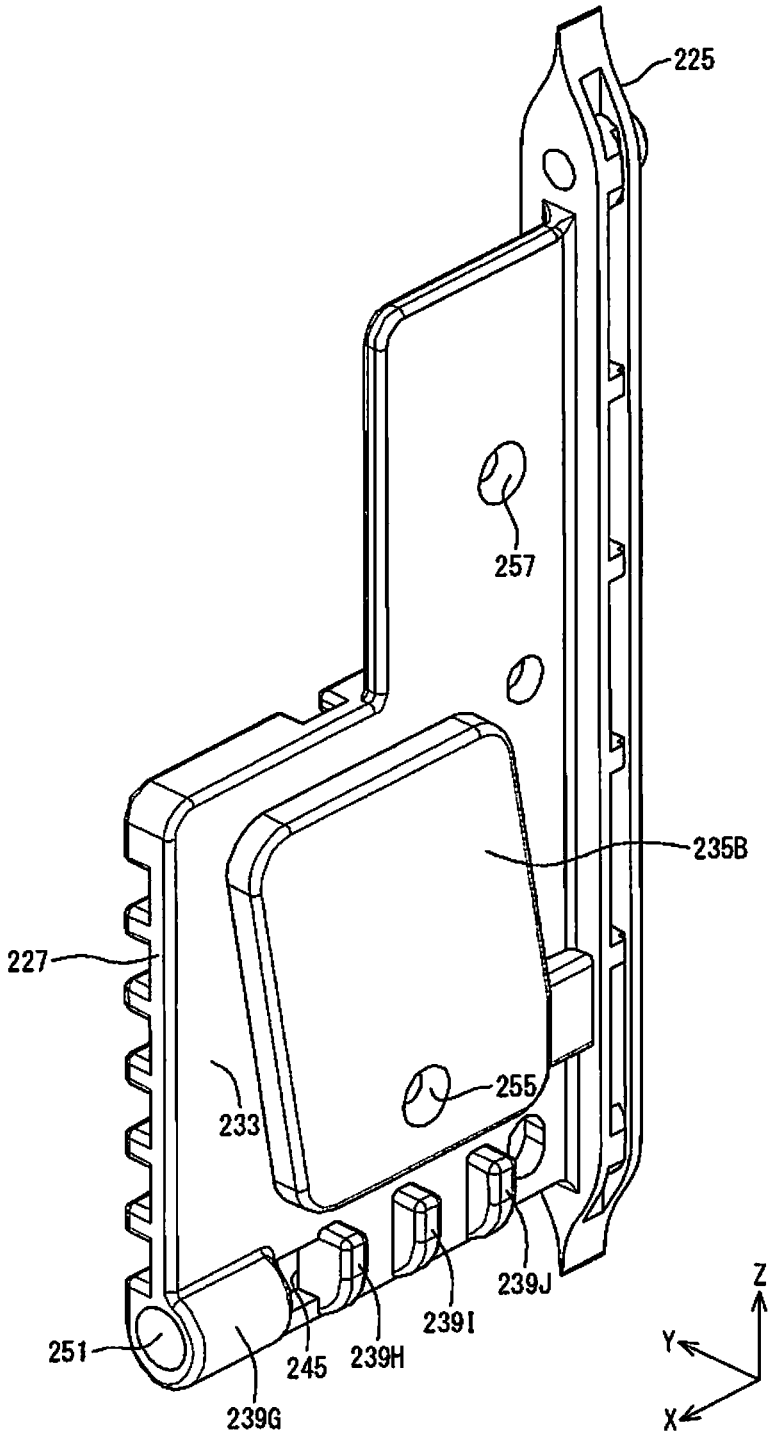
FIG. 26 is a perspective view showing the flow path member of embodiment 1.

Here, as shown in FIG. 26, the convex part 239G also extends on the surface 233. In other words, the convex part 239G protrudes facing from the surface 231 toward the side opposite the surface 233 side, and protrudes from the surface 233 to the side opposite the surface 213 side, specifically, the sheet 82B (FIG. 23) side. Similarly, the convex part 239H, the convex part 239I, and the convex part 239J also protrude from the surface 233 toward the side opposite the surface 231 side, specifically, the sheet 82B (FIG. 23) side. On the convex part 239G, a through hole 251 is provided piercing the convex part 239G along the Y axis direction. The through hole 251 passes through the opening part 245 at the convex part 239H side of the convex part 239G. A flow path that pierces the convex part 239G facing from the first site 227 side to the base part 225 side, and reaches the convex part 239H through the opening part 245 is constituted by the through hole 251 and the opening part 245.

As shown in FIG. 26, a convex part 235B is provided on the surface 233. The convex part 235B overlaps the recess part 235 area with a plan view. At the surface 231, the recess part 235 is provided inside the area overlapping the convex part 235B with a plan view. By doing this, the depth dimension from the surface 231 to the bottom part 235A of the recess part 235 can be made greater than the thickness dimension from the surface 231 to the surface 233.

As shown in FIG. 25, inside the recess part 235 are provided a plurality of ribs 253 and a gate part 255. With embodiment 1, two ribs 253 are provided. The number of ribs 253 is not limited to being two, but can also be one, or three or more. The two ribs 253 extend along the Y axis direction. The two ribs 253 are aligned in the Z axis direction in a state with a gap open between them. The two ribs 253 protrude from the bottom part 235A in the direction facing the side opposite the surface 233 side, specifically, the sheet 82A (FIG. 23) side. The protruding volume from the bottom part 235A of the two ribs 253 is smaller than the depth dimension from the surface 231 of the recess part 235. Because of this, the two ribs 253 are held further to the bottom part 235A side than the surface 231.

As shown in FIG. 22, the two ribs 253 extend from the site 241B of the contour of the recess part 235 toward the site 241A side. The two ribs 253 are connected to the site 241B. Also, the two ribs 253 are separated from the site 241A. In other words, a gap is provided between the site 241A and each rib 253. Hereafter, when distinguishing between the two ribs 253, the two ribs 253 are respectively noted as rib 253A and rib 253B. Of the two ribs 253, the rib 253A is positioned further to the second site 229 side than the rib 253B.

As shown in FIG. 22, the gate part 255 is provided at the side further to the side opposite the second site 229 side than the rib 253B. In other words, the gate part 255 is positioned between the rib 253B and the site 241C of the contour of the recess part 235. The gate part 255 protrudes from the bottom part 235A toward the side opposite the surface 233 side, specifically, the sheet 82A (FIG. 23) side. The protruding volume of the gate part 255 from the bottom part 235A is smaller than the depth dimension from the surface 231 of the recess part 235. Because of this, the gate part 255 is further to the bottom part 235A side than the surface 231.

As shown in FIG. 25, a gate part 257 is provided on the second site 229. The gate part 257 protrudes from the surface 231 toward the side opposite the surface 233 side, specifically, the sheet 82A (FIG. 23) side. As shown in FIG. 26, at the surface 233 side, the gate part 255 and the gate part 257 are respectively indented toward the surface 231 side. A gate remainder is formed with injection molding inside the respective indentation of the gate part 255 and the gate part 257. By doing this, it is easy to avoid having the gate remainder protrude from the surface 233 or the convex part 235B.

On the base part 225, as shown in FIG. 25, a protruding part 261 is provided on the side opposite to the second site 229 side of the base part 225. The protruding part 261 is provided further to the side opposite to the first site 227 side than the second site 229 in the Z axis direction. Said another way, in the Z axis direction, the second site 229 is positioned further to the first site 227 side than the protruding part 261. Said yet another way, in the Z axis direction, the second site 229 is positioned between the protruding part 261 and the first site 227. The protruding part 261 protrudes from the surface 225A of the base part 225 toward the side opposite the second site 229 side of the base part 225. Also, an injection port 263 is provided on the protruding part 261. The injection port 263 pierces through the protruding part 261 and the base part 225 along the Y axis direction.

Also, a communication path 265 is provided on the first site 227 side of the base part 225 in the Z axis direction. The communication path 265 passes through the inside of the recess part 235 of the base part 225 in the Y axis direction. As shown in FIG. 22, the communication path 265 pierces from the surface 225A of the base part 225 up to site 241E adjacent to the base part 225 in the Y axis direction of the contour of the recess part 235. By doing this, the communication path 265 passes through the inside of the recess part 235 from the side opposite to the first site 227 side of the base part 225 in the Y axis direction.

Figure 27:
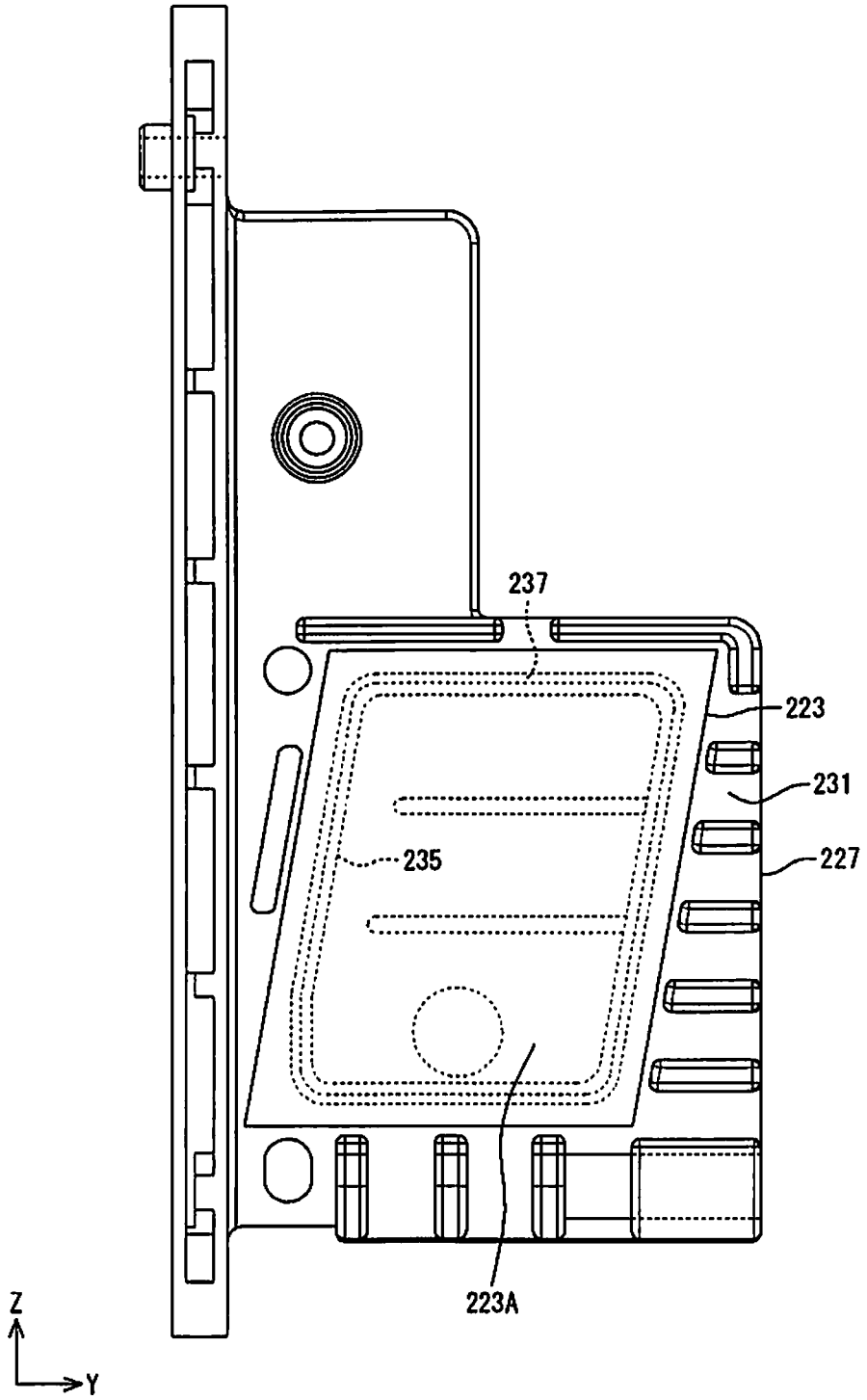
FIG. 27 is a side view showing the filter unit of embodiment 1.

As shown in FIG. 27, the filter 223 faces opposite the surface 231 of the first site 227. Specifically, the filter 223 is provided on the surface 231 side of the first site 227. The largest surface 223A of the filter 223 extends along the surface 231. Said another way, the filter 223 is provided in parallel to the surface 231. As described previously, the first site 227, the surface 89A, and the surface 89B are roughly parallel to each other. Because of this, the largest surface 223A of the filter 223 is also roughly parallel respectively to the surface 89A and the surface 89B.

The filter 223 is of a size that covers the recess part 235. Furthermore, the filter 223 is of a size that covers the embankment part 237 and the recess part 235. The filter 223 is joined to the embankment part 237 over the entire circumference of the embankment part 237 in a state covering the embankment part 237 and the recess part 235. With embodiment 1, the filter 223 is welded to the embankment part 237. As the material of the filter 223, for example, it is possible to use non-woven fabric, fabric, or metal mesh or the like.

Figure 28:
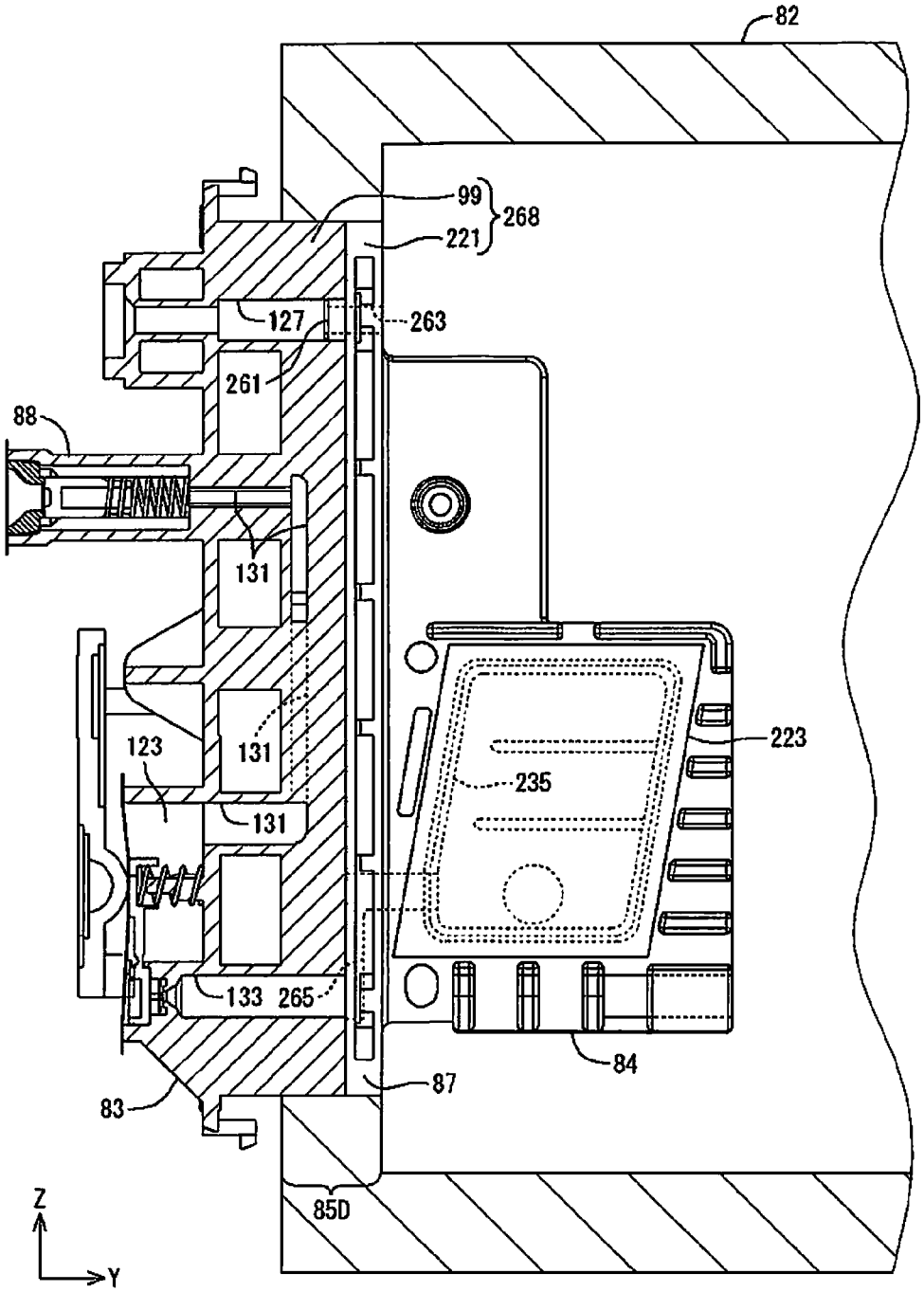
FIG. 28 is a drawing for describing the constitution of the pack unit of embodiment 1.

As shown in FIG. 28, the flow path unit 83 and the filter unit 84 having the constitution noted above are combined together. With FIG. 28, the flow path unit 83 is illustrated as a cross section diagram in the YZ plane. The filter unit 84 is provided on the side opposite to the cavity 123 side of the flow path unit 83 (ink pack 82 side). In a state with the surface 86A (FIG. 7) of the welded part 86 of the first flow path member 99 and the surface 225A (FIG. 25) of the base part 225 of the second flow path member 221 facing opposite each other, the first flow path member 99 of the flow path unit 83 and the second flow path member 221 of the filter unit 84 are combined with each other. With embodiment 1, the protruding part 261 of the second flow path member 221 is fit into the injection port 127 of the first flow path member 99, and the communication path 265 is connected to the flow path 133 of the first flow path member 99. In this way, in a state with the flow path unit 83 and the filter unit 84 combined, the ink pack 82 is welded to the welded part 86 and the welded part 97. In other words, the link (matching part) of the first flow path member 99 and the second flow path member 221 is sandwiched (covered) by the ink pack 82. The first flow path member 99 is exposed to the outside of the ink pack 82. On the other hand, the second flow path member 221 is housed inside the ink pack 82.

By combining the first flow path member 99 and the second flow path member 221, the flow path member 268 is constituted. The flow path member 268 is provided piercing the ink pack 82 and extending between the outside of the ink pack 82 and the inside of the ink pack 82. Because of this, the ink pack 82 and the flow path member 268 intersect each other. Also, the ink pack 82 and the flow path member 268 are joined at the site at which the ink pack 82 and the flow path member 268 intersect. With the flow path member 268, the welded part 86 and the welded part 87 respectively extend across the periphery of the flow path member. In other words, with the flow path member 268, the welded part 86 and the welded part 87 are sandwiched by the ink pack 82. As described previously, the first site 227 and the second site 229 are housed inside the area overlapping the base part 225 seen from the front (FIG. 24). Said another way, this can be regarded as the first site 227 and the second site 229 being housed within the area when the area enclosed by the ink pack 82 of the second flow path member 221 is seen in plan view.

The members constituting the flow path member 268 are not limited to the two items of the first flow path member 99 and the second flow path member 221. For example, it is also possible to constitute the flow path member 268 with one member. It is also possible to constitute the flow path member 268 with three members or to constitute it with more than three members. In this case, it is possible to use various constitutions such as a constitution for which another member is interposed between the first flow path member 99 and the second flow path member 221, or a constitution for which another member is provided further to the side opposite the first flow path member 99 than the second flow path member 221.

With the constitution noted above, the interior of the ink pack 82 reaches from the filter 223 to inside the recess part 235, and passes through the inside of the cavity 123 via the communication path 265 and the flow path 133. Also, the interior of the cavity 123 passes through the interior of the supply tube 88 via the flow path 131. In other words, the interior of the ink pack 82 passes through to outside the ink pack 82 via the recess part 235 interior, the communication path 265, the flow path 133, the cavity 123 interior, the flow path 131, and the supply tube 88 interior in that sequence. Because of this, the path from inside the recess part 235 to inside the supply tube 88 constitutes the ink flow path reaching from the interior of the ink pack 82 to outside the ink pack 82. The flow path that reached from inside the recess part 235 to inside the supply tube 88 extends further to the inside of the ink pack 82 than the welded part 87 with the ink pack 82. Also, the filter 223 is provided on the site further to the inside of the ink pack 82 than the welded part 87 of the flow path that reaches from the inside of the recess part 235 to the inside of the supply tube 88. Also, the interior of the ink pack 82 passes through to the outside of the ink pack 82 via the injection port 263 and the injection port 127. The injection port 127 and the injection port 263 are injection paths when injecting ink into the ink pack 82. After ink is injected into the ink pack 82, the injection port 127 is blocked by thermal caulking or the like.

Figure 29:
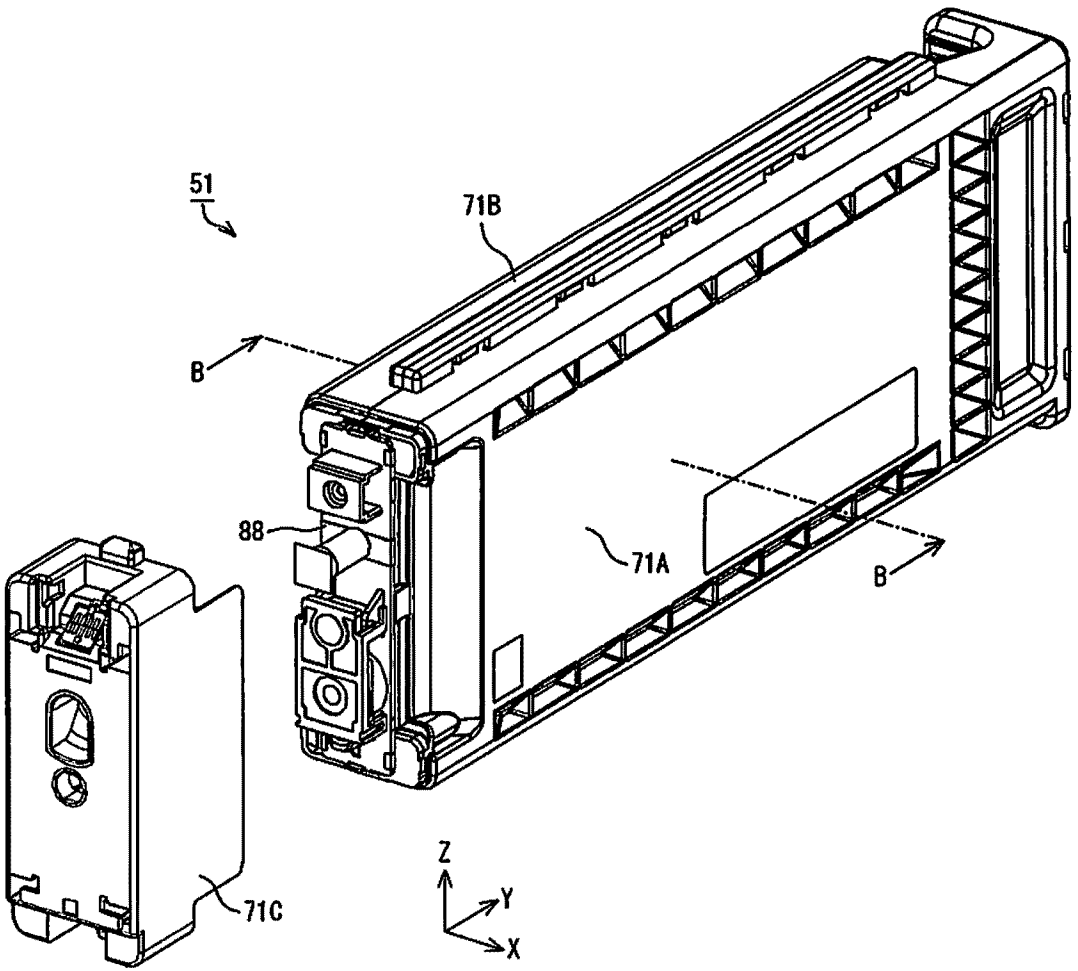
FIG. 29 is an exploded perspective view showing the cartridge of this embodiment.

As shown in FIG. 29, with the pack unit 81, the ink pack 82 is housed between the first case 71A and the second case 71B. In a state with the ink pack 82 housed between the first case 71A and the second case 71B, the flow path unit 83 is exposed to the outside of the area enclosed by the first case 71A and the second case 71B. Also, the cartridge 51 is constituted by the third case 71C covering the flow path unit 83.

Figure 30:
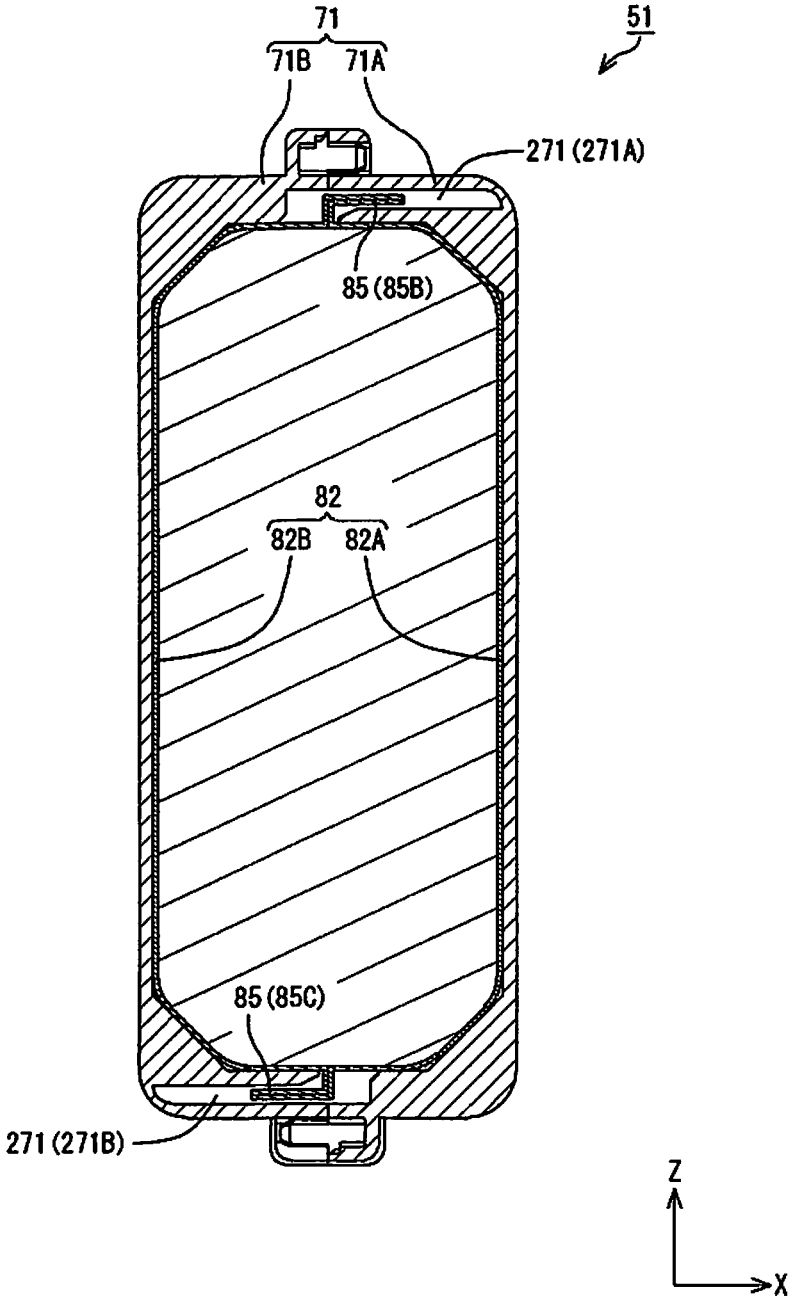
FIG. 30 is a cross section view of line B-B in FIG. 29.

With the cartridge 51, as shown in FIG. 30 which is a cross section diagram of line B-B in FIG. 29, the ink pack 82 is housed inside the case 71 in a state with the peripheral edge area 85 inserted in a groove 271 provided on the interior of the case 71. The groove 271 is provided on both the first case 71A and the second case 71B. Hereafter, when distinguishing between grooves 271 of the first case 71A and the second case 71B, the groove 271 of the first case 71A is noted as groove 271A, and the groove 271 of the second case 71B is noted as groove 271B.

The groove 271A is provided at the end part of the first case 71A in the Z axis positive direction. The groove 271A is provided in a direction that is concave facing the outside of the case 71 in the X axis direction, specifically, facing the X axis positive direction. The groove 271B is provided at the end part of the Z axis negative direction of the second case 71B. The groove 271B is provided in a direction that is concave facing the outside of the case 71 in the X axis direction, specifically, facing the X axis negative direction.

With this embodiment, the end part 85B is inserted in the groove 271A, and the end part 85C is inserted in the groove 271B.

The end part 85B is inserted inside groove 271A in a state bent from the ink pack 82. The end part 85C is inserted in the groove 271B in a state bent from the ink pack 82. Inside the case 71, the end part 85B and the end part 85C are bent facing opposite to each other. Because of this, in FIG. 30 (seen from the front) the ink pack 82 exhibits an S shape. By the end part 85B being inserted inside the groove 271A, and the end part 85C being inserted in the groove 271B, the orientation of the ink pack 82 is maintained inside the case 71.

Figure 31:
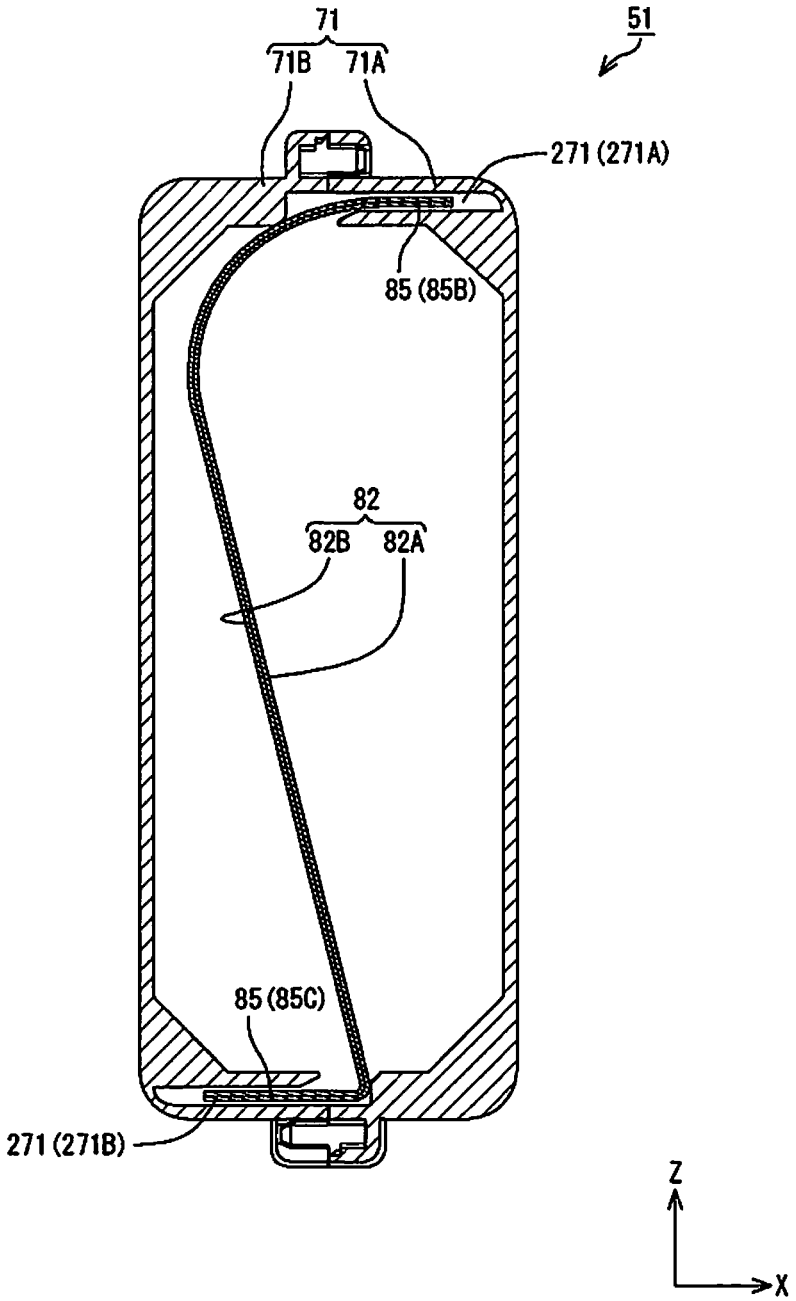
FIG. 31 is a drawing for describing the state of the ink pack of this embodiment.
Figure 32:
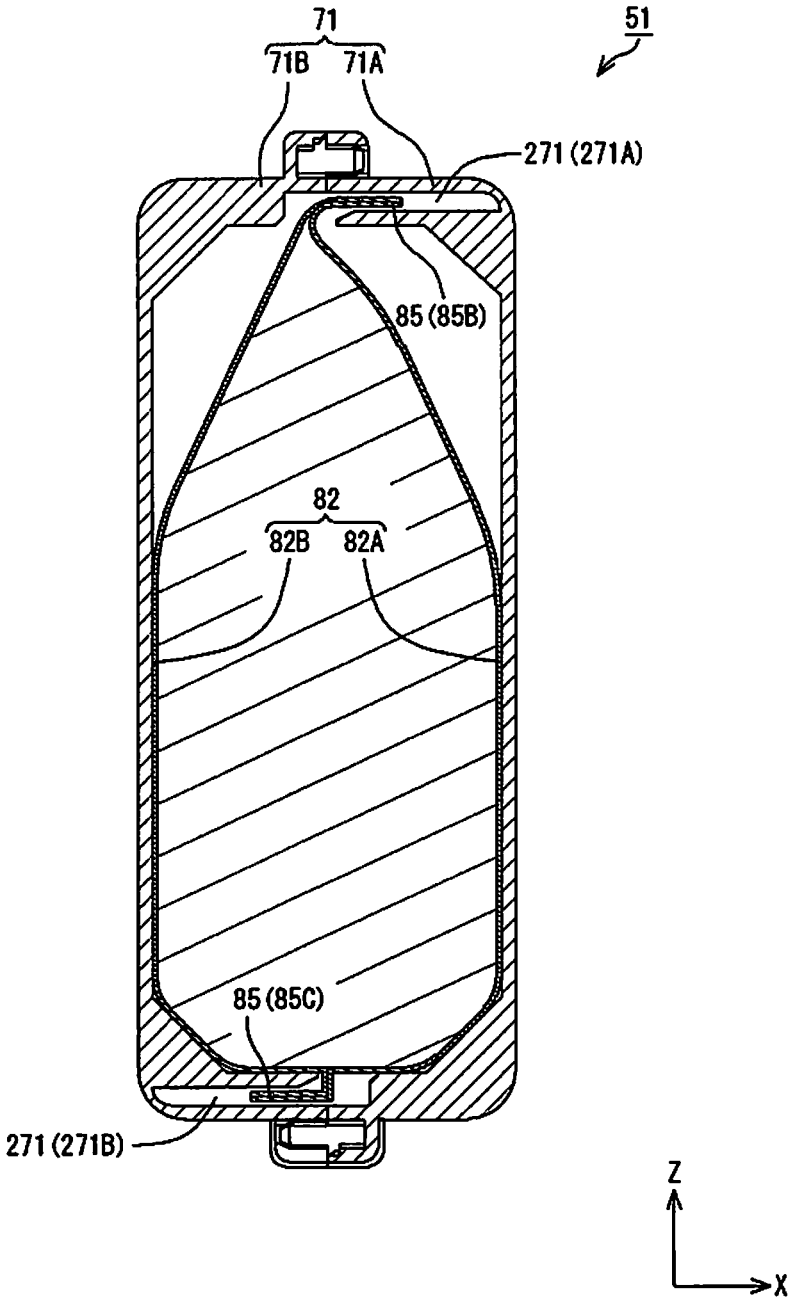
FIG. 32 is a drawing for describing the state of the ink pack of this embodiment.

As shown in FIG. 31, the ink pack 82, at the stage before the ink is injected, is collapsed in a state with the sheet 82A and the sheet 82B in contact with each other. At the stage before the ink is injected into the ink pack 82, the ink pack 82 is inserted between the first case 71A and the second case 71B. At this time, the end part 85B of the ink pack 82 is inserted in the groove 271A, and the end part 85C is inserted in the groove 271B. After the ink pack 82 is inserted between the first case 71A and the second case 71B, ink is injected inside the ink pack 82 from the injection port 127 of the flow path unit 83. At this time, as shown in FIG. 32, the ink pack 82 swells between the first case 71A and the second case 71B according to the volume of ink injected.

Figure 33:
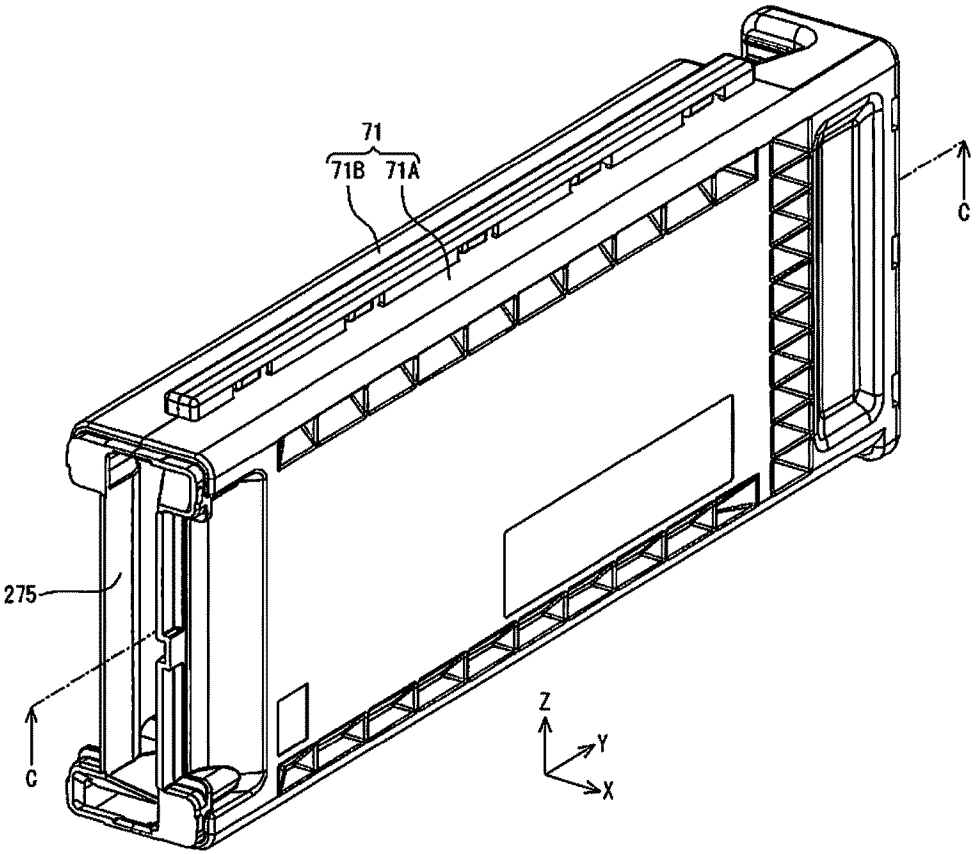
FIG. 33 is a perspective view showing the combined state of the first case and the second case of this embodiment.
Figure 34:
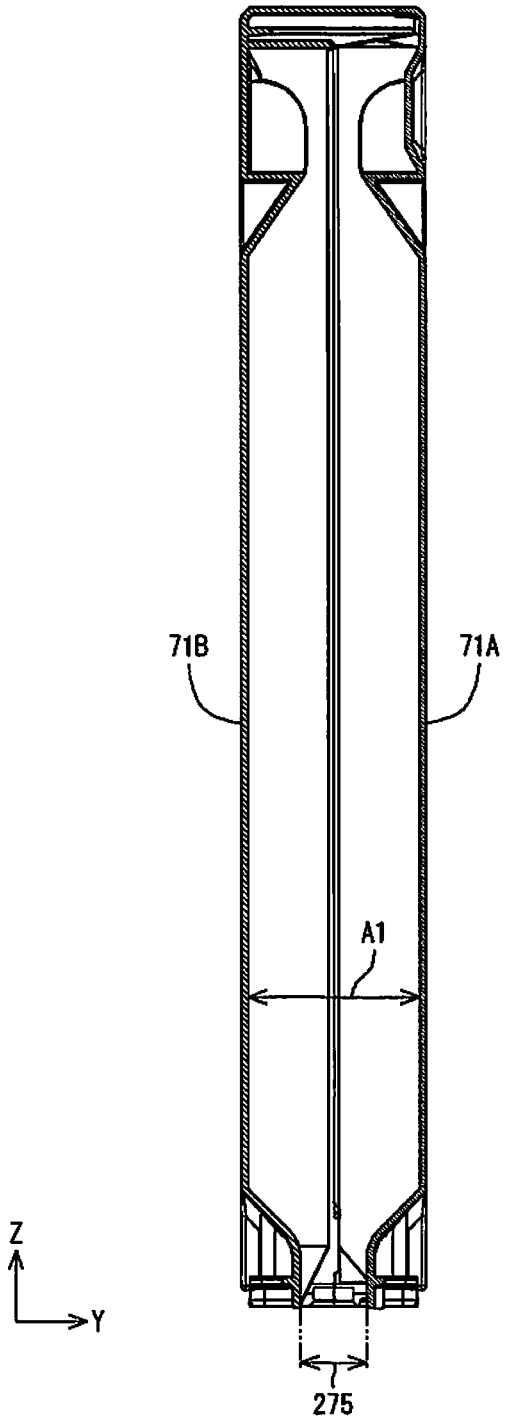
FIG. 34 is a cross section view of line C-C in FIG. 33.
Figure 35:
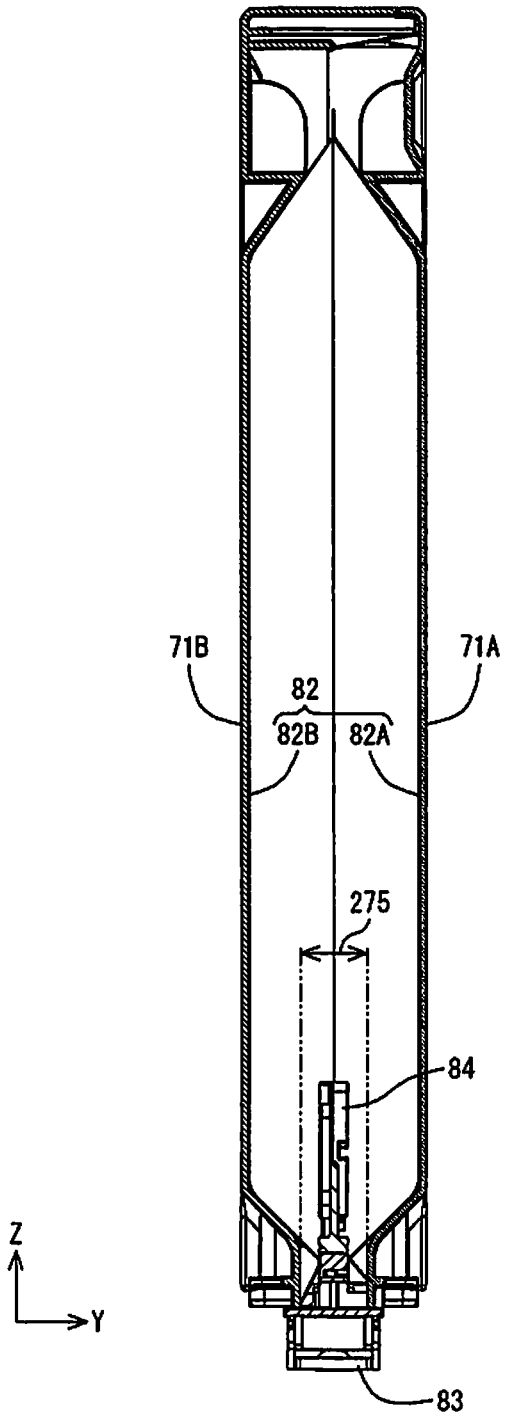
FIG. 35 is a drawing for describing the status of the ink pack of embodiment 1.

Here, when the first case 71A and the second case 71B are combined, as shown in FIG. 33, an opening part 275 is formed. As shown in FIG. 34 which is a cross section diagram of line C-C of FIG. 33, the opening part 275 is narrower than the cross section area A1 along the XZ plane of the space inside the first case 71A and the second case 71B. Because of this, when the ink pack 82 swells to the upper limit inside the case 71 by ink being injected into the ink pack 82, as shown in FIG. 35, the ink pack 82 cannot pass through the opening part 275. Because of this, from the opening part 275 of the mutually combined first case 71A and second case 71B, there are cases when it is not possible to remove the ink pack 82 in which ink is housed. Cases will arise when it is possible to remove the ink pack 82 and when it is not possible to remove the ink pack 82 from the opening part 275 of the first case 71A and the second case 71B based on the ink volume inside the ink pack 82.

We will describe the method of injecting ink in the ink pack 82. With this embodiment, as described above, the injecting of ink in the ink pack 82 is performed in a state with the ink pack 82 inserted between the first case 71A and the second case 71B. However, hereafter to make the constitution easier to understand, an illustration of the first case 71A and the second case 71B will be omitted. Also, for each drawing, a portion of the constitution may be omitted, or a cross section diagram of the constitution may be shown to make the constitution easy to understand.

Figure 36:
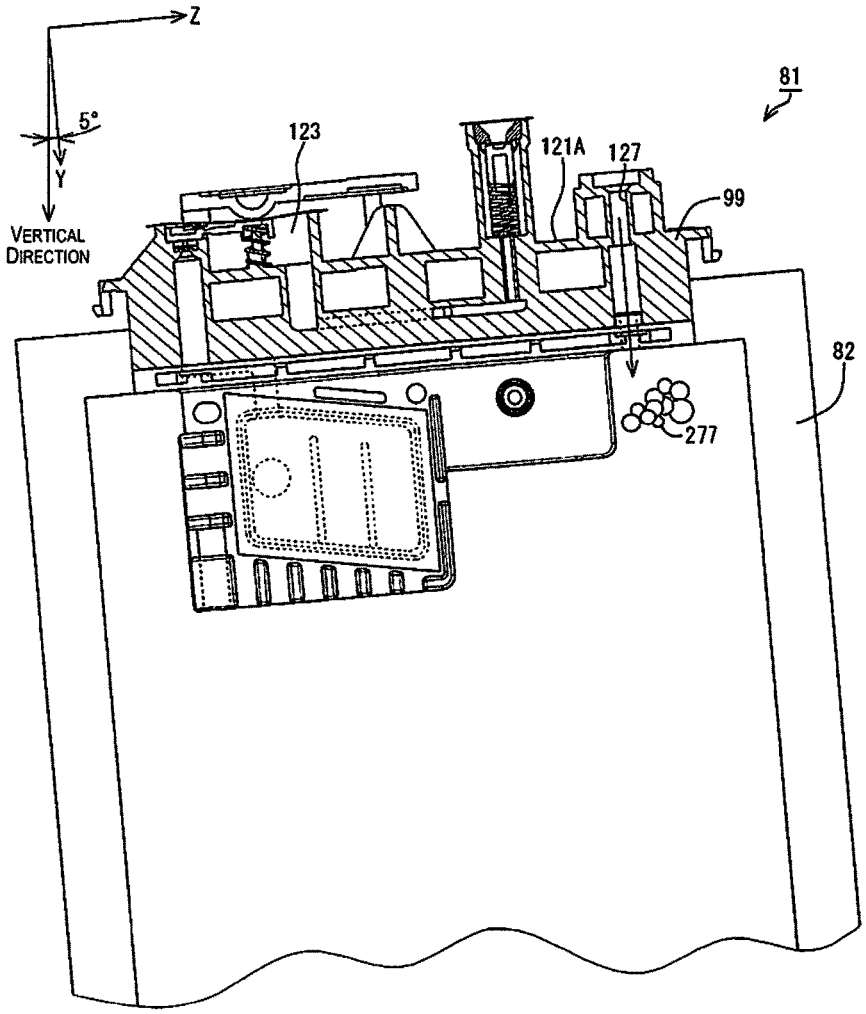
FIG. 36 is a drawing for describing the method of injecting ink to the ink pack of embodiment 1.

With the method of injecting ink in the ink pack 82, first, as shown in FIG. 36, the pack unit 81 is kept in the injection orientation. In the injection orientation, the surface 121A of the first flow path member 99 is facing upward in the vertical direction. In the vertical direction in the drawing, the arrow direction is the vertical downward direction. Furthermore, in the injection orientation, the pack unit 81 is inclined from the vertical direction. In the injection orientation, at the surface 121A, the cavity 123 side is included facing to drop further downward than the injection port 127 side in the vertical direction. With embodiment 1, the incline volume of the pack unit 81 in the injection orientation is set to approximately 5 degrees in relation to the vertical direction.

Figure 37:
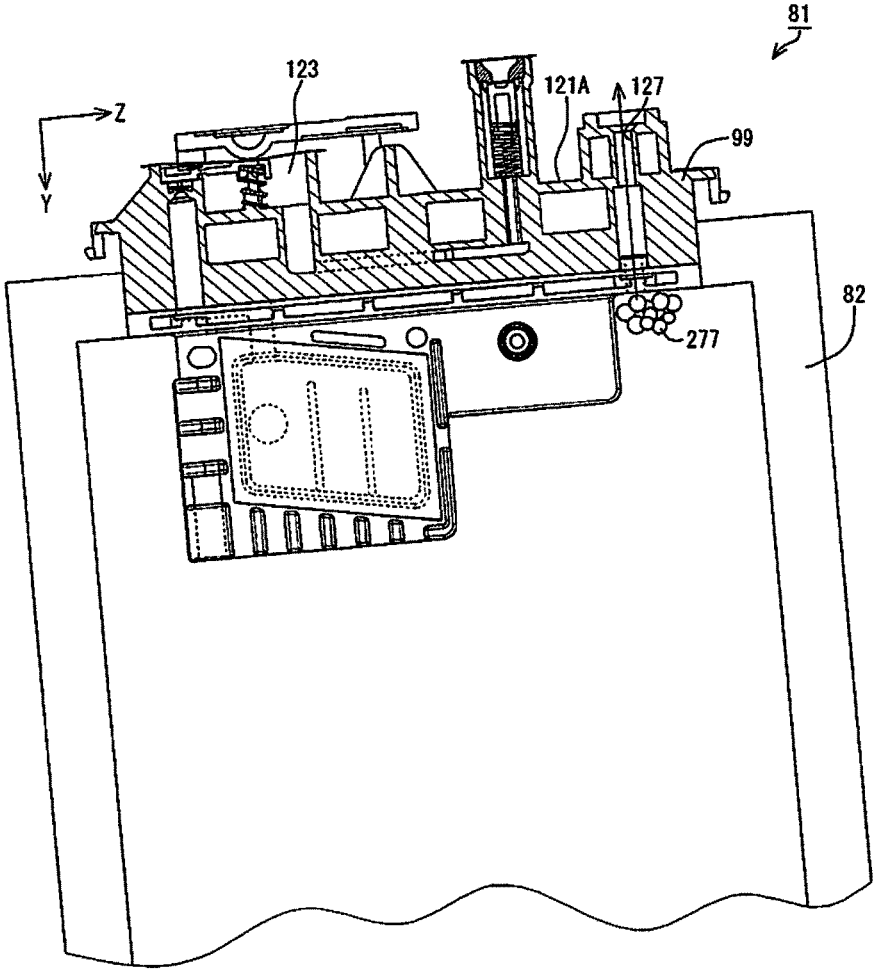
FIG. 37 is a drawing for describing the method of injecting ink to the ink pack of embodiment 1.

Next, with the pack unit 81 kept in the injection orientation, ink from the injection port 127 is injected inside the ink pack 82. By doing this, the ink pack 82 swells between the first case 71A and the second case 71B. At this time, when ink is injected into the ink pack 82, there are cases when air bubbles 277 get mixed in together with the ink inside the ink pack 82. With embodiment 1, the pack unit 81 is kept in the injection orientation, specifically, the pack unit 81 is inclined from the vertical direction, so the air bubbles 277 mixed in inside the ink pack 82 easily concentrate at the injection port 127 side. Furthermore, while kept in the injection orientation, by vibration or shock being given to the ink pack 82, it is easy for the air bubbles 277 to concentrate near the injection port 127. Then, next, as shown in FIG. 37, with the pack unit 81 kept in the injection orientation, the air bubbles 277 in the ink pack 82 are exhausted from the injection port 127.

Figure 38:
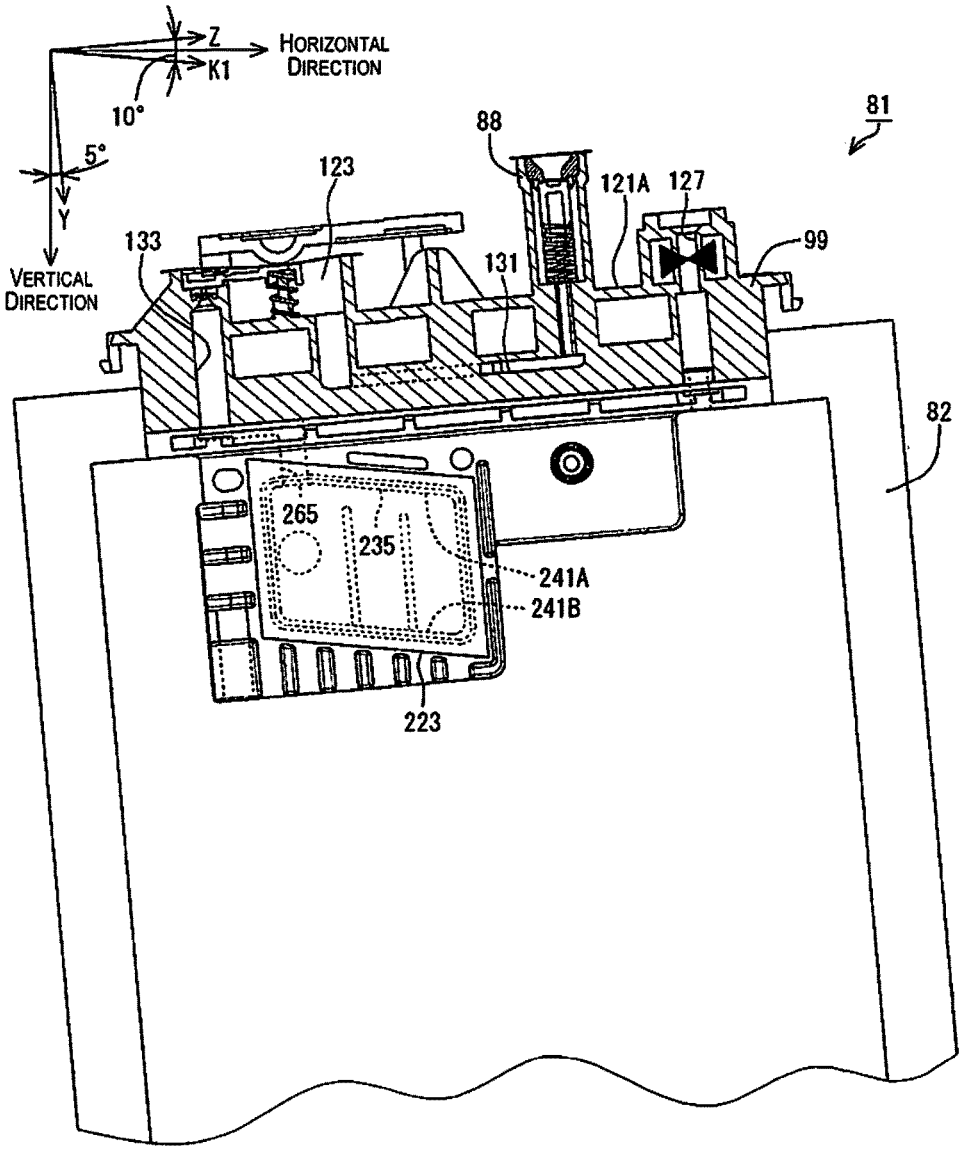
FIG. 38 is a drawing for describing the method of injecting ink to the ink pack of embodiment 1.

Next, as shown in FIG. 38, the injection port 127 is blocked. Next, with the pack unit 81 kept in the injection orientation, by suctioning the interior of the flow path 131 from the supply tube 88, the inside of the recess part 235 is filled with ink. Ink is injected inside the ink pack 82, so the filter 223 is immersed in ink inside the ink pack 82. However it is difficult for ink to enter inside the recess part 235 due to the filter 223. Because of this, gas remains inside the recess part 235. Because of this, by suctioning the inside of the flow path 131 from the supply tube 88, the recess part 235 inside is filled with ink.

As described previously, with embodiment 1, the site 241A and 241B of the contour of the recess part 235 are inclined along the incline direction K1. In other words, the recess part 235 is inclined along the incline direction K1. With embodiment 1, the incline volume of the incline direction K1 in relation to the Z axis direction is set to approximately 10 degrees. Because of this, in a state with the pack unit 81 kept in the injection orientation, the incline direction K1 is inclined facing the downward side from the horizontal direction. At this time, the incline volume of the incline direction K1 in relation to the horizontal direction is approximately 5 degrees. By doing this, the gas inside the recess part 235 concentrates easily facing the communication path 265. As a result, by suctioning the inside of the flow path 131 from the supply tube 88, it is easy to fill the inside of the recess part 235 with ink. Said another way, it is difficult for gas (air bubbles) to remain inside the recess part 235.

Figure 39:
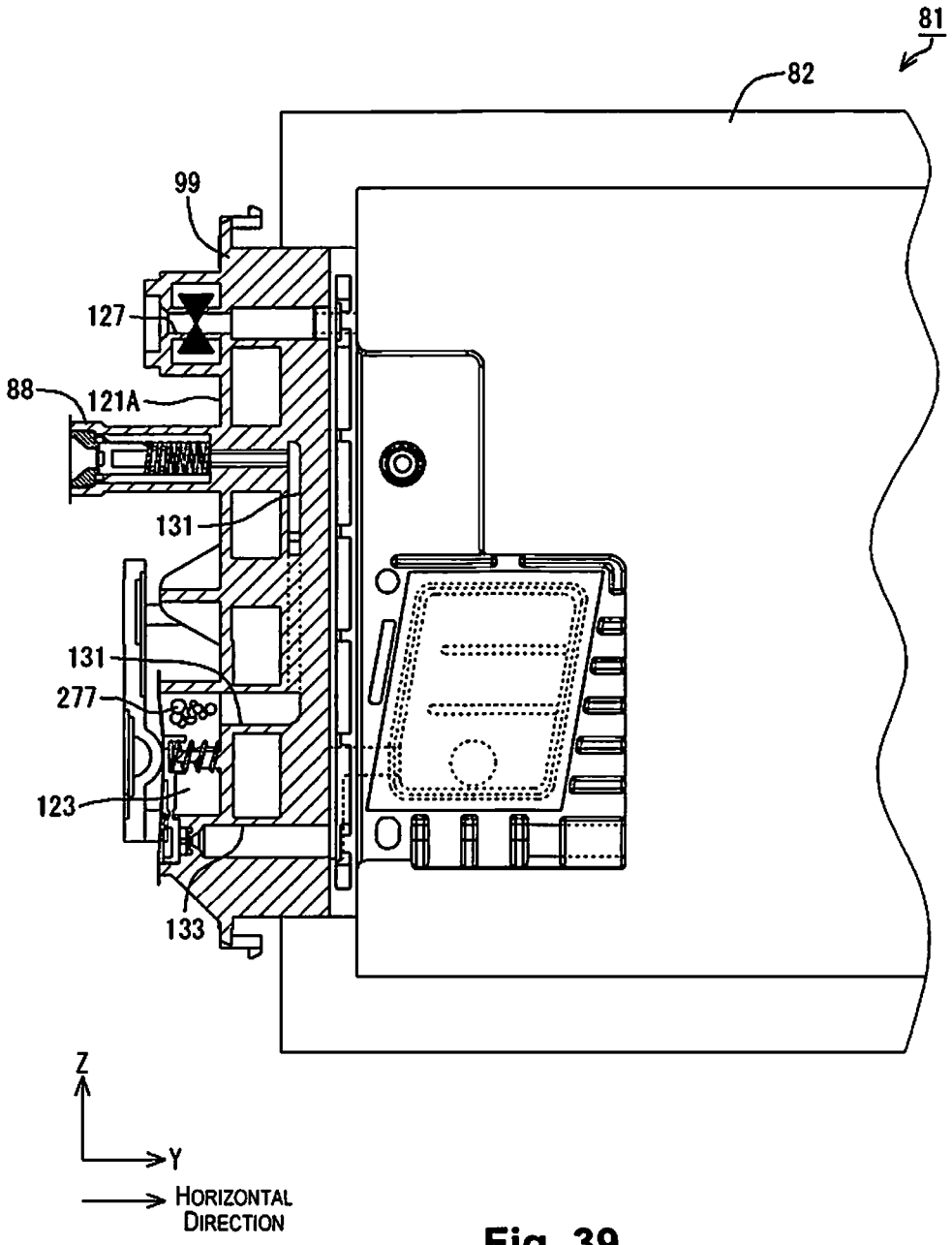
FIG. 39 is a drawing for describing the method of injecting ink to the ink pack of embodiment 1.

Next after the step of filling ink inside the recess part 235, as shown in FIG. 39, the pack unit 81 is kept in a horizontal orientation. In the horizontal orientation, the surface 121A of the first flow path member 99 and the horizontal direction intersect with each other. Also, in the horizontal orientation, the cavity 123 is positioned further downward in the vertical direction than the injection port 127. With embodiment 1, in the horizontal orientation, the angle between the surface 121A and the horizontal direction is set to approximately 90 degrees.

Next, with the pack unit 81 kept in the horizontal orientation, by suctioning the inside of the flow path 131 from the supply tube 88, the air bubbles 277 (gas) inside the cavity 123 are exhausted. By holding the pack unit 81 in the horizontal orientation, it is easy for the air bubbles 277 inside the cavity 123 to concentrate at the flow path 131 side. Because of this, the air bubbles 277 inside the cavity 123 can be more easily exhausted from the supply tube 88.

Next, after blocking the supply tube 88 with the film 119 (FIG. 6), when the third case 71C (FIG. 3) is combined with the first case 71A and the second case 71B, it is possible to manufacture the cartridge 51 (FIG. 2).

With embodiment 1, in the ink flow direction reaching from inside the ink pack 82 to the supply port 181, the filter 223 is provided further to the ink pack 82 side than the supply port 181, specifically, further to the downstream side than the supply port 181 (FIG. 28). The ink inside the ink pack 82 reaches the supply port 181 after passing through the filter 223. Because of this, it is possible to supply ink that was filtered by the filter 223 to the printer 1. By doing this, even if foreign matter or the like is mixed into the ink inside the ink pack 82, it is possible to trap the foreign matter with the filter 223. As a result, it is possible to suppress to a low level the supplying of foreign matter or the like to the printer 1.

Also, with embodiment 1, when the ink inside the ink pack 82 is consumed and the volume of ink inside the ink pack 82 decreases, the ink pack 82 collapses according to the ink consumption volume. When the ink pack 82 collapses, it is easy for the sheet 82A or the sheet 82B to contact the first site 227. For example, if the sheet 82A contacts the filter 223 and the filter 223 is covered by the sheet 82A, the ink inside the ink pack 82 does not easily pass through the filter 223. Because of this, it is easy for supplying of the ink inside the ink pack 82 to the printer 1 to be obstructed. However, with embodiment 1, as shown in FIG. 39, when the bottom part 235A of the recess part 235 is seen in the plan view, the convex part 239 is provided further to the outside than the area of the filter 223. It is easy to ensure a gap between the sheet 82A and the filter 223 using the convex part 239. By doing this, it is easy to avoid the filter 223 being covered by the sheet 82A. With embodiment 1, a plurality of convex parts 239 are provided in a state having a gap with each other, so it is easy to further ensure a gap between the sheet 82A and the filter 223. As a result, it is easy to maintain the flow of ink that reaches from inside the ink pack 82 to the supply port 181.

Also, with embodiment 1, the largest surface 223A of the filter 223 is roughly parallel with the sheet 82A and the sheet 82B respectively (FIG. 23). Because of this, by making the filter 223 larger along the sheet 82A and the sheet 82B, it is possible to enlarge the surface area of the filter 223 while suppressing to a low level the thickness for the ink pack 82 in the X axis direction. By doing this, it is easier to make the cartridge 51 smaller while increasing the trapping function of foreign matter or the like by the filter 223.

Also, with embodiment 1, the flow path unit 83 and the filter unit 84 are constituted as separate units from each other (FIG. 4). Because of this, with the cartridge 51, it is possible to also use a constitution that omits the filter unit 84. In other words, with the cartridge 51, it is possible to selectively use a constitution that uses the filter unit 84 and a constitution that omits the filter unit 84. By doing this, with the cartridge 51, it is possible to share a constitution with the filter unit 84 removed by constituting with a constitution that uses the filter unit 84 and a constitution that omits the filter unit 84.

Also, with embodiment 1, the first site 227 and the second site 229 are housed inside the area overlapping the base part 225 seen from the front (FIG. 24). Because of this, it is easy to keep to a low level the thickness for the ink pack 82 in the X axis direction.

Also, with embodiment 1, the through hole 251 that passes through the convex part 239G along the Y axis direction is provided (FIG. 25). The through hole 251 passes through the opening part 245 at the convex part 239H of the convex part 239G. The flow path that pierces the convex part 239G facing the base part 225 side from the first site 227 side and reaches the convex part 239H after passing through the opening part 245 is constituted by the through hole 251 and the opening part 245. By doing this, the ink pack 82 collapses according to the volume of ink consumed, and even if the sheet 82A and the sheet 82B contact the first site 227, it is easy to ensure an ink flow path that reaches from inside the ink pack 82 to the flow path 133. As a result, it is even easier to maintain the flow of ink that reaches from inside the ink pack 82 to the supply port 181.

Also, with embodiment 1, ribs 253 are provided on the interior of the recess part 235 (FIG. 25). By doing this, it is easy to avoid having the filter 223 contact the bottom part 235A of the recess part 235. For example, even if the filter 223 contacts the bottom part 235A of the recess part 235, it becomes difficult for the ink to pass through the site of the filter 223 in contact with the bottom part 235A. In other words, when the filter 223 contacts the bottom part 235A of the recess part 235, it is easy for the inflow of ink into the recess part 235 to be obstructed. However, with embodiment 1, ribs 253 are provided on the interior of the recess part 235, so it is easy to avoid obstruction of the inflow of the ink into the recess part 235.

Furthermore, with embodiment 1, ribs 253 are provided on the interior of the recess part 235, so it is even easier to avoid having the filter 223 contact the bottom part 235A of the recess part 235. Because of this, it is even easier to avoid obstruction of the inflow of ink to inside the recess part 235.

Furthermore, with embodiment 1, the gate part 255 is provided on the interior of the recess part 235, so it is even easier to avoid having the filter 223 contact the bottom part 235A of the recess part 235. Because of this, it is even easier to avoid obstruction of the inflow of ink inside the recess part 235.

Also, with embodiment 1, the opening part 245, the opening part 247, and the opening part 249 are provided on the first site 227. By doing this, it is easy to ensure an ink flow path that pierces between the surface 231 and the surface 233 of the first site 227. As a result, it is even easier to avoid obstruction of the inflow of ink into the recess part 235.

Also, with embodiment 1, the convex part 239G, the convex part 239H, the convex part 239I, and the convex part 239J also extend to the surface 233 (FIG. 26). By doing this, even if the sheet 82A and the sheet 82B contact the first site 227, the opening part 245, the opening part 247, and the opening part 249 are not blocked easily. Because of this, it is easy to ensure an ink flow path that pierces between the surface 231 and the surface 233 of the first site 227. As a result, it is even easier to avoid obstruction of the inflow of ink into the recess part 235.

Also, with embodiment 1, in the usage orientation of the printer 1, the opening part 247 is positioned further vertically downward than the recess part 235, and the opening part 249 is positioned further to the vertical upward side than the recess part 235 (FIG. 22). By doing this, even if the ink liquid level droplets further down than the opening part 249, it is easy to ensure an ink flow path that pierces between the surface 231 and the surface 233 of the first site 227 by the opening part 247. As a result, it is easy to avoid obstruction of the inflow of ink into the recess part 235.

Also, with embodiment 1, the second site 229 is provided on the flow path member 221. At the flow path member 221, the base part 225, the first site 227, and the second site 229 are connected to each other (FIG. 22). Using the second site 229, it is possible to reduce the inclination of the first site 227 to the base part 225. In particular, with embodiment 1, the flow path member 221 is formed using injection molding, so there are cases when distortion occurs on the flow path member 221 due to the molding. The embodiment 1 is preferable in that the distortion due to molding can be lightened using the second site 229.

Also, with embodiment 1, the second site 229 extends continuously with the first site 227. Also, the gate part 257 is provided on the second site 229 (FIG. 25). By doing this, even if the sheet 82A contacts the second site 229, it is easy to ensure a gap between the second site 229 and the sheet 82A. Because of this, inside the ink pack 82, it is easy to ensure an ink flow path that passes through the inside of the recess part 235. As a result, it is even easier to avoid obstruction of the inflow of ink into the recess part 235.

Also, with embodiment 1, in the usage orientation of the printer 1, the filter 223 extends further to the downward side than the center of the ink pack 82 in the vertical direction (FIG. 28). In the usage orientation of the printer 1, when ink inside the ink pack 82 is consumed, the ink remaining in the ink pack 82 concentrates downward vertically in the ink pack 82. Because of this, it is preferable to have a constitution with which the filter 23 is provided at the vertically downward side of the ink pack 82. With this constitution, even if the ink inside the ink pack 82 is consumed, the ink remaining in the ink pack 82 is easily introduced to inside the recess part 235. As a result, even if the ink inside the ink pack 82 is consumed, it is easy to stably supply ink remaining in the ink pack 82 to the printer 1.

Also, with embodiment 1, in a state with the flow path unit 83 and the filter unit 84 linked to each other, the welded part 86 and the welded part 87 are sandwiched by the sheet 82A and the sheet 82B. Also, the ink pack 82 is welded respectively to the welded part 86 and the welded part 87 (FIG. 5). By doing this, it is easy to suppress the ink inside the ink pack 82 from flowing into the flow path 133 from the matching part (link) of the flow path unit 83 and the filter unit 84, specifically, from flowing into the flow path 133 without going via the filter unit 84.

Embodiment 2

Figure 40:
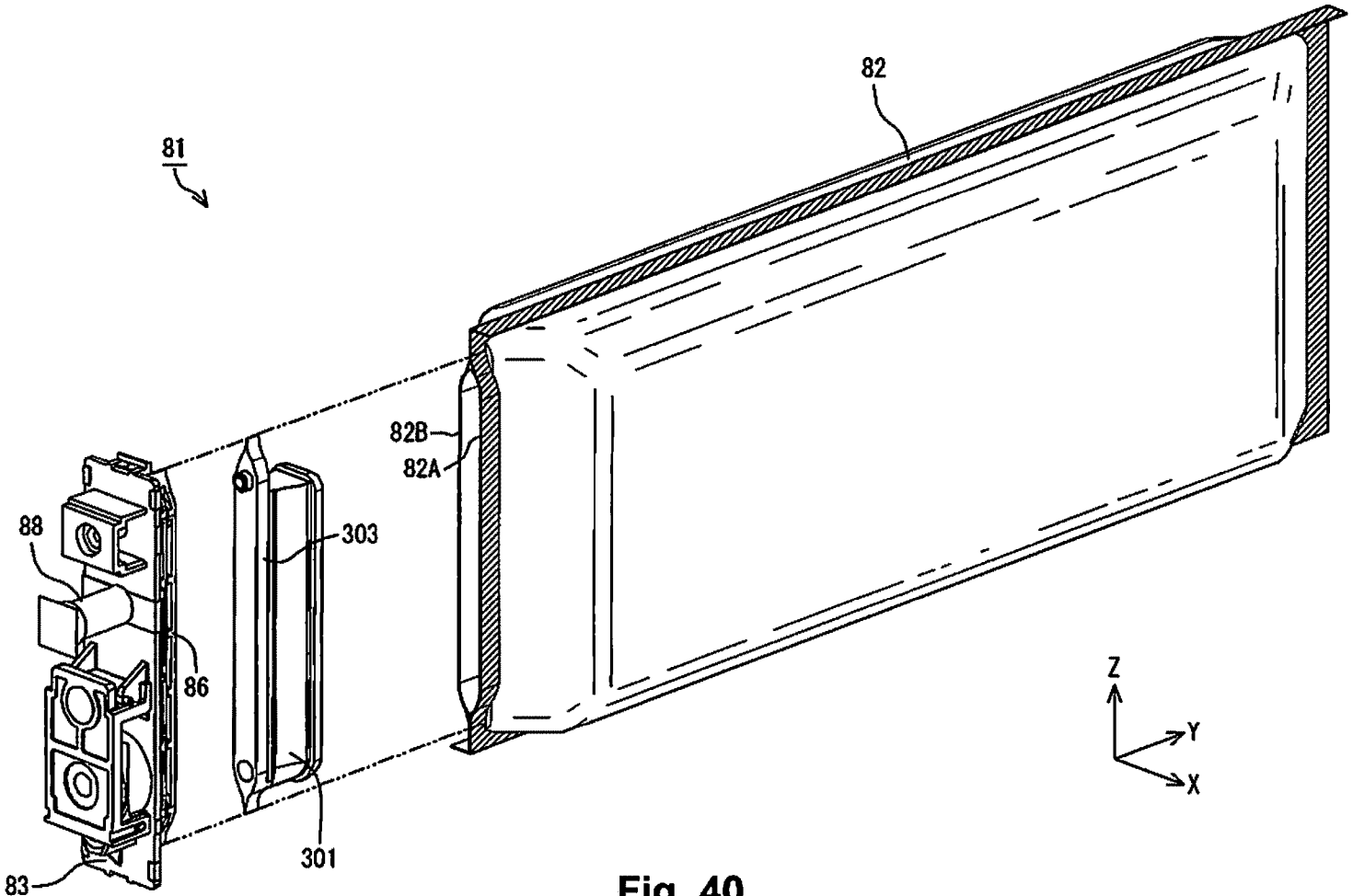
FIG. 40 is an exploded perspective view showing the pack unit of embodiment 2.

As shown in FIG. 40, the pack unit 81 of embodiment 2 has the ink pack 82, the flow path unit 83, and a filter unit 301. The cartridge 51 of embodiment 2, except for switching the filter unit 84 of embodiment 1 with the filter unit 301, has the same constitution as the cartridge 51 of embodiment 1. Hereafter, for the same constitution as that of embodiment 1, the same code numbers as embodiment 1 are given, and a detailed description will be omitted. The flow path unit 83 and the filter unit 301 are combined with each other in the same manner as with embodiment 1.

Figure 41:
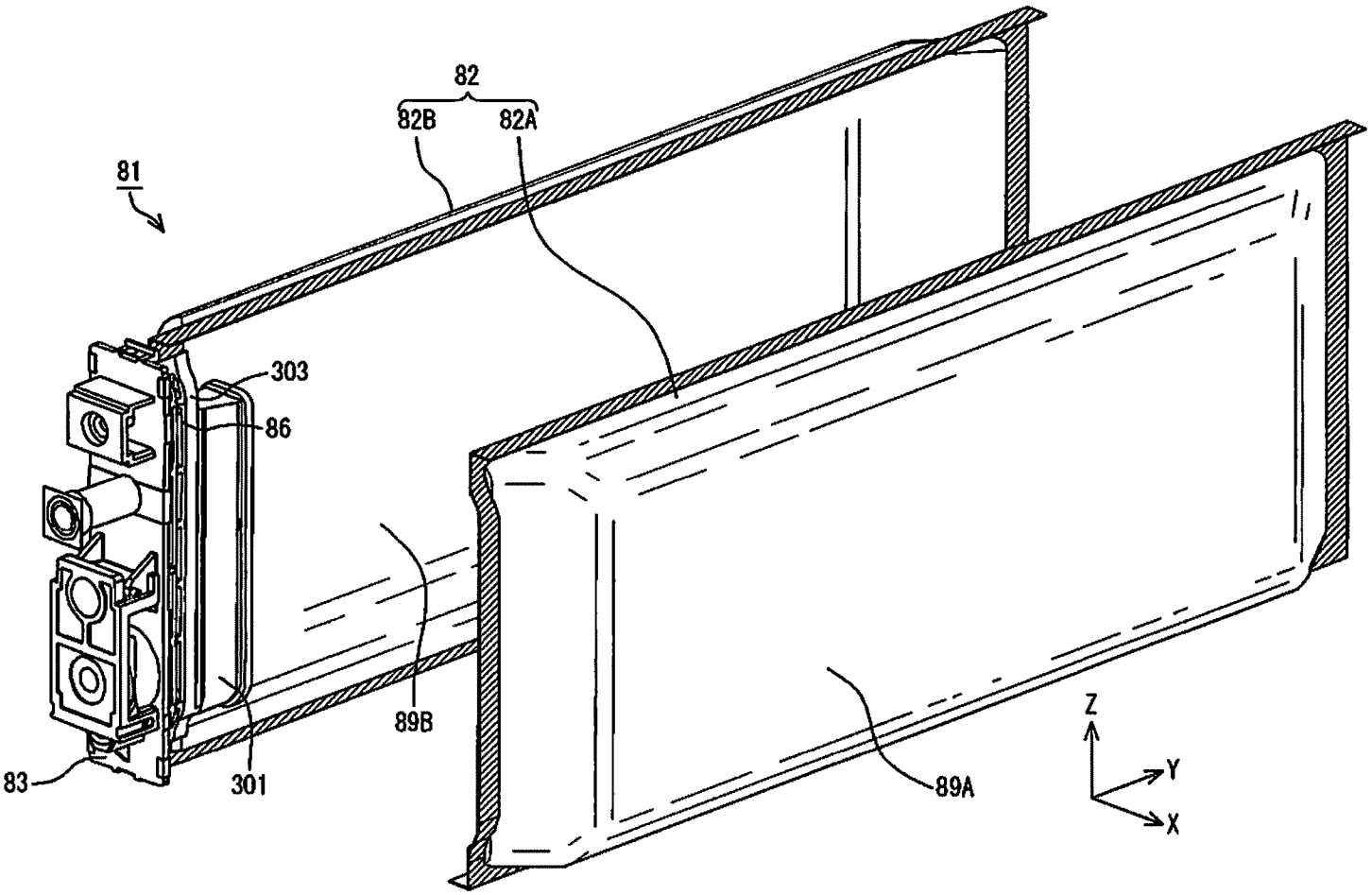
FIG. 41 is an exploded perspective view showing the pack unit of embodiment 2.

The filter unit 301 is housed on the interior of the ink pack 82. The filter unit 301 supplies the ink inside the ink pack 82 to the flow path unit 83 after passing it through a filter described later. As shown in FIG. 41, the filter unit 301 is housed inside the ink pack 82 in a state linked to the flow path unit 83. As shown in FIG. 40, a welded part 303 is provided on the filter unit 301. In a state with the welded part 303 sandwiched by the sheet 82A and the sheet 82B, the sheet 82A and the sheet 82B are welded to the welded part 303. In other words, with embodiment 2 as well, as shown in FIG. 41, in a state with the flow path unit 83 and the filter unit 301 linked to each other, the welded part 86 and the welded part 303 are sandwiched by the sheet 82A and the sheet 82B. Also, the sheet 82A and the sheet 82B are respectively welded to the respective welded part 86 and the welded part 303.

Figure 42:
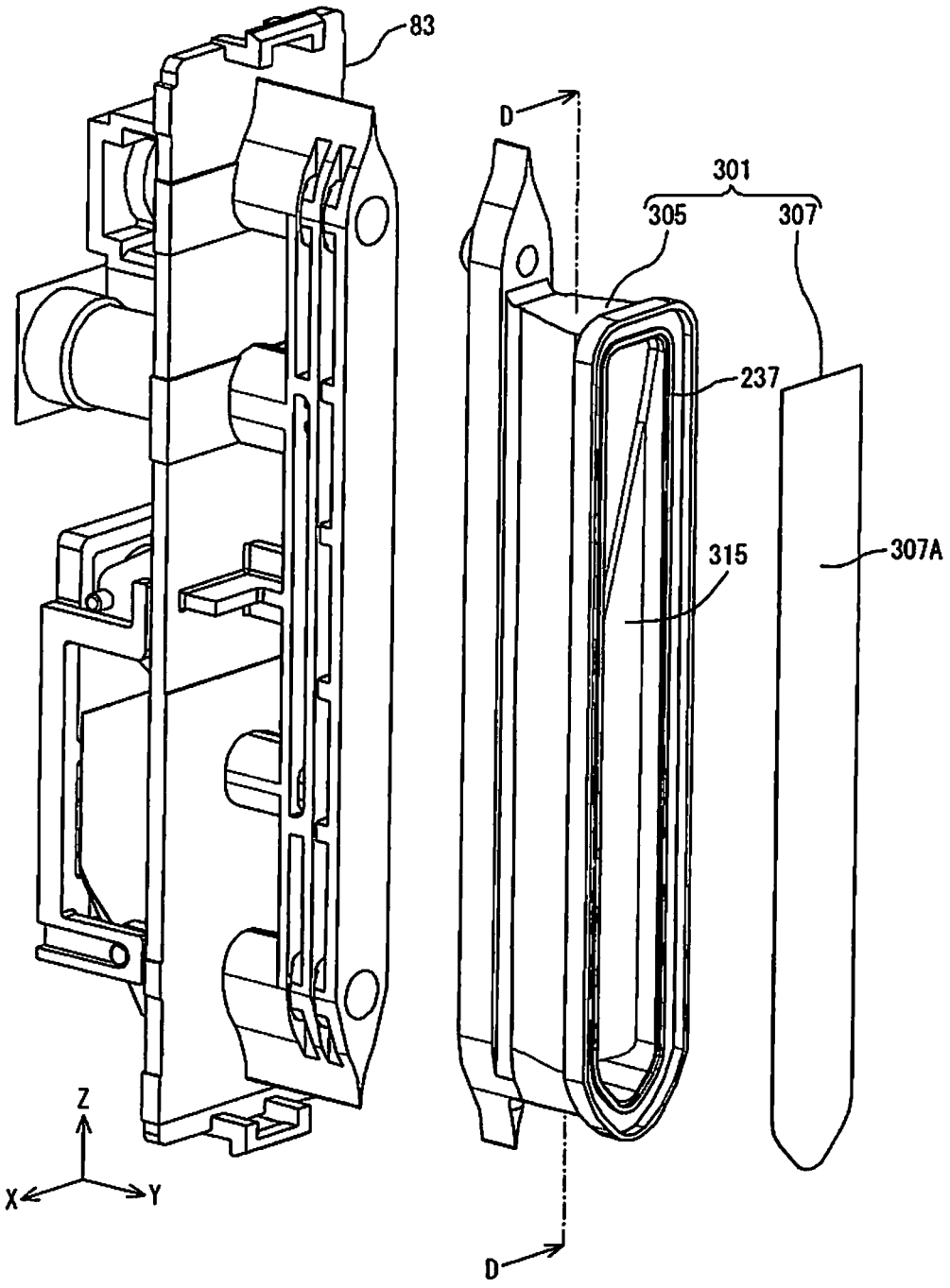
FIG. 42 is a drawing for describing the constitution of the filter unit of embodiment 2.
Figure 43:
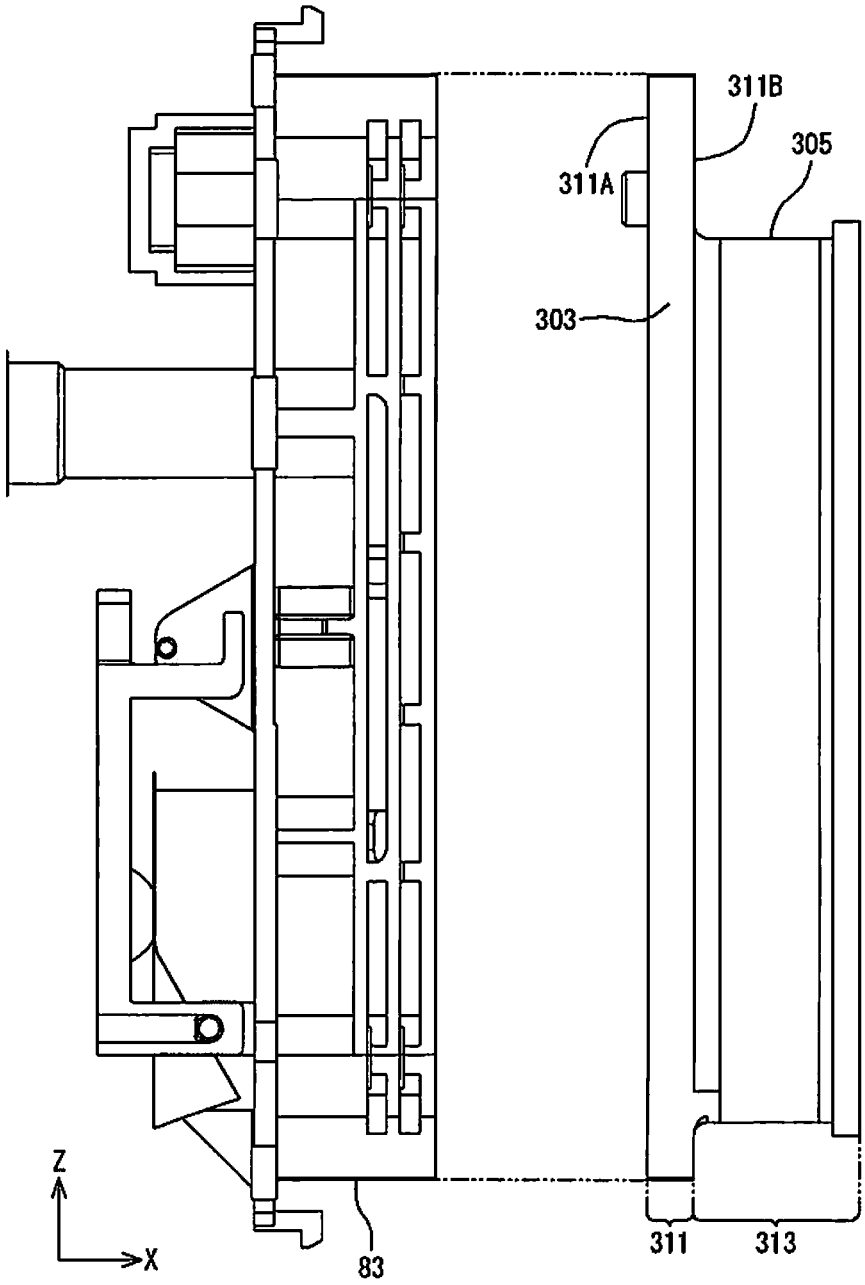
FIG. 43 is a side view showing the filter unit and the flow path unit of embodiment 2.

As shown in FIG. 42, the filter unit 301 has a second flow path member 305 and a filter 307. The second flow path member 305 is constituted using a plastic such as synthetic resin or the like. With the description hereafter, as shown in FIG. 43, the second flow path member 305 is divided into a base part 311 and a filter installation part 313. The base part 311 extends along the Z axis direction. The outer circumference of the base part 311 is set as the welded part 303 described previously. The base part 311 has a surface 311A facing the flow path unit 83 (FIG. 42) side, and a surface 311B on the side opposite the surface 311A. The surface 311A and the surface 311B extend along the XZ plane.

Figure 44:
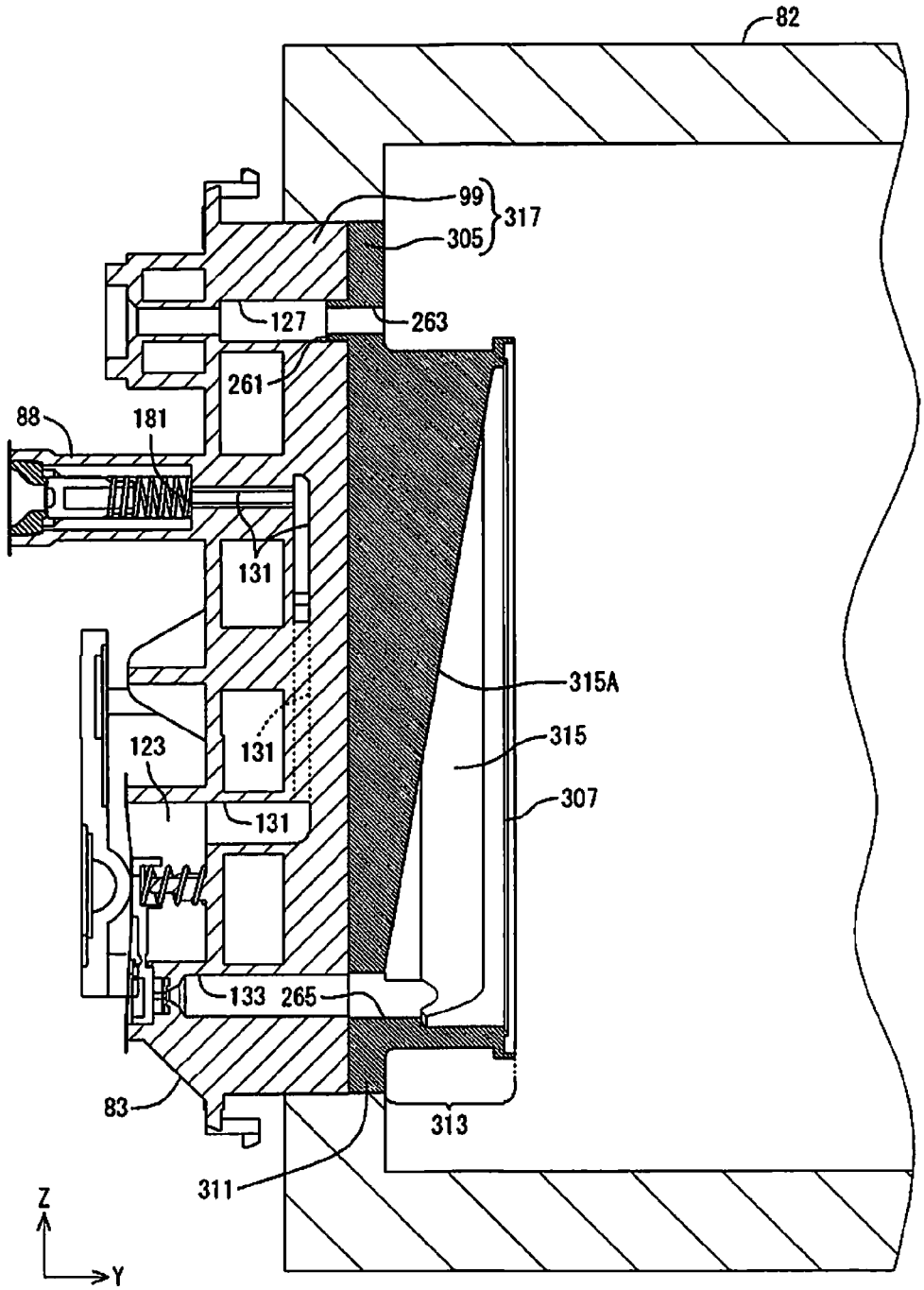
FIG. 44 is a cross section view of line D-D in FIG. 42.

As shown in FIG. 43, the filter installation part 313 protrudes from the surface 311B toward the side opposite the flow path unit 83 side, specifically, toward the ink pack 82 side. As shown in FIG. 42, a recess part 315 is provided on the filter installation part 313. The recess part 315 is provided on the side opposite the base part 311 side of the filter installation part 313. As shown in FIG. 44 which is a cross section diagram of line D-D in FIG. 42, the recess part 315 is provided in the direction that is concave facing the base part 311 side from the side opposite the base part 311 side of the filter installation part 313. A bottom part 315A of the recess part 315 is inclined facing as it approaches the base part 311 as it faces the cavity 123 side from the injection port 127 side in the Z axis direction.

The same as with embodiment 1, a protruding part 261 is provided on the base part 311. The protruding part 261 protrudes from the surface 311A of the base part 311 facing the side opposite the filter installation part 313 side of the base part 311, specifically, facing the flow path unit 83 side. Also, the same as with embodiment 1, an injection port 263 is provided on the protruding part 261. The injection port 263 pierces the protruding part 261 and the base part 311 along the Y axis direction. Also, the same as with embodiment 1, a communication path 265 is provided on the side opposite the protruding part 261 side of the base part 311 in the Z axis direction. The communication path 265 pierces the base part 311 in the Y axis direction and passes through the inside of the recess part 315. By doing this, the interior of the recess part 315 passes through the flow path 133 via the communication path 265.

As shown in FIG. 42, the filter 307 is provided on the side opposite the flow path unit 83 side of the second flow path member 305, specifically, the ink pack 82 side of the second flow path member 305. The filter 307 has a largest surface 307A. The largest surface 307A extends along the XZ plane. The filter 307 is of a size that covers the recess part 315. Furthermore, the filter 307 is of a size that covers the embankment part 237 and the recess part 315. In a state covering the embankment part 237 and the recess part 315, the filter 307 is joined to the embankment part 237 along the entire circumference of the embankment part 237. With embodiment 2, the embankment part 237 is provided along the contour of the opening of the recess part 315, and across the contour of the opening part of the recess part 315. With embodiment 2 as well, the filter 307 is welded to the embankment part 237. As the material of the filter 307, for example, it is possible to use non-woven fabric, fabric, metal mesh or the like.

With embodiment 1, the largest surface 223A of the filter 223 is roughly parallel respectively with the sheet 82A and sheet 82B. In contrast to embodiment 1, with embodiment 2, the largest surface 307A of the filter 307 is provided in the direction intersecting the filter 223. In other words, with embodiment 1 and embodiment 2, the filter 223 and the filter 307 are facing directions intersecting each other. Because of this, with embodiment 2, as shown in FIG. 41, the filter 307 is regarded as being provided in a direction respectively intersecting the surface 89A of the sheet 82A and the surface 89B of the sheet 82B. With embodiment 2, the largest surface 223A of the filter 307 faces the XZ plane, so the largest surface 223A of the filter 307 is provided in a direction roughly orthogonal to the sheet 82A and the sheet 82B respectively. Also, as shown in FIG. 45, with embodiment 2, the filter installation part 313 and the filter 307 stick out from the area overlapping the base part 311 seen from the front.

Using the constitution noted above, with embodiment 2, as shown in FIG. 44, the interior of the ink pack 82 reaches from the filter 307 to inside the recess part 315, and passes through the interior of the cavity 123 via the communication path 265 and the flow path 133. Also, the interior of the cavity 123 passes through the interior of the supply tube 88 via the flow path 131. By combining the first flow path member 99 and the second flow path member 305, the flow path member 317 is constituted. The members constituting the flow path member 317 are not limited to the two items of the first flow path member 99 and the second flow path member 305. For example, it is also possible to constitute the flow path member 317 with one member. Also, it is possible to constitute the flow path member 317 with three members, or to constitute it with more than three members. In this case, it is possible to use various constitutions such as a constitution with which another member is interposed between the first flow path member 99 and the second flow path member 305, or a constitution with which another member is provided further to the side opposite the first flow path member 99 than the second flow path member 305.

With embodiment 2 as well, the same effects can be obtained as with embodiment 1. Furthermore, with embodiment 2, the filter 207 is provided in the direction intersecting the sheet 82A and the sheet 82B respectively. By doing this, it is possible to avoid the sheet 82A and the sheet 82B contacting the filter 307, and the filter 307 being covered by the sheet 82A and the sheet 82B.

Figure 45:
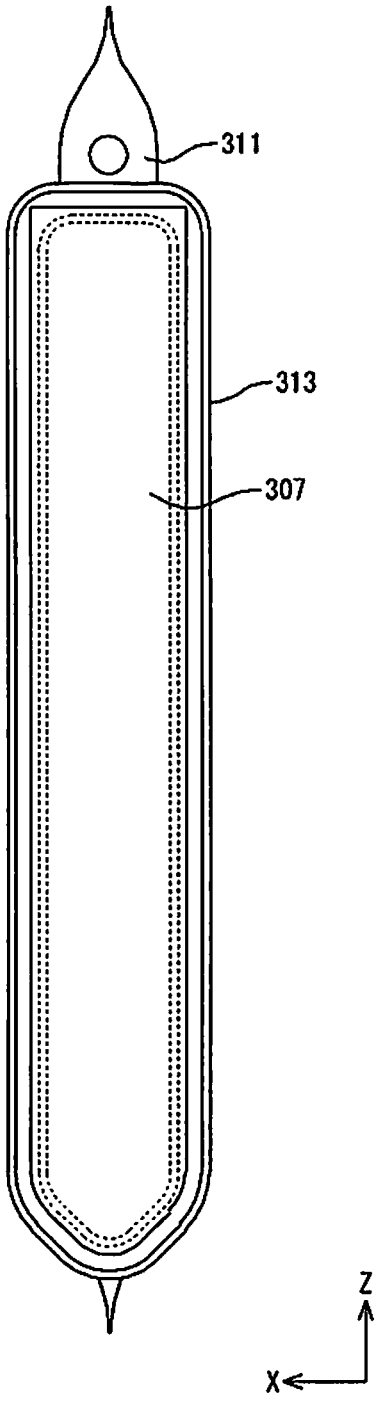
FIG. 45 is a rear view showing the filter unit of embodiment 2.

Also, with embodiment 2, the filter installation part 313 and the filter 307 stick out from the area overlapping the base part 311 seen from the front (FIG. 45). This is because the width dimension of the filter installation part 313 in the X axis direction expands facing the ink pack 82 side from the base part 311 side (FIG. 42). By doing this, it is possible to broaden the width dimension of the ink pack 82 side of the filter installation part 313 while suppressing the width dimension of the base part 311 side of the filter installation part 313 to a level equal to that of the base part 311. Because of this, it is possible to increase the surface area of the filter 307. As a result, at the base part 311 side, while keeping the width dimension of the pack unit 81 narrow, it is possible to enlarge the surface area of the filter 307 further to the ink pack 82 side than the base part 311. By doing this, it is easy to make the cartridge 51 more compact while improving the capacity to trap foreign matter or the like by the filter 223.

Also, with embodiment 2, as shown in FIG. 44, the bottom part 315A of the recess part 315 is inclined facing as it approaches the base part 311 side as it faces the communication path 265 side from the injection port 263 side in the Z axis direction. By doing this, it is easy to guide ink to the communication path 265 inside the recess part 315. Because of this, it is possible to make it easier to guide ink to the flow path 133, and it is easy to maintain the flow of ink reaching from inside the ink pack 82 to the supply port 181.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid holding container comprising:

a housing unit constituted in a bag form by a flexible sheet member, and configured and arranged to house ink as liquid inside;

a flow path member extending through the sheet member between an outside and an interior of the housing unit, the flow path member defining a flow path configured and arranged to deliver the ink from the interior of the housing unit to the outside of the housing unit, and the flow path member having a supply tube connected to a printer; and a filter disposed in the flow path member and attached to the flow path member in the interior of the housing unit, wherein the flow path member and the sheet member are joined at a junction part, the flow path extends further to an inside of the housing unit than the junction part, the filter in the flow path member is disposed at a location further to the inside of the housing unit than the junction part, the flow path member is constituted by a plurality of members including a first flow path member exposed to the outside of the housing unit, and a second flow path member connected directly to the first flow path member and housed in the interior of the housing unit, the filter is disposed in the second flow path member, and the second flow path member includes a base part, a first site protruding from the base part with the filter being disposed in the first site, and a second site protruding from the base part and connected to the first site, the second site being a plate continuous with the first site, the second site including a gate part which is convex facing toward the sheet member, and the gate part protruding further toward the sheet member than the filter.

2. The liquid holding container according to claim 1, wherein a link between the first flow path member and the second flow path member is covered by the junction part.

3. The liquid holding container according to claim 1, wherein the junction part extends to a periphery of the flow path member, and when an area enclosed by the junction part is seen in a plan view, the second flow path member and the filter are inside the area.

4. The liquid holding container according to claim 1, wherein a largest surface among a plurality of surfaces of the filter is parallel to a largest surface among a plurality of surfaces of the housing unit.

5. The liquid holding container according to claim 4, wherein the flow path member includes a convex part protruding further outward than the filter.

6. The liquid holding container according to claim 5, wherein the flow path member includes a plurality of the convex parts with a gap being defined between each of the plurality of the convex parts, and the plurality of convex parts are provided in a periphery of the filter to surround at least a part of the filter.

7. The liquid holding container according to claim 6, wherein at least one of the plurality of convex parts includes a through hole extending through the at least one of the convex parts in a direction intersecting a direction orthogonal to the largest surface of the filter.

8. The liquid holding container according to claim 4, wherein the flow path member includes an opening part extending through the flow path member in a direction intersecting the largest surface further to the outside than the area of the largest surface of the filter.

9. The liquid holding container according to claim 8, wherein the flow path member includes a plurality of the opening parts, in the orientation when the liquid holding container is used, a first opening part among the plurality of the opening parts is positioned further downward in a vertical direction than the filter, and a second opening part among the plurality of the opening parts is positioned further upward in the vertical direction than the first opening part.

10. The liquid holding container according to claim 1, wherein in the orientation in which the liquid holding container is used, the filter extends further to a downward side than a center of the housing unit in a vertical direction.

11. The liquid holding container according to claim 1, wherein a largest surface among a plurality of surfaces of the filter intersects a largest surface among a plurality of surfaces of the housing unit.

12. The liquid holding container according to claim 11, wherein the junction part extends to a periphery of the flow path member, and when an area enclosed by the junction part is seen in a plan view, the filter extends from within the area to outside the area.

13. A liquid holding container comprising:

a housing unit constituted in a bag form by a flexible sheet member, and configured and arranged to house ink as liquid inside;

a flow path member extending through the sheet member between an outside and an interior of the housing unit, the flow path member defining a flow path configured and arranged to deliver the ink from the interior of the housing unit to the outside of the housing unit, and the flow path member having a supply tube connected to a printer; and a filter disposed in the flow path member and attached to the flow path member in the interior of the housing unit, wherein the flow path member and the sheet member are joined at a junction part, the flow path extends further to an inside of the housing unit than the junction part, the filter in the flow path member is disposed at a location further to the inside of the housing unit than the junction part, the flow path member is constituted by a plurality of members including a first flow path member exposed to the outside of the housing unit, and a second flow path member connected directly to the first flow path member and housed in the interior of the housing unit, the filter is disposed in the second flow path member such that a largest surface among a plurality of surfaces of the filter is parallel to a largest surface among a plurality of surfaces of the second flow path member, the first flow path member and the second flow path member contact each other in a state in which a surface of the first flow path member and a surface of the second flow path member face each other, and the second flow path member includes base part, a first site protruding from the base part with the filter being disposed in the first site and a second site protruding from the base part and connected to the first site, the second site being a plate continuous with the first site, the second site including a gate part which is convex facing toward the sheet member, and the gate part protruding further toward the sheet member than the filter.

14. A liquid holding container comprising:

a housing unit constituted in a bag form by a flexible sheet member, and configured and arranged to house ink as liquid inside;

a flow path member extending through the sheet member between an outside and an interior of the housing unit, the flow path member defining a flow path configured and arranged to deliver the ink from the interior of the housing unit to the outside of the housing unit, and the flow path member having a supply tube connected to a printer; and a filter disposed in the flow path member and attached to the flow path member in the interior of the housing unit, wherein the flow path member and the sheet member are joined at a junction part, the flow path extends further to an inside of the housing unit than the junction part, the filter in the flow path member is disposed at a location further to the inside of the housing unit than the junction part, the flow path member includes an embankment part protruding from the flow path member along a direction intersecting a largest surface among a plurality of surfaces of the sheet member, the filter is attached to the embankment part, a largest surface among a plurality of surfaces of the filter is parallel to a largest surface among a plurality of surfaces of the housing unit, the flow path member includes a plurality of convex parts protruding further outward than the filter, with a gap being defined between each of the plurality of the convex parts, the plurality of convex parts are provided in a periphery of the filter to surround at least a part of the filter, the plurality of the convex parts are arranged along a vertical direction, and the plurality of convex parts have horizontal dimensions in a direction orthogonal to the vertical direction, the horizontal dimensions of the plurality of convex carts being configured such that the horizontal dimension of the convex part located in a lower position along the vertical direction is greater than the horizontal dimension of the convex part located in an upper position along the vertical direction.

15. The liquid holding container according to claim 6, wherein the plurality of the convex parts are arranged along a vertical direction, and the plurality of convex parts have horizontal dimensions in a direction orthogonal to the vertical direction, the horizontal dimensions of the plurality of convex parts being configured such that the horizontal dimension of the convex part located in a lower position along the vertical direction is greater than the horizontal dimension of the convex part located in an upper position along the vertical direction.

16. The liquid holding container according to claim 1, wherein a largest surface among a plurality of surfaces of the filter is parallel to a largest surface among a plurality of surfaces of the second flow path member.

17. The liquid holding container according to claim 1, wherein the sheet member includes a first sheet member and a second sheet member, the junction part is a part in which the first sheet member and the second sheet member are welded in a state where the first sheet member and the second sheet member overlap, and the second flow path member is located inside the housing unit with respect to the junction part.

* * * * *